US005490945A

United States Patent [19]

Smith et al.

[11] Patent Number: 5,490,945

[45] Date of Patent: Feb. 13, 1996

[54] LUBRICATING COMPOSITIONS AND CONCENTRATES

[75] Inventors: Thomas R. Smith, Seven Hills; Mary F. Salomon, Mayfield Village; Kirk E. Davis, Chester Township; Jack L. Karn, Richmond Height; John M. Cahoon, Mentor, all of Ohio

[73] Assignee: The Lubrizol Corporation, Wickliffe, Ohio

[21] Appl. No.: 234,208

[22] Filed: Apr. 28, 1994

Related U.S. Application Data

[63] Continuation-in-part of Ser. No. 884,102, May 15, 1992, abandoned, which is a continuation-in-part of Ser. No. 688,195, Apr. 19, 1991, abandoned, and Ser. No. 690,179, Apr. 19, 1991, abandoned.

[51] Int. Cl.[6] ..... C10M 125/00; C10M 133/56

[52] U.S. Cl. ..... 252/18; 252/51.5 A

[58] Field of Search ..... 252/18, 51.5 A

[56] References Cited

U.S. PATENT DOCUMENTS

| | | | |
|---|---|---|---|
| 2,298,660 | 10/1942 | Stevens | 260/624 |
| 2,316,080 | 4/1943 | Loane | 252/48 |
| 2,316,082 | 4/1943 | Loane | 252/48 |
| 2,921,901 | 1/1960 | Karee | 252/32.7 |
| 3,003,959 | 10/1961 | Wilson | 252/32.7 |
| 3,042,613 | 7/1962 | Lammon | 252/32.7 |
| 3,087,936 | 4/1963 | Le Suer | 260/326.3 |
| 3,127,348 | 3/1964 | Verstieg | 252/32.7 |
| 3,172,892 | 3/1965 | Le Suer | 260/326.5 |
| 3,182,019 | 5/1965 | Wilks | 252/32.7 |
| 3,215,707 | 11/1965 | Rense | 260/326.3 |
| 3,219,666 | 11/1965 | Norman | 260/268 |
| 3,271,310 | 9/1966 | Le Suer | 252/35 |
| 3,272,746 | 9/1966 | Le Suer | 252/47.5 |
| 3,312,618 | 4/1967 | Le Suer | 252/33 |
| 3,377,282 | 4/1968 | Bell | 252/32.7 |
| 3,454,607 | 7/1969 | Le Suer | 260/408 |
| 3,522,179 | 7/1970 | Le Suer | 252/51.5 |
| 3,562,159 | 2/1971 | Mastin | 252/32.7 |
| 3,654,152 | 4/1972 | Corringer | 252/32.7 |
| 4,234,435 | 11/1980 | Meinhardt | 252/51.5 A |
| 4,283,294 | 8/1981 | Clarke | 252/32.7 R |
| 4,326,972 | 4/1982 | Chamberlain | 252/33.3 |
| 4,528,108 | 7/1985 | Grover | 252/75 |
| 4,579,666 | 4/1986 | Schroeck | 252/32.7 E |
| 4,867,890 | 9/1989 | Colclough | 252/32.7 E |
| 4,867,891 | 9/1989 | Hunt | 252/33 |
| 4,904,401 | 2/1990 | Ripple | 252/32.7 E |
| 4,938,881 | 7/1990 | Ripple | 252/32.7 E |
| 4,952,328 | 8/1990 | Davis | 252/32.7 E |
| 4,957,649 | 9/1990 | Ripple | 252/32.7 E |
| 4,981,602 | 1/1991 | Ripple | 252/32.7 E |

FOREIGN PATENT DOCUMENTS

| | | |
|---|---|---|
| 1055700 | 6/1979 | Canada . |
| 0309105 | 3/1989 | European Pat. Off. . |
| 0323088 | 7/1989 | European Pat. Off. . |
| 0330523 | 8/1989 | European Pat. Off. . |
| 0462319 | 12/1991 | European Pat. Off. . |
| 0465118 | 1/1992 | European Pat. Off. . |
| 0482759 | 4/1992 | European Pat. Off. . |
| 2062672 | 5/1981 | United Kingdom . |

OTHER PUBLICATIONS

McGeehan, "Some Effects of Zinc Dithiophosphates and Detergents on Controlling Engine Wear", SAE, 1986, pp. 879–892 Month (Month N/A).

*Primary Examiner*—Ellen M. McAvoy

*Attorney, Agent, or Firm*—Frederick D. Hunter; Joseph P. Fischer

[57] ABSTRACT

A lubricating oil composition is described which comprises a major amount of an oil of lubricating viscosity and (A) at least about 1% by weight of at least one carboxylic derivative composition produced by reacting (A-1) at least one substituted succinic acylating agent containing at least about 50 carbon atoms in the substituent with (A-2) from about 0.5 equivalent up to about 2 moles, per equivalent of acylating agent (A-1), of at least one amine compound characterized by the presence within its structure of at least one HN< group; and (B) an amount of at least one alkali metal overbased salt of a carboxylic acid or a mixture of a carboxylic acid and an organic sulfonic acid sufficient to provide at least about 0.002 equivalent of alkali metal per 100 grams of the lubricating oil composition provided that when the alkali metal salt comprises a mixture of overbased alkali metal salts of a hydrocarbyl-substituted carboxylic acid and a hydrocarbyl-substituted sulfonic acid, then the carboxylic acid comprises more than 50% of the acid equivalents of the mixture; and either (C-1) at least one magnesium overbased salt of an acidic organic compound having a metal ratio of at least 3 provided that the lubricating composition is free of calcium overbased salts of acidic organic compounds having a metal ratio of at least 3; or (C-2) at least one calcium overbased salt of an acidic organic compound having a metal ratio of at least 3 provided that the lubricating composition is free of magnesium overbased salts of acidic organic compounds having a metal ratio greater than 3.

74 Claims, No Drawings

LUBRICATING COMPOSITIONS AND CONCENTRATES

CROSS-REFERENCE TO RELATED APPLICATIONS

This application is a continuation-in-part of U.S. Ser. No. 07/884,102 filed May 15, 1992, now abandoned, which in turn is a continuation-in-part of U.S. Ser. No. 07/688,195, filed Apr. 19, 1991, now abandoned and U.S. Ser. No. 07/690,179, filed Apr. 19, 1991, now abandoned. The disclosures of said prior applications are incorporated herein in their entirety.

FIELD OF THE INVENTION

This invention relates to lubricating oil compositions and concentrates, and more particularly, to lubricating oil compositions containing alkali metal overbased salts of carboxylic acids and either magnesium overbased salts of acidic compounds having a metal ratio of at least 3 provided that the lubricating composition is free of calcium overbased salts having a metal ratio greater than 3 or calcium overbased salts of acidic compounds having a metal ratio greater than 3 provided that the lubricating composition is free of magnesium overbased salts having a metal ratio greater than 3.

BACKGROUND OF THE INVENTION

As engines, specifically, spark-ignited and diesel engines have increased power output and complexity, the performance requirements of lubricating oils have been increased to require lubricating oils that exhibit a reduced tendency to deteriorate under conditions of use and thereby to reduce wear, rust, corrosion and the formation of such undesirable deposits as varnish, sludge, carbonaceous materials and resinous materials which tend to adhere to various engine parts and reduce the efficiency of engines. Various materials have been included in the lubricating oil compositions to enable the oil compositions to meet the various performance requirements, and these include dispersants, detergents, friction modifiers, corrosion inhibitors, antioxidants, viscosity modifiers, etc.

Dispersants are employed in lubricants to maintain impurities, particularly those formed during operation of an internal combustion engine, in suspension rather than allowing them to deposit as sludge. Dispersant additives for lubricants comprising the reaction products of hydroxy compounds or amines with substituted succinic acids or their derivatives have been described in the prior art, and typical dispersions of this type are disclosed in, for example, U.S. Pat. Nos. 3,272,746; 3,522,179; 3,219,666; and 4,234,435. When incorporated into lubricating oils, the compositions described in the '435 patent function primarily as dispersants/detergents and viscosity-index improvers.

Alkaline earth metal detergents have been included in lubricating oil compositions to suspend degradation products of a motor oil and to neutralize acid products within the oil in the engines. The alkaline earth metals may be calcium, magnesium, barium or strontium, and mixtures of such metals can be used. The alkaline earth metal detergents generally are basic. Alkali metal detergents also have been used in lubricating oil compositions to provide improved detergency.

Alkali metal salts, including basic salts, have been described in the general literature and in patents. For example, Canadian Patent 1,055,700 describes basic alkali metal sulfonate dispersions and processes. More particularly, the patent describes solutions and/or stable dispersions of basic lithium sulfonates, basic sodium sulfonates and basic potassium sulfonates having metal ratios in the range of from about 4 to about 40. In the procedure utilized for the preparation of these overbased sulfonates, the reaction mixture which is contacted with an acidic gaseous material such as carbon dioxide comprises in addition to one or more oil-soluble sulfonic acids or derivatives thereof, one or more alkali metals or metal compounds, one or more lower aliphatic mono- or dihydric alcohols, and one or more oil-soluble carboxylic acids or derivatives thereof. These carboxylic acids include mono- and polycarboxylic acids.

U.S. Pat. No. 3,271,310 (LeSuer) describes metal salts of an alkenyl succinic acid having at least about 50 aliphatic carbon atoms in the alkenyl substituent. The salts include acidic salts, neutral salts or basic salts, and the metals are selected from the class consisting of Group I metals, Group II metals, aluminum, lead, tin, cobalt and nickel. The metal salts of the alkenyl succinic acids are reported to be useful as lubricating additives and may be included in lubricating oils in amounts of from about 0.1% to about 20% by weight. Other additives which may be included in the lubricating oils include, for example, other detergents and dispersants, oxidation-inhibiting agents, corrosion-inhibiting agents, extreme pressure agents, etc.

U.S. Pat. No. 3,312,618 (LeSuer) describes a process for preparing an oil-soluble highly basic metal salt of an organic acid utilizing anhydrous conditions and certain promoters. The organic acids may be sulfonic acids, phosphorus acids, carboxylic acids or mixtures thereof. The carboxylic acids include fatty acids containing at least 12 carbon atoms such as palmitic acid, or cyclic acids such as those containing a benzenoid structure, for example, benzene, an oil-soluble group or groups having a total of at least about 15 carbon atoms and preferably from about 15 to about 200 carbon atoms. The metal compounds utilized to form the metal salts include alkali and alkaline earth metals.

U.S. Pat. No. 4,283,294 (Clarke) describes lubricating oil compositions useful in marine diesel engines, and the compositions comprise in addition to oil, a mixture of a Group Ia metal overbased detergent, a Group IIa metal overbased detergent, and an antioxidant provided that the weight ratio of the overbased detergent mixture to the antioxidant is between 7.5:1 and 50:1. The Group Ia and IIa detergent additives include metal salts of phenols, phenol sulfides, phosphosulfurized polyolefins, organic sulfonates and carboxylic acids. The carboxylic acids are long chain, mono- or dicarboxylic acids such as those wherein the acid radical contains at least 50 carbon atoms per molecule. Thus, the metal salts include salts of long chain succinic acids such as those having molecular weights of 850 to 1200. The antioxidants described in this patent include alkylated hindered phenols, organic amines, organic sulfur compounds, metal thiophosphates, etc. Optional additives in the lubricating oil compositions are dispersants such as polyisobutenyl succinic anhydride-tetraethylene pentamine reaction products.

Lubricating oil compositions containing basic alkali metal salts of sulfonic or carboxylic acids, and carboxylic derivative compositions obtained by reacting substituted succinic acylating agents with at least one amine compound are described in U.S. Pat. Nos. 4,904,401; 4,938,881; and 4,952,238. The carboxylic acids may be either monocarboxylic acids or polycarboxylic acids including dicarboxylic acids such as substituted succinic acids. Suitable carboxylic acids from which useful alkali metal salts can be prepared include aliphatic, cycloaliphatic and aromatic mono- and polycarboxylic acids including naphthenic acids, alkenyl-substituted aromatic acids, and alkenyl succinic acids. The aliphatic acids generally contain from about 8 to about 50, and preferably from about 12 to about 25 carbon atoms. These patents also describe basic alkali metal salts, mixtures of sulfonic acids and carboxylic acids wherein the ratio of equivalents of the carboxylic acid when present to the organic sulfonic acid in the mixture generally is from about 1:1 to about 1:20 and preferably from about 1:2 to about 1:10. The amount of the alkali metal overbased sulfonate or carboxylate included in these oil compositions may range from about 0.01 to about 2% by weight. The oil compositions may contain other desirable additives such as metal salts of dihydrocarbylphosphorodithioic acids, antioxidants, friction modifiers, neutral and basic salts of phenol sulfides, sulfur-containing compounds useful in improving antiwear, extreme pressure antioxidant properties, and neutral or basic alkaline earth metal salt detergents.

U.K. Patent Application 2,062,672 (Zalar) describes additive compositions for lubricating oils which comprise sulfurized alkyl phenol and high molecular weight dispersants. The dispersants are oil-soluble carboxylic dispersants containing a hydrocarbon-based radical having a number average molecular weight of at least 1300 attached to a polar group such as succinic acid or derivative thereof. Generally, the carboxylic dispersants are reaction products of carboxylic acids or derivatives thereof with (a) nitrogen-containing compounds having at least one >NH group, (b) organic hydroxy compounds such as phenols and alcohols, and/or (c) reactive metals or metal-reactive compounds. The carboxylic dispersants may be post-treated with various reagents including sulfur and sulfur compounds, urea, thiourea, aldehydes, ketones, carboxylic acids, epoxides, boron compounds, phosphorus compounds, etc. The carboxylic acids which are utilized in the preparation of the dispersants are referred to as acylating agents. The acylating agent may be prepared by the alkylation of an acid such as maleic acid or anhydride. The alkylating agent may be a polymer containing at least one olefinic bond or a halogen. The number average molecular weight of the polymer is at least 1300 and usually is in the range of about 1500 to about 5000. The ratio of $\bar{M}w$ to $\bar{M}n$ may be from about 1.5 to about 6 and is usually from 1.5 to about 4. Depending upon the amount of the reactants utilized to form the substituted succinic acids, and depending upon the type of dispersant desired, the mole ratio of the polymer to the maleic acid or anhydride in the reaction mixture may be equal to, greater than or less than 1. In some applications, the dispersant is produced containing an average of at least 1.3 succinic moieties per polymer moiety. Among the reactive metal compounds which may be used to produce the dispersants are alkali metal compounds such as alkali metal hydroxides, carbonates, alkoxides, oxides, etc. The patentees indicate that the lubricating oil compositions may also contain other additives including auxiliary detergents and dispersants, corrosion and oxidation-inhibiting agents, pour point depressing agents, extreme pressure agents, etc.

Engine oil compositions containing increased levels of overbased metallic salts of organic acids are frequently less effective in providing valve-train wear protection as measured by the Sequence V-E test when compared to similar formulations that contain lower levels of such overbased salts. Overbased salts have also been observed to have a detrimental effect on fuel economy as measured by the Sequence VI test.

The Sequence V-E test is a requirement of Military Specifications MIL-L-21260D and MIL-L 46176B and API Classifications SG and SH.

The Sequence VI test is a requirement of API Classification EC and EC-II (energy conserving) oils.

Overbased metallic detergents are used almost universally in engine oils in order to keep parts clean and to neutralize acids formed during combustion of motor fuels.

It is frequently desirable to provide lubricating oil compositions that are suitable for multiple purposes. In one embodiment, it is desirable to provide an engine oil lubricant that meets both gasoline engine lubricant requirements such as those required by API specifications SG and SH and diesel engine lubricant requirements such as API specification CD.

In order to meet API specification CD, increased additive treatments, especially increased treatments of overbased metallic salts, are employed to obtain acceptable Caterpillar 1G2 test results. This test measures piston deposits and wear.

As mentioned hereinabove, when increased amounts of overbased metallic salts are present in an engine oil, wear protection and fuel economy frequently suffer.

Accordingly, it is desirable to provide such overbased metallic detergent-containing lubricating oil compositions that do not display undesirable adverse effects on wear and fuel economy.

SUMMARY OF THE INVENTION

It has now surprisingly been found that the selection of certain types of overbased detergents and the use thereof in certain amounts, provides lubricating oil compositions, and particularly engine oils, that are not adversely affected with respect to valve train wear and fuel economy.

A lubricating oil composition is described which comprises a major amount of an oil of lubricating viscosity and (A) at least about 1% by weight of at least one carboxylic derivative composition produced by reacting (A-1) at least one substituted succinic acylating agent containing at least about 50 carbon atoms in the substituent with (A-2) from about 0.5 equivalent up to about 2 moles, per equivalent of acylating agent (A-1), of at least one amine compound characterized by the presence within its structure of at least one HN< group; and (B) an amount of at least one alkali metal overbased salt of a hydrocarbyl substituted carboxylic acid containing at least about 50 carbon atoms in the hydrocarbyl substituent or a mixture of a carboxylic acid and an organic sulfonic acid sufficient to provide at least about 0.002 equivalent of alkali metal per 100 grams of the lubricating oil composition provided that when the alkali metal salt comprises a mixture of overbased alkali metal salts of a hydrocarbyl-substituted carboxylic acid and a hydrocarbyl-substituted sulfonic acid, then the carboxylic acid comprises more than 50% of the acid equivalents of the mixture; and either (C-1) at least one magnesium overbased salt of an acidic organic compound having a metal ratio of at least 3 provided that the lubricating composition is free of calcium overbased salts of acidic organic compounds having a metal ratio of at least 3; or (C-2) at least one calcium overbased salt of an acidic organic compound having a metal ratio greater than 3 provided that the lubricating composition is free of magnesium overbased salts of acidic organic compounds having a metal ratio greater than 3.

DESCRIPTION OF THE PREFERRED EMBODIMENTS

Throughout this specification and claims, references to percentages by weight of the various components are on a chemical basis unless otherwise indicated. For example, when the oil compositions of the invention are described as containing at least 2% by weight of (A), the oil composition comprises at least 2% by weight of (A) on a chemical basis. Thus, if component (A) is available as a 50% by weight oil solution, at least 4% by weight of the oil solution would be included in the lubricant composition.

The number of equivalents of the acylating agent depends on the total number of carboxylic functions present. In determining the number of equivalents for the acylating agents, those carboxyl functions which are not capable of reacting as a carboxylic acid acylating agent are excluded. In general, however, there is one equivalent of acylating agent for each carboxy group in these acylating agents. For example, there are two equivalents in an anhydride derived from the reaction of one mole of olefin polymer and one mole of maleic anhydride. Conventional techniques are readily available for determining the number of carboxyl functions (e.g., acid number, saponification number) and, thus, the number of equivalents of the acylating agent can be readily determined by one skilled in the art.

An equivalent weight of an amine or a polyamine is the molecular weight of the amine or polyamine divided by the total number of nitrogens present in the molecule. Thus, ethylene diamine has an equivalent weight equal to one-half of its molecular weight; diethylene triamine has an equivalent weight equal to one-third its molecular weight. The equivalent weight of a commercially available mixture of polyalkylene polyamine can be determined by dividing the atomic weight of nitrogen (14) by the %N contained in the polyamine and multiplying by 100; thus, a polyamine mixture containing 34% nitrogen would have an equivalent weight of 41.2. An equivalent weight of ammonia or a monoamine is the molecular weight.

An equivalent weight of a hydroxyl-substituted amine to be reacted with the acylating agents to form the carboxylic derivative (A) is its molecular weight divided by the total number of nitrogen groups present in the molecule. For the purpose of this invention in preparing component (A), the hydroxyl groups are ignored when calculating equivalent weight. Thus, ethanolamine would have an equivalent weight equal to its molecular weight, and diethanolamine has an equivalent weight (based on nitrogen) equal to its molecular weight.

The terms "substituent", "acylating agent" and "substituted succinic acylating agent" are to be given their normal meanings. For example, a substituent is an atom or group of atoms that has replaced another atom or group in a molecule as a result of a reaction. The terms acylating agent or substituted succinic acylating agent refer to the compound per se and does not include unreacted reactants used to form the acylating agent or substituted succinic acylating agent.

The term "hydrocarbyl" includes hydrocarbon, as well as substantially hydrocarbon, groups. Substantially hydrocarbon describes groups which contain non-hydrocarbon substituents which do not alter the predominately hydrocarbon nature of the group.

Examples of hydrocarbyl groups include the following:

(1) hydrocarbon substituents, that is, aliphatic (e.g., alkyl or alkenyl), alicyclic (e.g., cycloalkyl, cycloalkenyl) substituents, aromatic-, aliphatic- and alicyclic-substituted aromatic substituents and the like as well as cyclic substituents wherein the ring is completed through another portion of the molecule (that is, for example, any two indicated substituents may together form an alicyclic radical);

(2) substituted hydrocarbon substituents, that is, those substituents containing non-hydrocarbon groups which, in the context of this invention, do not alter the predominantly hydrocarbon substituent; those skilled in the art will be aware of such groups (e.g., halo (especially chloro and fluoro), hydroxy, alkoxy, mercapto, alkylmercapto, nitro, nitroso, sulfoxy, etc.);

(3) hetero substituents, that is, substituents which will, while having a predominantly hydrocarbon character within the context of this invention, contain other than carbon present in a ring or chain otherwise composed of carbon atoms. Suitable heteroatoms will be apparent to those of ordinary skill in the art and include, for example, sulfur, oxygen, nitrogen and such substituents as, e.g., pyridyl, furyl, thienyl, imidazolyl, etc. In general, no more than about 2, preferably no more than one, non-hydrocarbon substituent will be present for every 10 carbon atoms in the hydrocarbyl group. Often, there will be no such non-hydrocarbon substituents in the hydrocarbyl group and the hydrocarbyl group is purely hydrocarbon.

OIL OF LUBRICATING VISCOSITY

The oil which is utilized in the preparation of the lubricants of the invention may be based on natural oils, synthetic oils, or mixtures thereof.

Natural oils include animal oils and vegetable oils (e.g., castor oil, lard oil) as well as mineral lubricating oils such as liquid petroleum oils and solvent treated or acid treated mineral lubricating oils of the paraffinic, naphthenic or mixed paraffinic-naphthenic types. Oils of lubricating viscosity derived from coal or shale are also useful. Synthetic lubricating oils include hydrocarbon oils and halo-substituted hydrocarbon oils such as polymerized and interpolymerized olefins (e.g., polybutylenes, polypropylenes, propyleneisobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_{13}$ Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methylhexyl)silicate, tetra-(p-tert-butylphenyl)silicate, hexyl-(4-methyl-2-pentoxy)disiloxane, poly(methyl)siloxanes, poly(methylphenyl)siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the concentrates of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, hydrotreating, secondary distillation, acid or base extraction, filtration, percolation, etc. Rerefined oils are obtained by processes similar to those used to obtain refined oils applied to refined oils which have been already used in service. Such rerefined oils are also known as reclaimed, recycled or reprocessed oils and often are additionally processed by techniques directed to removal of spent additives, oil contaminants such as water and fuel, and oil breakdown products.

(A) Carboxylic Derivatives

Component (A) which is utilized in the lubricating oils of the present invention is at least one carboxylic derivative composition produced by reacting (A-1) at least one substituted succinic acylating agent containing at least about 50 carbon atoms in the substituent with (A-2) at least one amine compound containing at least one HN< group. Generally the reaction involves about 0.5 equivalent up to about 2 moles of the amine compound per equivalent of acylating agent. In one preferred embodiment, the acylating agent (A-1) consists of substituent groups and succinic groups wherein the substituent groups are derived from a polyalkene characterized by an $\bar{M}n$ value of about 1300 to about 5000 and an $\bar{M}w/\bar{M}n$ ratio of about 1.5 to about 4.5, and said acylating agents are further characterized by the presence within their structure of an average of at least about 1.3 succinic groups for each equivalent weight of substituent groups.

The carboxylic derivatives (A) are included in the oil compositions to improve dispersancy and VI properties of the oil compositions. In general from about 1% and more often from about 1.5% or 2% to about 10 or 15% by weight of component (A) can be included in the oil compositions, although the oil compositions preferably will contain at least 2.5% and often at least 3% by weight of component (A).

The substituted succinic acylating agent (A-1) utilized in the preparation of the carboxylic derivative (A) can be characterized by the presence within its structure of two groups or moieties. The first group or moiety is referred to hereinafter, for convenience, as the "substituent group(s)" and is derived from a polyalkene. The polyalkene from which the substituted groups are derived is characterized in one embodiment as containing at least about 50 carbon atoms and by an $\bar{M}n$ (number average molecular weight) value of from about 900 to about 5000 or even 10,000 or higher. In one preferred embodiment the $\bar{M}n$ is from about 1300 to about 5000, and an $\bar{M}w/\bar{M}n$ value of at least about 1.5 or at least 2.0 up to about 4.0 or 4.5. The abbreviation $\bar{M}w$ is the conventional symbol representing the weight average molecular weight. Gel permeation chromatography (GPC) is a method which provides both weight average and number average molecular weights as well as the entire molecular weight distribution of the polymers. For purpose of this invention a series of fractionated polymers of isobutene, polyisobutene, is used as the calibration standard in the GPC.

The techniques for determining $\bar{M}n$ and $\bar{M}w$ values of polymers are well known and are described in numerous books and articles. For example, methods for the determination of $\bar{M}n$ and molecular weight distribution of polymers is described in W. W. Yan, J. J. Kirkland and D. D. Bly, "Modern Size Exclusion Liquid Chromatography", J. Wiley & Sons, Inc., 1979.

The second group or moiety in the acylating agent is referred to herein as the "succinic group(s)". The succinic groups are those groups characterized by the structure

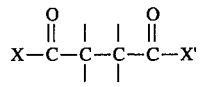

(I)

wherein X and X' are the same or different provided at least one of X and X' is such that the substituted succinic acylating agent can function as carboxylic acylating agent. That is, at least one of X and X' must be such that the substituted acylating agent can form amides or amine salts with amino compounds, and otherwise function as a conventional carboxylic acid acylating agent. Transesterification and transamidation reactions are considered, for purposes of this invention, as conventional acylating reactions.

Thus, X and/or X' is usually —OH, —O-hydrocarbyl, —O—M+ where M+ represents one equivalent of a metal, ammonium or amine cation, $—NH_2$, —Cl, —Br, and together, X and X' can be —O— so as to form the anhydride. The specific identity of any X or X' group which is not one of the above is not critical so long as its presence does not prevent the remaining group from entering into acylation reactions. Preferably, however, X and X' are each such that both carboxyl functions of the succinic group (i.e., both —C(O)X and —C(O)X' can enter into acylation reactions.

One of the unsatisfied valences in the grouping

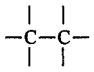

of Formula I forms a carbon bond with a carbon atom in the substituent group. While other such unsatisfied valence may be satisfied by a similar bond with the same or different substituent group, all but the said one such valence is usually satisfied by hydrogen; i.e., —H.

In one embodiment, the substituted succinic acylating agents are characterized by the presence within their structure of at least one succinic group (that is, groups corresponding to Formula I) for each equivalent weight of substituent groups. In a preferred embodiment the substituted succinic acylating agents are characterized by the presence of an average of at least 1.3 succinic groups for each equivalent weight of substituent groups. For purposes of this invention, the equivalent weight of substituent groups is deemed to be the number obtained by dividing the $\bar{M}n$ value of the polyalkene from which the substituent is derived into the total weight of the substituent groups present in the substituted succinic acylating agents. Thus, if a substituted succinic acylating agent is characterized by a total weight of substituent group of 5000 and the $\bar{M}n$ value for the polyalkene from which the substituent groups are derived is 2000, then that substituted succinic acylating agent is characterized by a total of 2.5 (5000/2000=2.5) equivalent weights of substituent groups. Therefore, that particular succinic acylating agent must also be characterized by the presence within its structure of at least 3.25 succinic groups to meet one of the requirements of the succinic acylating agents used in this invention.

Another requirement for the substituted succinic acylating agents in a preferred embodiment is that the substituent groups must have been derived from a polyalkene characterized by an $\bar{M}w/\bar{M}n$ value of at least about 1.5 or 2.0. The upper limit of $\bar{M}w/\bar{M}n$ will generally be about 4.0 or 4.5. Values of from 1.5 to about 4.5 are useful, and a ratio of 2 to about 4.5 is particularly useful.

Polyalkenes having the $\bar{M}n$ and $\bar{M}w$ values discussed above are known in the art and can be prepared according to conventional procedures. For example, some of these polyalkenes are described and exemplified in U.S. Pat. No. 4,234,435, and the disclosure of this patent relative to such polyalkenes is hereby incorporated by reference. Several such polyalkenes, especially polybutenes, are commercially available.

In one preferred embodiment, the succinic groups will normally correspond to the formula

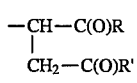

(II)

wherein R and R' are each independently selected from the group consisting of —OH, —Cl, —O-lower alkyl, and when taken together, R and R' are —O—. In the latter case, the succinic group is a succinic anhydride group. All the succinic groups in a particular succinic acylating agent need not be the same, but they can be the same. Preferably, the succinic groups will correspond to

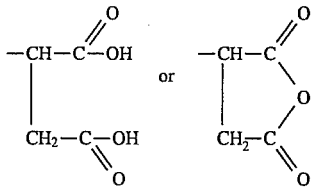

(III)

(A) (B)

and mixtures of (III(A)) and (III(B)). Providing substituted succinic acylating agents wherein the succinic groups are the same or different is within the ordinary skill of the art and can be accomplished through conventional procedures such as treating the substituted succinic acylating agents themselves (for example, hydrolyzing the anhydride to the free acid or converting the free acid to an acid chloride with thionyl chloride) and/or selecting the appropriate maleic or fumaric reactants.

As previously mentioned, the minimum number of succinic groups for each equivalent weight of substituent group is at least 1 and preferably 1.3. The maximum number generally will not exceed 4.5. In another preferred embodiment, the minimum will be about 1.4 succinic groups for each equivalent weight of substituent group. A range based on this minimum is at least 1.4 to about 3.5, and more specifically about 1.4 to about 2.5 succinic groups per equivalent weight of substituent groups.

In addition to preferred substituted succinic groups where the preference depends on the number and identity of succinic groups for each equivalent weight of substituent groups, still further preferences are based on the identity and characterization of the polyalkenes from which the substituent groups are derived.

With respect to the value of $\bar{M}n$ for example, a minimum of about 1300 and a maximum of about 5000 are preferred with an $\bar{M}n$ value in the range of from about 1500 to about 5000 also being preferred. A more preferred $\bar{M}n$ value is one in the range of from about 1500 to about 2800. A most preferred range of $\bar{M}n$ values is from about 1500 to about 2400.

Before proceeding to a further discussion of the polyalkenes from which the substituent groups are derived, it should be pointed out that these preferred characteristics of the succinic acylating agents are intended to be understood as being both independent and dependent. They are intended to be independent in the sense that, for example, a preference for a minimum of 1.4 or 1.5 succinic groups per equivalent weight of substituent groups is not tied to a more preferred value of $\bar{M}n$ or $\bar{M}w/\bar{M}n$. They are intended to be dependent in the sense that, for example, when a preference for a minimum of 1.4 or 1.5 succinic groups is combined with more preferred values of $\bar{M}n$ and/or $\bar{M}w/\bar{M}n$ the combination of preferences does in fact describe still further more preferred embodiments of the invention. Thus, the various parameters are intended to stand alone with respect to the particular parameter being discussed but can also be combined with other parameters to identify further preferences. This same concept is intended to apply throughout the specification with respect to the description of preferred values, ranges, ratios, reactants, and the like unless a contrary intent is clearly demonstrated or apparent.

In one embodiment, when the $\bar{M}n$ of a polyalkene is at the lower end of the range, e.g., about 1300, the ratio of succinic groups to substituent groups derived from said polyalkene in the acylating agent is preferably higher than the ratio when the $\bar{M}n$ is, for example, 1500. Conversely when the $\bar{M}n$ of the polyalkene is higher, e.g., 2000, the ratio may be lower than when the $\bar{M}n$ of the polyalkene is, e.g., 1500.

The polyalkenes from which the substituent groups are derived are homopolymers and interpolymers of polymerizable olefin monomers of 2 to about 16 carbon atoms; usually 2 to about 6 carbon atoms. The interpolymers are those in which two or more olefin monomers are interpolymerized according to well known conventional procedures to form polyalkenes having units within their structure derived from each of said two or more olefin monomers. Thus, "interpolymer(s)" as used herein is inclusive of copolymers, terpolymers, tetrapolymers, and the like. As will be apparent to those of ordinary skill in the art, the polyalkenes from which the substituent groups are derived are often conventionally referred to as "polyolefin(s)".

The olefin monomers from which the polyalkenes are derived are polymerizable olefin monomers characterized by the presence of one or more ethylenically unsaturated groups (i.e., >C=C<); that is, they are monoolefinic monomers such as ethylene, propylene, butene-1, isobutene, and octene-1 or polyolefinic monomers (usually diolefinic monomers) such as butadiene-1,3 and isoprene.

These olefin monomers are usually polymerizable terminal olefins; that is, olefins characterized by the presence in their structure of the group $>C{=}CH_2$. However, polymerizable internal olefin monomers (sometimes referred to in the literature as medial olefins) characterized by the presence within their structure of the group

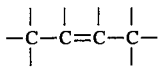

can also be used to form the polyalkenes. When internal olefin monomers are employed, they normally will be employed with terminal olefins to produce polyalkenes which are interpolymers. For purposes of this invention, when a particular polymerized olefin monomer can be classified as both a terminal olefin and an internal olefin, it will be deemed to be a terminal olefin. Thus, 1,3-pentadiene (i.e., piperylene) is deemed to be a terminal olefin for purposes of this invention.

Some of the substituted succinic acylating agents (A-1) useful in preparing the carboxylic derivatives (A) are known in the art and are described in, for example, U.S. Pat. Nos. 3,087,936 (LeSuer), 3,219,666 (Norman) and 4,234,435 (Meinhardt), the disclosures of which are hereby incorporated by reference. The acylating agents described in the '435 patent are characterized as containing substituent groups derived from polyalkenes having an $\bar{M}n$ value of about 1300 to about 5000, and an $\bar{M}w/\bar{M}n$ value of about 1.5 to about 4.

There is a general preference for aliphatic, hydrocarbon polyalkenes free from aromatic and cycloaliphatic groups. Within this general preference, there is a further preference for polyalkenes which are derived from the group consisting of homopolymers and interpolymers of terminal hydrocarbon olefins of 2 to about 16 carbon atoms. This further preference is qualified by the proviso that, while interpolymers of terminal olefins are usually preferred, interpolymers optionally containing up to about 40% of polymer units derived from internal olefins of up to about 16 carbon atoms are also within a preferred group. A more preferred class of polyalkenes are those selected from the group consisting of homopolymers and interpolymers of terminal olefins of 2 to about 6 carbon atoms, more preferably 2 to 4 carbon atoms. However, another preferred class of polyalkenes are the latter more preferred polyalkenes optionally containing up to about 25% of polymer units derived from internal olefins of up to about 6 carbon atoms.

Obviously, preparing polyalkenes as described above which meet the various criteria for $\bar{M}n$ and $\bar{M}w/\bar{M}n$ is within the skill of the art and does not comprise part of the present invention. Techniques readily apparent to those in the art include controlling polymerization temperatures, regulating the amount and type of polymerization initiator and/or catalyst, employing chain terminating groups in the polymerization procedure, and the like. Other conventional techniques such as stripping (including vacuum stripping) a very light end and/or oxidatively or mechanically degrading high molecular weight polyalkene to produce lower molecular weight polyalkenes can also be used.

In preparing the substituted succinic acylating agents of this invention, one or more of the above-described polyalkenes (or halogenated derivatives thereof) is reacted with one or more acidic reactants selected from the group consisting of maleic or fumaric reactants of the general formula $$X(O)C{-}CH{=}CH{-}C(O)X' \qquad \text{(IV)}$$

wherein X and X' are as defined hereinbefore in Formula I. Preferably the maleic and fumaric reactants will be one or more compounds corresponding to the formula $$RC(O){-}CH{=}CH{-}C(O)R' \qquad \text{(V)}$$

wherein R and R' are as previously defined in Formula II herein. Ordinarily, the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the substituted succinic acylating agents of the present invention. The especially preferred reactants are maleic acid, maleic anhydride, and mixtures of these. Due to availability and ease of reaction, maleic anhydride will usually be employed.

Examples of patents describing various procedures for preparing useful acylating agents include U.S. Pat. Nos. 3,215,707 (Rense); 3,219,666 (Norman et al); 3,231,587 (Rense); 3,912,764 (Palmer); 4,110,349 (Cohen); and 4,234,435 (Meinhardt et al); and U.K. 1,440,219. The disclosures of these patents are hereby incorporated by reference.

The relative amount of the polyalkene and maleic reactant used in preparing the hydrocarbyl-substituted succinic acids will vary according to the proportion of the succinic acid groups desired in the product. Thus, for each mole of the polymer employed, one or more moles of maleic reactant may be used depending upon whether one or more succinic acid groups are to be incorporated in each polymer molecule. In general, the higher the molecular weight of the polymer, the greater the proportion of maleic reactant which may be used. On the other hand, if a molar excess of the polymer reactant is used, the excess polymer will simply remain in the product as diluent without adverse effect.

For convenience and brevity, the term "maleic reactant" is often used hereinafter. When used, it should be understood that the term is generic to acidic reactants selected from maleic and fumaric reactants corresponding to Formulae (IV) and (V) above including a mixture of such reactants.

The acylating reagents described above are intermediates in processes for preparing the carboxylic derivative compositions (A) comprising reacting (A-1) one or more acylating reagents with (A-2) at least one amino compound characterized by the presence within its structure of at least one HN< group.

The amino compound (A-2) characterized by the presence within its structure of at least one HN< group can be a monoamine or polyamine compound. Mixtures of two or more amino compounds can be used in the reaction with one or more acylating reagents of this invention. Preferably, the amino compound contains at least one primary amino group (i.e., —$NH_2$) and more preferably the amine is a polyamine, especially a polyamine containing at least two —NH— groups, either or both of which are primary or secondary amines. The amines may be aliphatic, cycloaliphatic, aromatic or heterocyclic amines. The polyamines not only result in carboxylic acid derivative compositions which are usually more effective as dispersant/detergent additives, relative to derivative compositions derived from monoamines, but these preferred polyamines result in carboxylic derivative compositions which exhibit more pronounced VI improving properties.

Among the preferred amines are the alkylene polyamines, including the polyalkylene polyamines. The alkylene polyamines include those conforming to the formula $$\begin{array}{l} R^3N-(U-N)_n-R^3 \\ \quad\;\; | \qquad\;\; | \\ \quad\;\; R^3 \qquad R^3 \end{array} \qquad \text{(VI)}$$

wherein n is from 1 to about 10; each $R^3$ is independently a hydrogen atom, a hydrocarbyl group or a hydroxy-substituted or amine-substituted hydrocarbyl group having up to about 30 atoms, or two $R^3$ groups on different nitrogen atoms can be joined together to form a U group, with the proviso that at least one $R^3$ group is a hydrogen atom and U is an alkylene group of about 2 to about 10 carbon atoms. Preferably U is ethylene or propylene. Especially preferred are the alkylene polyamines where each $R^3$ is hydrogen or an amino-substituted hydrocarbyl group with the ethylene polyamines and mixtures of ethylene polyamines being the most preferred. Usually n will have an average value of from about 2 to about 7. Such alkylene polyamines include methylene polyamine, ethylene polyamines, butylene polyamines, propylene polyamines, pentylene polyamines, hexylene polyamines, heptylene polyamines, etc. The higher homologs of such amines and related amino alkyl-substituted piperazines are also included.

Alkylene polyamines useful in preparing the carboxylic derivative compositions (A) include ethylene diamine, triethylene tetramine, propylene diamine, trimethylene diamine, hexamethylene diamine, decamethylene diamine, hexamethylene diamine, decamethylene diamine, octamethylene diamine, di(heptamethylene) triamine, tripropylene tetramine, tetraethylene pentamine, trimethylene diamine, pentaethylene hexamine, di(trimethylene)triamine, N-(2-aminoethyl)piperazine, 1,4-bis(2-aminoethyl)piperazine, and the like. Higher homologs as are obtained by condensing two or more of the above-illustrated alkylene amines are useful, as are mixtures of two or more of any of the afore-described polyamines.

Ethylene polyamines, such as those mentioned above, are especially useful for reasons of cost and effectiveness. Such polyamines are described in detail under the heading "Diamines and Higher Amines" in The Encyclopedia of Chemical Technology, Second Edition, Kirk and Othmer, Volume 7, pages 27–39, Interscience Publishers, Division of John Wiley and Sons, 1965, which is hereby incorporated by reference for the disclosure of useful polyamines. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines. The mixtures are particularly useful in preparing carboxylic derivative (A) useful in this invention. On the other hand, quite satisfactory products can also be obtained by the use of pure alkylene polyamines.

Other useful types of polyamine mixtures are those resulting from stripping of the above-described polyamine mixtures. In this instance, lower molecular weight polyamines and volatile contaminants are removed from an alkylene polyamine mixture to leave as residue what is often termed "polyamine bottoms". In general, alkylene polyamine bottoms can be characterized as having less than two, usually less than 1% (by weight) material boiling below about 200° C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Tex. designated "E-100" showed a specific gravity at 15.6° C. of 1.0168, a percent nitrogen by weight of 33.15 and a viscosity at 40° C. of 121 centistokes. Gas chromatography analysis of such a sample showed it to contain about 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher analogs of diethylenetriamine, triethylenetetramine and the like.

These alkylene polyamine bottoms can be reacted solely with the acylating agent, in which case the amino reactant consists essentially of alkylene polyamine bottoms, or they can be used with other amines and polyamines, or alcohols or mixtures thereof. In these latter cases at least one amino reactant comprises alkylene polyamine bottoms.

Other polyamines which can be reacted with the acylating agents (A-1) in accordance with this invention are described in, for example, U.S. Pat. Nos. 3,219,666 and 4,234,435, and these patents are hereby incorporated by reference for their disclosures of amines which can be reacted with the acylating agents described above to form the carboxylic derivatives (B) of this invention.

In another embodiment, the amine may be a hydroxyamine. Typically, the hydroxyamines are primary or secondary alkanol amines or mixtures thereof. Such amines can be represented by the formulae:

$$H_2N—R'—OH, \qquad \text{(VII)}$$

and $$R'_1N(H)—R'—OH \qquad \text{(VIII)}$$

wherein each $R'_1$ is independently a hydrocarbyl group of one to about eight carbon atoms or hydroxyhydrocarbyl group of two to about eight carbon atoms, preferably one to about four, and R' is a divalent hydrocarbyl group of about two to about 18 carbon atoms, preferably two to about four. The group —R'—OH in such formulae represents the hydroxyhydrocarbyl group. R' can be an acyclic, alicyclic or aromatic group. Typically, R' is an acyclic straight or branched alkylene group such as an ethylene, 1,2-propylene, 1,2-butylene, 1,2-octadecylene, etc. group. Where two $R'_1$ groups are present in the same molecule they can be joined by a direct carbon-to-carbon bond or through a heteroatom (e.g., oxygen, nitrogen or sulfur) to form a 5-, 6-, 7- or 8-membered ring structure.

Examples of such heterocyclic amines include N-(hydroxyl lower alkyl)-morpholines, -thiomorpholines, -piperidines, -oxazolidines, -thiazolidines and the like. Typically, however, each $R'_1$ is independently a methyl, ethyl, propyl, butyl, pentyl or hexyl group.

Examples of these alkanolamines include mono-, di-, and triethanol amine, diethylethanolamine, ethylethanolamine, butyldiethanolamine, etc.

The hydroxyamines can also be an ether N-(hydroxyhydrocarbyl-)amine. These are hydroxypoly(hydrocarbyloxy) analogs of the above-described hydroxy amines (these analogs also include hydroxyl-substituted oxyalkylene analogs). Such N-(hydroxyhydrocarbyl) amines can be conveniently prepared by reaction of epoxides with aforedescribed amines and can be represented by the formulae:

$$H_2N—(R'O)_x—H, \quad (IX)$$

and $$R'_1N(H)—(R'O)_xH \quad (X)$$

wherein x is a number from about 2 to about 15 and $R'_1$ and R' are as described above. $R'_1$ may also be a hydroxypoly-(hydrocarbyloxy) group.

The carboxylic derivative compositions (A) produced from the acylating reagents (A-1) and the amino compounds (A-2) described hereinbefore comprise acylated amines which include amine salts, amides, imides, amidines, amidic acids, amidic salts and imidazolines as well as mixtures thereof. To prepare the carboxylic acid derivatives from the acylating reagents and the amino compounds, one or more acylating reagents and one or more amino compounds are heated, optionally in the presence of a normally liquid, substantially inert organic liquid solvent/diluent, at temperatures in the range of about 80° C. up to the decomposition point of either the reactants or the carboxylic derivative but normally at temperatures in the range of about 100° C. up to about 300° C. provided 300° C. does not exceed the decomposition point. Temperatures of about 125° C. to about 250° C. are normally used. The acylating reagent and the amino compound are reacted in amounts sufficient to provide from about one-half equivalent up to about 2 moles of amino compound per equivalent of acylating reagent.

Because the acylating reagents (A-1) can be reacted with the amine compounds (A-2) in the same manner as the high molecular weight acylating agents of the prior art are reacted with amines, U.S. Pat. Nos. 3,172,892; 3,219,666; 3,272,746; and 4,234,435 are expressly incorporated herein by reference for their disclosures with respect to the procedures applicable to reacting the acylating reagents with the amino compounds as described above.

In order to produce carboxylic derivative compositions exhibiting viscosity index improving capabilities, it has been found generally necessary to react the acylating reagents with polyfunctional amine reactants. For example, polyamines having two or more primary and/or secondary amino groups are preferred. Obviously, however, it is not necessary that all of the amino compound reacted with the acylating reagents be polyfunctional. Thus, combinations of mono and polyfunctional amino compounds be used.

The acylating agent is reacted with from about 0.5 equivalent up to about 2 moles of the amine compound per equivalent of acylating agent. In another embodiment, the amount of amine may range from 0.7 up to about 1.5 equivalents per equivalent of acylating agent.

In another embodiment, the acylating agent is reacted with from about 0.5 and more often 0.7 equivalent up to less than 1 equivalent (e.g., about 0.95 equivalent) of amine compound, per equivalent of acylating agent. The lower limit on the equivalents of amine compound may be 0.75 or even 0.80 up to about 0.90 or 0.95 equivalent, per equivalent of acylating agent. Thus narrower ranges of equivalents of acylating agents (A-1) to amine compounds (A-2) may be from about 0.70 to about 0.90 or about 0.75 to about 0.90 or about 0.75 to about 0.85. It appears, at least in some situations, that when the equivalent of amine compound is about 0.75 or less, per equivalent of acylating agent, the effectiveness of the carboxylic derivative as a dispersant is reduced.

In yet another embodiment, the acylating agent is reacted with from about 1.0 equivalent up to 2 moles of amine per equivalent of acylating agent. More often the acylating agent is reacted with from about 1.0 or 1.1 up to 1.5 equivalents of amine per equivalent of acylating agent.

The amount of amine compound (A-2) within the above ranges that is reacted with the acylating agent (A-1) may also depend in part on the number and type of nitrogen atoms present. For example, a smaller amount of a polyamine containing one or more —$NH_2$ groups is required to react with a given acylating agent than a polyamine having the same number of nitrogen atoms and fewer or no —$NH_2$ groups. One —$NH_2$ group can react with two —COOH groups to form an imide. If only secondary nitrogens are present in the amine compound, each >NH group can react with only one —COOH group. Accordingly, the amount of polyamine within the above ranges to be reacted with the acylating agent to form the carboxylic derivatives of the invention can be readily determined from a consideration of the number and types of nitrogen atoms in the polyamine (i.e., —$NH_2$, >NH, and >N—).

In addition to the relative amounts of acylating agent and amine compound used to form the carboxylic derivative composition (A), other features of the carboxylic derivative compositions used in this invention are the $\bar{M}n$ and the $\bar{M}w/\bar{M}n$ values of the polyalkene as well as the presence within the acylating agents of an average of at least 1 and preferably at least 1.3 succinic groups for each equivalent weight of substituent groups. When all of these features are present in the carboxylic derivative compositions (A), the lubricating oil compositions of the present invention are characterized by improved performance in combustion engines.

The ratio of succinic groups to the equivalent weight of substituent group present in the acylating agent can be determined from the saponification number of the reacted mixture corrected to account for unreacted polyalkene present in the reaction mixture at the end of the reaction (generally referred to as filtrate or residue in the following examples). Saponification number is determined using the ASTM D-94 procedure. The formula for calculating the ratio from the saponification number is as follows:

$$\text{Ratio} = \frac{(\bar{M}n)(\text{Sap No., corrected})}{112{,}200-98(\text{Sap No., corrected})}$$

The corrected saponification number is obtained by dividing the saponification number by the percent of the polyalkene that has reacted. For example, if 10% of the polyalkene did not react and the saponification number of the filtrate or residue is 95, the corrected saponification number is 95 divided by 0.90 or 105.5.

The preparation of the acylating agents is illustrated in the following Examples 1–6 and the preparation of the carboxylic acid derivative compositions (A) is illustrated by the following Examples A-1 to A-29. In the following examples, and elsewhere in the specification and claims, all percentages and parts are by weight, temperatures are in degrees centigrade and pressures are atmospheric unless otherwise clearly indicated. The desired acylating agents are sometimes referred to in the examples as "residue" without specific determination or mention of other materials present or the amounts thereof.

Acylating Agents

EXAMPLE 1

A mixture of 510 parts (0.28 mole) of polyisobutene ($\bar{M}n$=1845; $\bar{M}w$=5325) and 59 parts (0.59 mole) of maleic anhydride is heated to 110° C. This mixture is heated to 190° C. in 7 hours during which 43 parts (0.6 mole) of gaseous chlorine is added beneath the surface. At 190°–192° C. an additional 11 parts (0.16 mole) of chlorine is added over 3.5 hours. The reaction mixture is stripped by heating at 190°–193° C. with nitrogen blowing for 10 hours. The residue is the desired polyisobutene-substituted succinic acylating agent having a saponification equivalent number of 87 as determined by ASTM procedure D-94.

EXAMPLE 2

A mixture of 1000 parts (0.495 mole) of polyisobutene ($\bar{M}n$=2020; $\bar{M}w$=6049) and 115 parts (1.17 moles) of maleic anhydride is heated to 110° C. This mixture is heated to 184° C. in 6 hours during which 85 parts (1.2 moles) of gaseous chlorine is added beneath the surface. At 184°–189° C. an additional 59 parts (0.83 mole) of chlorine is added over 4 hours. The reaction mixture is stripped by heating at 186°–190° C. with nitrogen blowing for 26 hours. The residue is the desired polyisobutene-substituted succinic acylating agent having a saponification equivalent number of 87 as determined by ASTM procedure D-94.

EXAMPLE 3

A mixture of 3251 parts of polyisobutene chloride, prepared by the addition of 251 parts of gaseous chlorine to 3000 parts of polyisobutene ($\bar{M}n$=1696; $\bar{M}w$=6594) at 80° C. in 4.66 hours, and 345 parts of maleic anhydride is heated to 200° C. in 0.5 hour. The reaction mixture is held at 200°–224° C. for 6.33 hours, stripped at 210° C. under vacuum and filtered. The filtrate is the desired polyisobutene-substituted succinic acylating agent having a saponification equivalent number of 94 as determined by ASTM procedure D- 94.

EXAMPLE 4

A polyisobutenyl succinic anhydride is prepared by the reaction of 1 mole of a chlorinated polyisobutylene with 1 mole of maleic anhydride at 200° C. The polyisobutenyl group has an average molecular weight of 850, and the resulting substituted succinic anhydride is found to have an acid number of 113 (corresponding to an equivalent weight of 500).

EXAMPLE 5

A polyisobutenyl succinic anhydride having an acid number of 105 and an equivalent weight of 540 is prepared by the reaction of 1 mole of a chlorinated polyisobutylene (having an $\bar{M}n$ of about 1050 and a chlorine content of 4.3%) and 1 mole of maleic anhydride at a temperature of about 200° C.

EXAMPLE 6

A substituted succinic anhydride is prepared by reacting 1 mole of maleic anhydride with 1 mole of a chlorinated copolymer of isobutylene and styrene. The copolymer consists of 94 parts by weight of isobutylene units and 6 parts by weight of styrene units, has an $\bar{M}n$ of about 1200, and is chlorinated to a chlorine content of 2.8% by weight. The resulting substituted succinic anhydride has an acid number of 40.

Carboxylic Derivative Compositions (A)

EXAMPLE A-1

A mixture is prepared by the addition of 10.2 parts (0.25 equivalent) of a commercial mixture of ethylene polyamines having from about 3 to about 10 nitrogen atoms per molecule to 113 parts of mineral oil and 161 parts (0.25 equivalent) of the substituted succinic acylating agent prepared in Example 1 at 138° C. The reaction mixture is heated to 150° C. in 2 hours and stripped by blowing with nitrogen. The reaction mixture is filtered to yield the filtrate as an oil solution of the desired product.

EXAMPLE A-2

A mixture is prepared by the addition of 57 parts (1.38 equivalents) of a commercial mixture of ethylene polyamines having from about 3 to 10 nitrogen atoms per molecule to 1067 parts of mineral oil and 893 parts (1.38 equivalents) of the substituted succinic acylating agent prepared in Example 2 at 140°–145° C. The reaction mixture is heated to 155° C. in 3 hours and stripped by blowing with nitrogen. The reaction mixture is filtered to yield the filtrate as an oil solution of the desired product.

EXAMPLE A-3

A mixture of 1132 parts of mineral oil and 709 parts (1.2 equivalents) of a substituted succinic acylating agent prepared as in Example 1 is prepared, and a solution of 56.8 parts of piperazine (1.32 equivalents) in 200 parts of water is added slowly from a dropping funnel to the above mixture at 130°–140° C. over approximately 4 hours. Heating is continued to 160° C. as water is removed. The mixture is maintained at 160°–165° C. for one hour and cooled overnight. After reheating the mixture to 160° C., the mixture is maintained at this temperature for 4 hours. Mineral oil (270 parts) is added, and the mixture is filtered at 150° C. through a filter aid. The filtrate is an oil solution of the desired product (65% oil) containing 0.65% nitrogen (theory, 0.86%).

EXAMPLE A-4

A mixture of 1968 parts of mineral oil and 1508 parts (2.5 equivalents) a substituted succinic acylating agent prepared as in Example 1 is heated to 145° C. whereupon 125.6 parts (3.0 equivalents) of a commercial mixture of ethylene polyamines as used in Example A-1 are added over a period of 2 hours while maintaining the reaction temperature at 145°–150° C. The reaction mixture is stirred for 5.5 hours at 150°–152° C. while blowing with nitrogen. The mixture is filtered at 150° C. with a filter aid. The filtrate is an oil solution of the desired product (55% oil) containing 1.20% nitrogen (theory, 1.17).

EXAMPLE A-5

A mixture of 4082 parts of mineral oil and 250.8 parts (6.24 equivalents) of a commercial mixture of ethylene polyamine of the type utilized in Example A-1 is heated to 110° C. whereupon 3136 parts (5.2 equivalents) of a substituted succinic acylating agent prepared as in Example 1 are added over a period of 2 hours. During the addition, the temperature is maintained at 110°–120° C. while blowing with nitrogen. When all of the amine has been added, the mixture is heated to 160° C. and maintained at this temperature for about 6.5 hours while removing water. The mixture is filtered at 140° C. with a filter aid, and the filtrate is an oil solution of the desired product (55% oil) containing 1.17% nitrogen (theory, 1.18).

EXAMPLE A-6

A mixture of 4158 parts of mineral oil and 3136 parts (5.2 equivalents) of a substituted succinic acylating agent prepared as in Example 1 is heated to 140° C. whereupon 312 parts (7.26 equivalents) of a commercial mixture of ethylene polyamines as used in Example A-1 are added over a period of one hour as the temperature increases to 140°–150° C. The mixture is maintained at 150° C. for 2 hours while blowing with nitrogen and at 160° C. for 3 hours. The mixture is filtered at 140° C. with a filter aid. The filtrate is an oil solution of the desired product (55% oil) containing 1.44% nitrogen (theory, 1.34).

EXAMPLE A-7

A mixture of 4053 parts of mineral oil and 287 parts (7.14 equivalents) of a commercial mixture of ethylene polyamines as used in Example A-1 is heated to 110° C. whereupon 3075 parts (5.1 equivalents) of a substituted succinic acylating agent prepared as in Example 1 are added over a period of one hour while maintaining the temperature at about 110° C. The mixture is heated to 160° C. over a period of 2 hours and held at this temperature for an additional 4 hours. The reaction mixture then is filtered at 150° C. with filter aid, and the filtrate is an oil solution of the desired product (55% oil) containing 1.33% nitrogen (theory, 1.36).

EXAMPLE A-8

A mixture of 1503 parts of mineral oil and 1220 parts (2 equivalents) of a substituted succinic acylating agent prepared as in Example 1 is heated to 110° C. whereupon 120 parts (3 equivalents) of a commercial mixture of ethylene polyamines of the type used in Example A-1 are added over a period of about 50 minutes. The reaction mixture is stirred an additional 30 minutes at 110° C., and the temperature is then raised to and maintained at about 151° C. for 4 hours. A filter aid is added and the mixture is filtered. The filtrate is an oil solution of the desired product (53.2% oil) containing 1.44% nitrogen (theory, 1.49).

EXAMPLE A-9

A mixture of 3111 parts of mineral oil and 844 parts (21 equivalents) of a commercial mixture of ethylene polyamine as used in Example A-1 is heated to 140° C. whereupon 3885 parts (7.0 equivalents) of a substituted succinic acylating agent prepared as in Example 1 are added over a period of about 1.75 hours as the temperature increases to about 150° C. While blowing with nitrogen, the mixture is maintained at 150°–155° C. for a period of about 6 hours and thereafter filtered with a filter aid at 130° C. The filtrate is an oil solution of the desired product (40% oil) containing 3.5% nitrogen (theory, 3.78).

EXAMPLE A-10

A mixture is prepared by the addition of 18.2 parts (0.433 equivalent) of a commercial mixture of ethylene polyamines having from about 3 to 10 nitrogen atoms per molecule to 392 parts of mineral oil and 348 parts (0.52 equivalent) of the substituted succinic acylating agent prepared in Example 2 at 140° C. The reaction mixture is heated to 150° C. in 1.8 hours and stripped by blowing with nitrogen. The reaction mixture is filtered to yield the filtrate as an oil solution (55% oil) of the desired product.

EXAMPLE A-11

An appropriate size flask fitted with a stirrer, nitrogen inlet tube, addition funnel and Dean-Stark trap/condenser is charged with a mixture of 2483 parts acylating agent (4.2 equivalents) as described in Example 3, and 1104 parts oil. This mixture is heated to 210° C. while nitrogen was slowly bubbled through the mixture. Ethylene polyamine bottoms (134 parts, 3.14 equivalents) are slowly added over about one hour at this temperature. The temperature is maintained at about 210° C. for 3 hours and then 3688 parts oil is added to decrease the temperature to 125° C. After storage at 138° C. for 17.5 hours, the mixture is filtered through diatomaceous earth to provide a 65% oil solution of the desired acylated amine bottoms.

EXAMPLE A-12

A mixture of 3660 parts (6 equivalents) of a substituted succinic acylating agent prepared as in Example 1 in 4664 parts of diluent oil is prepared and heated at about 110° C. whereupon nitrogen is blown through the mixture. To this mixture there are then added 210 parts (5.25 equivalents) of a commercial mixture of ethylene polyamines containing from about 3 to about 10 nitrogen atoms per molecule over a period of one hour and the mixture is maintained at 110° C. for an additional 0.5 hour. After heating for 6 hours at 155° C. while removing water, a filter aid is added and the reaction mixture is filtered at about 150° C. The filtrate is the oil solution of the desired product.

EXAMPLE A-13

The general procedure of Example A-12 is repeated with the exception that 0.8 equivalent of a substituted succinic acylating agent as prepared in Example 1 is reacted with 0.67 equivalent of the commercial mixture of ethylene polyamines. The product obtained in this manner is an oil solution of the product containing 55% diluent oil.

EXAMPLE A-14

The general procedure of Example A-12 is repeated except that the polyamine used in this example is an equivalent amount of an alkylene polyamine mixture comprising 80% of ethylene polyamine bottoms from Union Carbide and 20% of a commercial mixture of ethylene polyamines corresponding in empirical formula to diethylene triamine. This polyamine mixture is characterized as having an equivalent weight of about 43.3.

EXAMPLE A-15

The general procedure of Example A-12 is repeated except that the polyamine utilized in this example comprises a mixture of 80 parts by weight of ethylene polyamine bottoms available from Dow and 20 parts by weight of diethylenetriamine. This mixture of amines has an equivalent weight of about 41.3.

EXAMPLE A-16

A mixture of 444 parts (0.7 equivalent) of a substituted succinic acylating agent prepared as in Example 1 and 563 parts of mineral oil is prepared and heated to 140° C. whereupon 22.2 parts of an ethylene polyamine mixture corresponding in empirical formula to triethylene tetramine (0.58 equivalent) are added over a period of one hour as the temperature is maintained at 140° C. The mixture is blown with nitrogen as it is heated to 150° C. and maintained at this temperature for 4 hours while removing water. The mixture then is filtered through a filter aid at about 135° C., and the filtrate is an oil solution of the desired product comprising about 55% of mineral oil.

EXAMPLE A-17

A mixture of 422 parts (0.7 equivalent) of a substituted succinic acylating agent prepared as in Example 1 and 188 parts of mineral oil is prepared and heated to 210° C. whereupon 22.1 parts (0.53 equivalent) of a commercial mixture of ethylene polyamine bottoms from Dow are added over a period of one hour blowing with nitrogen. The temperature then is increased to about 210°–216 ° C. and maintained at this temperature for 3 hours. Mineral oil (625 parts) is added and the mixture is maintained at 135° C. for about 17 hours whereupon the mixture is filtered and the filtrate is an oil solution of the desired product (65% oil).

EXAMPLE A-18

The general procedure of Example A-17 is repeated except that the polyamine used in this example is a commercial mixture of ethylene polyamines having from about 3 to 10 nitrogen atoms per molecule (equivalent weight of 42).

EXAMPLE A-19

A mixture is prepared of 414 parts (0.71 equivalent) of a substituted succinic acylating agent prepared as in Example 1 and 183 parts of mineral oil. This mixture is heated to 210° C. whereupon 20.5 parts (0.49 equivalent) of a commercial mixture of ethylene polyamines having from about 3 to 10 nitrogen atoms per molecule are added over a period of about one hour as the temperature is increased to 210°–217° C. The reaction mixture is maintained at this temperature for 3 hours while blowing with nitrogen, and 612 parts of mineral oil are added. The mixture is maintained at 145°–135° C. for about one hour, and at 135° C. for 17 hours. The mixture is filtered while hot, and the filtrate is an oil solution of the desired product (65% oil).

EXAMPLE A-20

A mixture of 414 parts (0.71 equivalent) of a substituted succinic acylating agent prepared as in Example 1 and 184 parts of mineral oil is prepared and heated to about 80° C. whereupon 22.4 parts (0.534 equivalent) of melamine are added. The mixture is heated to 160° C. over a period of about 2 hours and maintained at this temperature for 5 hours. After cooling overnight, the mixture is heated to 170° C. over 2.5 hours and to 215° C. over a period of 1.5 hours. The mixture is maintained at about 215° C. for about 4 hours and at about 220° C. for 6 hours. After cooling overnight, the reaction mixture is filtered at 150° C. through a filter aid. The filtrate is an oil solution of the desired product (30% mineral oil).

EXAMPLE A-21

A mixture of 414 parts (0.71 equivalent) of a substituted acylating agent prepared as in Example 1 and 184 parts of mineral oil is heated to 210° C. whereupon 21 parts (0.53 equivalent) of a commercial mixture of ethylene polyamine corresponding in empirical formula to tetraethylene pentamine are added over a period of 0.5 hour as the temperature is maintained at about 210°–217° C. Upon completion of the addition of the polyamine, the mixture is maintained at 217° C. for 3 hours while blowing with nitrogen. Mineral oil is added (613 parts) and the mixture is maintained at about 135° C. for 17 hours and filtered. The filtrate is an oil solution of the desired product (65% mineral oil).

EXAMPLE A-22

A mixture of 414 parts (0.71 equivalent) of a substituted acylating agent prepared as in Example 1 and 183 parts of mineral oil is prepared and heated to 210° C. whereupon 18.3 parts (0.44 equivalent) of ethylene amine bottoms (Dow) are added over a period of one hour while blowing with nitrogen. The mixture is heated to about 210°–217° C. in about 15 minutes and maintained at this temperature for 3 hours. An additional 608 parts of mineral oil are added and the mixture is maintained at about 135° C. for 17 hours. The mixture is filtered at 135° C. through a filter aid, and the filtrate is an oil solution of the desired product (65% oil).

EXAMPLE A-23

The general procedure of Example A-22 is repeated except that the ethylene amine bottoms are replaced by an equivalent amount of a commercial mixture of ethylene polyamines having from about 3 to 10 nitrogen atoms per molecule.

EXAMPLE A-24

A mixture of 422 parts (0.70 equivalent) of a substituted acylating agent prepared as in Example 1 and 190 parts of mineral oil is heated to 210° C. whereupon 26.75 parts (0.636 equivalent) of ethylene amine bottoms (Dow) are added over one hour while blowing with nitrogen. After all of the ethylene amine is added, the mixture is maintained at 210°–215° C. for about 4 hours, and 632 parts of mineral oil are added with stirring. This mixture is maintained for 17 hours at 135° C. and filtered through a filter aid. The filtrate is an oil solution of the desired product (65% oil).

EXAMPLE A-25

A mixture of 468 parts (0.8 equivalent) of a substituted succinic acylating agent prepared as in Example 1 and 908.1 parts of mineral oil is heated to 142° C. whereupon 28.63 parts (0.7 equivalent) of ethylene amine bottoms (Dow) are added over a period of 1.5–2 hours. The mixture was stirred an additional 4 hours at about 142° C. and filtered. The filtrate is an oil solution of the desired product (65% oil).

EXAMPLE A-26

A mixture of 2653 parts of a substituted acylating agent prepared as in Example 1 and 1186 parts of mineral oil is heated to 210° C. whereupon 154 parts of ethylene amine bottoms (Dow) are added over a period of 1.5 hours as the temperature is maintained between 210°–215° C. The mixture is maintained at 215°–220° C. for a period of about 6 hours. Mineral oil (3953 parts) is added at 210° C. and the mixture is stirred for 17 hours with nitrogen blowing at 135°–128° C. The mixture is filtered hot through a filter aid, and the filtrate is an oil solution of the desired product (65% oil).

EXAMPLE A-27

To a mixture of 500 parts (1 equivalent) of the polyisobutenyl succinic anhydride prepared in Example 4, and to 160 parts of toluene, there are added at room temperature, 35 parts (1 equivalent) of diethylene triamine. The addition is made portionwise through a period of 15 minutes, and an initial exothermic reaction causes the temperature to rise to about 50° C. The mixture is heated and a water-toluene azeotrope is distilled from the mixture. When no additional water distills, the mixture is heated to 150° C. at reduced pressure to remove the toluene. The residue is diluted with 300 parts of mineral oil, and this solution is found to have a nitrogen content of 1.6%.

EXAMPLE A-28

To a mixture of 300 parts by weight of the polyisobutenyl succinic anhydride prepared in Example 5, and 160 parts by weight of mineral oil, there is added at 65°–95° C., an equivalent amount (25 parts by weight) of Polyamine H which is an ethyleneamine mixture having an average composition corresponding to that of tetraethylene pentamine. The mixture is then heated to 150° C. to distill water formed in the reaction. Nitrogen is bubbled through the mixture at this temperature to insure removal of the last traces of water. The residue is diluted with 79 parts by weight of mineral oil, and this oil solution is found to have a nitrogen content of 1.6%.

EXAMPLE A-29

To 710 parts (0.51 equivalent) of the substituted succinic anhydride prepared in Example 6, and 500 parts of toluene there are added portionwise 22 parts (0.51 equivalent) of Polyamine H. The mixture is heated at reflux temperature for 3 hours to remove water formed during the reaction by azeotropic distillation. The mixture then is heated to 150° C./20 min. to remove the toluene. The residue contains 1.1% by weight of nitrogen.

(B) Alkali Metal Overbased Salts of Hydrocarbyl-Substituted Carboxylic Acids

The lubricating oil compositions of the present invention also contain (B) an alkali metal overbased salt of a carboxylic acid or a mixture of a carboxylic acid and an organic sulfonic acid provided that the carboxylic acid in the mixture comprises more than 50% of the acid equivalents of the mixture. The carboxylic acids are generally hydrocarbyl-substituted carboxylic acids wherein the hydrocarbyl substituent generally contains at least 50 carbon atoms.

The amount of the alkali metal overbased salt of the hydrocarbyl-substituted carboxylic acid or mixture of carboxylic acid and sulfonic acid included in the lubricating oil compositions of the present invention is an amount sufficient to provide at least about 0.002 equivalent of alkali metal per 100 grams of lubricating oil composition. In other embodiments, sufficient alkali metal overbased salt is included in the lubricating oil composition to provide at least about 0.003 and even at least about 0.005 equivalent of alkali metal per 100 grams of the lubricating oil composition.

The alkali metal overbased salts (B) are characterized by a metal content in excess of that which would be present according to the stoichiometry of the metal and the particular hydrocarbyl-substituted carboxylic acid reacted with the metal. The amount of excess metal is commonly expressed in terms of metal ratio which is the ratio of the total equivalents of the metal to the equivalents of the acidic organic compound. For example, a salt having 4.5 times as much metal as present in a normal salt is characterized as having a metal ratio of 4.5. In the present invention, the alkali metal overbased salts have a metal ratio of greater than 1, preferably at least about 1.5 or at least about 2 or 3 up to about 30 or even up to about 40. In yet another embodiment the metal ratio is at least about 6.5. The alkali metal overbased compositions are prepared by reacting an acidic material which is typically carbon dioxide with a mixture comprising the carboxylic acid or mixture of carboxylic and sulfonic acids, of an alkali metal compound, typically a metal oxide or hydroxide, a promoter and at least one inert organic diluent for the carboxylic acid compound. The carboxylic acids from which useful alkali metal overbased salts can be prepared include aliphatic, cycloaliphatic and aromatic mono- and polybasic carboxylic acids. The aliphatic acids contain, exclusive of carboxylic carbon atoms, at least about 50 carbon atoms. The aliphatic mono- and polycarboxylic acids are preferred, and they may be saturated or unsaturated.

A preferred type of carboxylic acid useful in preparing the alkali metal overbased salts (B) is prepared by reacting an olefin polymer or halogenated olefin polymer with an α,β-unsaturated acid or its anhydride such as acrylic, methacrylic, maleic or fumaric acid, or maleic anhydride to form the corresponding hydrocarbyl-substituted acid or derivative thereof. Thus the hydrocarbyl groups of the hydrocarbyl-substituted carboxylic acids and hydrocarbyl-substituted sulfonic acids may be derived from polyalkenes. The molecular weight of the polyalkenes may vary within broad limits. In one embodiment, the polyalkenes may be characterized as containing at least about 50 carbon atoms up to about 300 or 400 carbon atoms. In one embodiment, the polyalkene is characterized by an $\bar{M}n$ value of at least about 900 or 1000 up to about 2500 or even up to about 5000.

The polyalkenes from which the hydrocarbyl substituent of the acid is derived include homopolymers and interpolymers of polymerizable olefin monomers of from 2 to about 16 carbon atoms, usually from 2 to about 6 carbon atoms, and preferably from 2 to about 4 carbon atoms. The olefins may be monoolefins such as ethylene, propylene, 1-butene, isobutene and 1-octene or a polyolefinic monomer, preferably diolefinic monomer such as 1,3-butadiene and isoprene. The polyalkenes are prepared by conventional procedures. Additional examples of polyalkenes from which the hydrocarbyl substituent of the succinic and sulfonic acids can be derived include any of the polyalkenes described above with regard to the preparation of the acylating agent (A-1), and that portion of the specification describing such polyalkenes is herein incorporated by reference.

When preparing the hydrocarbyl-substituted carboxylic acids useful in preparing the alkali metal salts utilized in the present invention, one or more of the above-described polyalkenes is reacted with one or more α,β-unsaturated mono- or dicarboxylic acid reagents by techniques known in the art. For example, a halogenated hydrocarbon such as can be obtained from polyisobutene and a halogenating agent can be reacted with an α,β-unsaturated carboxylic acid reagent by mixing the reactants at a suitable temperature such as 80° C. or higher. The reaction can be carried out in the presence of an inert solvent or diluent.

The α,β-unsaturated monocarboxylic acid reagent may be the acid, ester, amide, imide, ammonium salt, or halide. It preferably contains less than about 12 carbon atoms. Examples of such monocarboxylic acids include, for example, acrylic acid, methacrylic acid (i.e., α-methylacrylic acid), crotonic acid, cinnamic acid, α-ethylacrylic acid, α-phenylacrylic acid, α-octylacrylic acid, β-propylacrylic acid, β-octylacrylic acid, β-cyclohexylacrylic acid, α-cyclopentylacrylic acid, β-decylacrylic acid, α-methyl β-pentylacrylic acid, α-propyl-β-phenylacrylic acid, α-chloroacrylic acid, α-bromoacrylic acid, β-chloroacrylic acid, α-chlorocrotonic acid, β-isocrotonic acid, α-methylcrotonic acid, α-methylisocrotonic acid, β,β-dichloroacrylic acid, etc.

Esters of such α,β-unsaturated carboxylic acids especially those in which the ester group is derived from a lower alkanol (i.e., having less than about 8 carbon atoms) likewise are useful in the invention. Specific examples of such esters include methyl acrylate, methyl methacrylate, ethyl acrylate, cyclohexyl acrylate, cyclopentyl methacrylate, neopentyl α-phenyloacrylate, hexyl α-propyl-β-propylacrylate, octyl β-decylacrylate and the like. Other esters such as those derived from other alcohols (e.g., decyl alcohol, epichlorohydrin, β-chloroethanol, dodecyl alcohol, and 4-bromo-1-decanol) are also contemplated. Still other esters which are useful in the invention are exemplified by those derived from phenolic compounds including phenol, naphthol, cresol, o-butylphenol, heptylphenol, p-tertiary butylphenol, o,p-diisopropylphenol, α-decyl-β-naphthol, p-dodecylphenol, and other alkyl phenols and alkyl naphthols in which the alkyl substituent preferably has less than about 12 carbon atoms.

The halides of the α,β-unsaturated monocarboxylic acids are principally the chlorides and bromides. They are illustrated by acrylyl chloride, methacrylyl bromide, α-phenylacrylyl chloride, β-decylacrylyl chloride as well as the chlorides and bromides of the above-illustrated acids.

The amides and the ammonia salts of α,β-unsaturated monocarboxylic acids include principally those derived from ammonia or a monoamine such as an aliphatic amine or an aryl amine. Such amines may be mono-, di- or trialkyl or aryl amines such as methylamine, dimethylamine, trimethylamine, diethylamine, aniline, toluidine, cyclohexylamine, dicyclohexylamine, triethylamine, melamine, piperazine, pyridine, N-methyloctylamine, N,N-diethylcyclohexylamine, o-butylaniline, p-decylaniline, etc. Again the unsaturated acids from which the amides and ammonium salts of the above amines may be those illustrated previously. Imides of such acids derived from ammonia or a primary amine likewise are useful in the invention and the imides are formed by the replacement of 2 hydrogen atoms of ammonia or a primary amine with the carboxy radicals of the α,β-unsaturated monocarboxylic acid. Likewise useful are the anhydrides of such monocarboxylic acids such as are formed by molecular dehydration of the acid. It should be noted that the above-noted acids and derivatives are capable of yielding the α,β-unsaturated monocarboxylic acid and, for the sake of convenience, they are described by the generic expressions "α,β-unsaturated monocarboxylic acid reagent" or "α,β-unsaturated monocarboxylic acid-producing compound".

Procedures for preparing hydrocarbon-substituted monocarboxylic acid reagents useful in preparing the alkali metal overbased salts (B) are described in, for example, U.S. Pat. No. 3,454,607 (LeSuer et al), and the description of such procedures and additional examples of such reagents are hereby incorporated by reference.

The following examples illustrate such procedures and reagents.

EXAMPLE 7

A chlorinated polyisobutene having a molecular weight of 1000 and a chlorine content of 4.5% (6300 grams, 8 equivalents of chlorine) is mixed with acrylic acid (940 grams, 13 equivalents) and the mixture is heated to 235° C. while hydrogen chloride is evolved. It is then heated at 130°–182° C./6 mm. and then filtered. The filtrate is an acid having a chlorine content of 0.62% and an acid number of 63.

EXAMPLE 8

A mixture of acrylic acid (720 grams, 10 equivalents) and a chlorinated polyisobutene having a molecular weight of 1000 and a chlorine content of 4.3% (6536 grams, 8 equivalents of chlorine) is heated at 170°– 225° C. for 12 hours and then at 200° C./10 mm. The residue is filtered at 140° C. and the filtrate is the desired acid having a chlorine content of 0.36% and an acid number of 60.

EXAMPLE 9

The procedure of Example 7 is repeated except that the chlorinated isobutene is replaced on a halogen equivalent basis with a brominated copolymer of isobutene (98% by weight) and isoprene (2% by weight) having a molecular weight of 5000 and a bromine content of 2.5 and that the acrylic acid used is replaced on a chemical equivalent basis with phenyl acrylate.

EXAMPLE 10

A mixture of crotonic acid (2 equivalents) and a chlorinated polypropene having a molecular weight of 2500 and a chlorine content of 5% (0.5 equivalent of chlorine) is heated at 180°–220° C. for 5 hours and then at 200° C./1 mm. The residue is filtered and the filtrate is the desired acid.

EXAMPLE 11

A methyl ester of a high molecular weight monocarboxylic acid is prepared by heating an equimolar mixture of a chlorinated polyisobutene having a molecular weight of 1000 and a chlorine content of 4.7% by weight and methylmethacrylate at 140°–220° C.

When preparing the hydrocarbyl-substituted dicarboxylic acids useful in preparing the alkali metal salts used in the present invention, one or more of the above polyalkenes (or halogenated polyalkenes) is reacted with one or more acidic reagents selected from the group consisting of maleic or fumaric reactants of the general formula $$X(O)C—CH=CH—C(O)X' \quad \text{(XII)}$$

wherein X and X' are the same or different provided that at least one of X and X' is independently OH, O-lower hydrocarbyl, O—M, Cl, Br or together, X and X' can be —O— so as to form the anhydride. Ordinarily, the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes to prepare the desired hydrocarbyl-substituted succinic acids.

The hydrocarbyl-substituted succinic acid reagents used to prepare the alkali metal overbased salts (B) are similar to the hydrocarbyl-substituted succinic acids used as the acylating agents (A-1) described above where the hydrocarbyl-substituted succinic acids contain at least about one succinic group for each equivalent weight of substituent group. Thus, in one embodiment the hydrocarbyl-substituted succinic acids are prepared by reacting about one mole (or 1 equivalent) of a polyalkene with one mole (or 2 equivalents) of the maleic or fumaric acid reactant.

Procedures for preparing hydrocarbyl-substituted dicarboxylic acid reagents useful in preparing the alkali metal overbased salts are described in, for example, U.S. Pat. Nos. 3,087,936 (LeSuer) and 3,219,666 (Norman), the disclosures of which are hereby incorporated by reference. Examples of hydrocarbyl-substituted succinic acid reagents useful in preparing the alkali metal salts (B) include the succinic acylating agents exemplified above in Examples 1–6.

In one embodiment, the carboxylic acids are aromatic carboxylic acids. A group of useful aromatic carboxylic acids are those of the formula

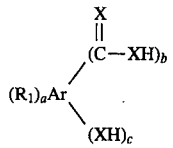

wherein R1 is an aliphatic hydrocarbyl group preferably derived from the above-described polyalkenes, a is a number in the range of 1 to about 4, usually 1 or 2, Ar is an aromatic group, each X is independently sulfur or oxygen, preferably oxygen, b is a number in the range of from 1 to about 4, usually 1 or 2, c is a number in the range of zero to about 4, usually 1 to 2, with the proviso that the sum of a, b and c does not exceed the number of valences of Ar. Examples of aromatic carboxylic acids include substituted benzoic, phthalic and salicylic acids.

The $R_1$ group is a hydrocarbyl group that is directly bonded to the aromatic group Ar. Examples of $R_1$ groups include substituents derived from polymerized olefins such as polyethylenes, polypropylenes, polybutylenes, ethylene-propylene copolymers, chlorinated olefin polymers and oxidized ethylene-propylene copolymers.

The aromatic group Ar may have the same structure as any of the aromatic groups Ar discussed below. Examples of the aromatic groups that are useful herein include the polyvalent aromatic groups derived from benzene, naphthalene, anthracene, etc., preferably benzene. Specific examples of Ar groups include phenylenes and naphthylene, e.g., methylphenylenes, ethoxyphenylenes, isopropylphenylenes, hydroxyphenylenes, dipropoxynaphthylenes, etc. Within this group of aromatic acids, a useful class of carboxylic acids are those of the formula

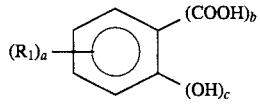

wherein $R_1$ is defined above, a is a number in the range of from 1 to about 4, preferably 1 to about 3; b is a number in the range of 1 to about 4, preferably 1 to about 2, c is a number in the range of zero to about 4, preferably 1 to about 2, and more preferably 1; with the proviso that the sum of a, b and c does not exceed 6. Preferably, b and c are each one and the carboxylic acid is a salicylic acid.

Overbased salts prepared from salicylic acids wherein the aliphatic hydrocarbon substituents ($R_1$) are derived from the above-described polyalkenes, particularly polymerized lower 1-mono-olefins such as polyethylene, polypropylene, polyisobutylene, ethylene/propylene copolymers and the like and having average carbon contents of about 50 to about 400 carbon atoms are particularly useful.

The above aromatic carboxylic acids are well known or can be prepared according to procedures known in the art. Carboxylic acids of the type illustrated by these formulae and processes for preparing their neutral and basic metal salts are well known and disclosed, for example, in U.S. Pat. Nos. 2,197,832; 2,197,835; 2,252,662; 2,252,664; 2,714,092; 3,410,798; and 3,595,791. These references are incorporated by reference for disclosure of carboxylic acid, their basic salt and processes of making the same.

As noted previously, the alkali metal overbased hydrocarbyl-substituted carboxylic acid may be derived from a mixture of carboxylic acid (preferably a hydrocarbyl-substituted carboxylic acid) and hydrocarbyl-substituted sulfonic acid. The hydrocarbyl-substituted carboxylic acid in the mixture generally will contain at least about 50 carbon atoms in the hydrocarbyl substituent, and the hydrocarbyl substituent may also be characterized as having a number average molecular weight of at least about 900. The sulfonic acids useful in the mixtures include the sulfonic and thiosulfonic acids. Generally they are salts of sulfonic acids. The sulfonic acids include the mono- or polynuclear aromatic or cycloaliphatic compounds. The oil-soluble sulfonic acids can be represented for the most part by one of the following formulae: $R_2$—T—$(SO_3)_aH$ and $R_3$—$(SO_3)_bH$, wherein T is a cyclic nucleus such as, for example, benzene, naphthalene, anthracene, diphenylene oxide, diphenylene sulfide, petroleum naphthenes, etc. $R_2$ and $R_3$ are generally an essentially hydrocarbon group, preferably free of acetylenic unsaturation, and containing about 4 to about 60 or more aliphatic carbon atoms, preferably an aliphatic hydrocarbon group such as alkyl or alkenyl. When $R_3$ is aliphatic it usually contains at least about 15 carbons; when it is an aliphatic-substituted cycloaliphatic group, the aliphatic substituents usually contain a total of at least about 12 carbon atoms. Specific examples of $R_2$ and $R_3$ are groups derived from petrolatum, saturated and unsaturated paraffin wax, and the above-described polyalkenes. The groups T, $R_2$, and $R_3$ in the above formulae can also contain other inorganic or organic substituents in addition to those enumerated above such as, for example, hydroxy, mercapto, halogen, nitro, amino, nitroso, sulfide, disulfide, etc. In the above Formulae, a and b are at least 1.

Specific examples of such sulfonic acids include mahogany sulfonic acids, bright stock sulfonic acids, petrolatum sulfonic acids, mono- and polywax-substituted naphthalene sulfonic acids, cetylchlorobenzene sulfonic acids, cetylphenol sulfonic acids, cetylphenol disulfide sulfonic acids, cetoxycapryl benzene sulfonic acids, dicetyl thianthrene sulfonic acids, dilauryl beta-naphthol sulfonic acids, dicapryl nitronaphthalene sulfonic acids, saturated paraffin wax sulfonic acids, unsaturated paraffin wax sulfonic acids, hydroxy-substituted paraffin wax sulfonic acids, tetraisobutylene sulfonic acids, tetraamylene sulfonic acids, chlorine substituted paraffin wax sulfonic acids, nitroso substituted paraffin wax sulfonic acids, petroleum naphthene sulfonic acids, cetylcyclopentyl sulfonic acids, lauryl cyclohexyl sulfonic acids, mono- and polywax substituted cyclohexyl sulfonic acids, dodecylbenzene sulfonic acids, "dimer alkylate" sulfonic acids, and the like.

Alkyl-substituted benzene sulfonic acids wherein the alkyl group contains at least 8 carbon atoms including dodecyl benzene "bottoms" sulfonic acids are particularly useful. The latter are acids derived from, benzene which has been alkylated with propylene tetramers or isobutene, trimers to introduce 1, 2, 3, or more branched-chain $C_{12}$ substituents on the benzene ring. Dodecyl benzene bottoms, principally mixtures of mono- and di-dodecyl benzenes, are available as by products from the manufacture of household detergents. Similar products obtained from alkylation bottoms formed during manufacture of linear alkyl sulfonates (LAS) are also useful in making the sulfonates used in this invention.

Illustrative examples of these sulfonic acids include polybutene or polypropylene substituted naphthalene sulfonic acids, sulfonic acids derived by the treatment of polybutenes having a number average molecular weight ($\bar{M}n$) in the range of 700 to 5000, preferably 700 to 1200, more preferably about 1500 with chlorosulfonic acids, paraffin wax sulfonic acids, polyethylene ($\bar{M}n$ equals about 900–2000, preferably about 900–1500, more, preferably 900–1200 or 1300) sulfonic acids, etc. Preferred sulfonic acids are mono-, di-, and tri-alkylated benzene (including hydrogenated forms thereof) sulfonic acids.

The promoters, that is, the materials which facilitate the incorporation of excess metal into the overbased material improve contact between the acidic material and the carboxylic acid or mixture of carboxylic acid and sulfonic acid (overbasing substrate). Generally, the promoter is a material which is slightly acidic and able to form a salt with the basic metal compound. The promoter must also be an acid weak enough to be displaced by the acidic material, usually carbon dioxide. Generally, the promoter has a pKa in the range from about 7 to about 10. A particularly comprehensive discussion of suitable promoters is found in U.S. Pat. Nos. 2,777,874, 2,695,910, 2,616,904, 3,384,586 and 3,492,231. These patents are incorporated by reference for their disclosure of promoters. Promoters may include phenolic substances such as phenols and naphthols; amines such as aniline, phenylenediamine, dodecylamine; etc. In one embodiment, the preferred promoters are the phenolic promoters. Phenolic promoters include a variety of hydroxy-substituted benzenes and naphthalenes. A particularly useful class of phenols are the alkylated phenols of the type listed in U.S. Pat. No. 2,777,874, e.g., heptylphenols, octylphenols, nonylphenols, and tetrapropenyl-substituted phenols. Mixtures of various promoters are sometimes used.

The inorganic or lower carboxylic acidic materials, which are reacted with the mixture of promoter, basic metal compound, reaction medium and the hydrocarbyl-substituted carboxylic acid are disclosed in the above cited patents, for example, U.S. Pat. No. 2,616,904. Included within the known group of useful acidic materials are lower carboxylic acids, having from 1 to about 8, preferably 1 to about 4 carbon atoms. Examples of these acids include formic acid, acetic acid, propanoic acid, etc., preferably acetic acid. Useful inorganic acidic compounds include HC, $SO_2$, $SO_3$, $CO_2$, $H_2S$, $N_2O_3$, etc., are ordinarily employed as the acidic materials. Preferred acidic materials are carbon dioxide and acetic acid, more preferably carbon dioxide.

The alkali metals present in the alkali metal overbased salts include principally lithium, sodium and potassium, with sodium being preferred. The overbased metal salts are prepared using a basic alkali metal compound. Illustrative of basic alkali metal compounds are hydroxides, oxides, alkoxides (typically those in which the alkoxy group contains up to 10 and preferably up to 7 carbon atoms), hydrides and amides of alkali metals. Thus, useful basic alkali metal compounds include sodium oxide, potassium oxide, lithium oxide, sodium hydroxide, potassium hydroxide, lithium hydroxide, sodium propoxide, lithium methoxide, potassium ethoxide, sodium butoxide, lithium hydride, sodium hydride, potassium hydride, lithium amide, sodium amide and potassium amide. Especially preferred are sodium hydroxide and the sodium lower alkoxides (i.e., those containing up to 7 carbon atoms).

The alkali metal overbased materials useful in the present invention may be prepared by methods known to those in the art. The methods generally involve adding acidic material to a reaction mixture comprising the hydrocarbyl-substituted carboxylic acid or mixture of carboxylic acid and sulfonic acid, the promoter and a basic alkali metal compound. These processes are described in the following U.S. Pat. Nos.: 2,616,904; 2,616,905; 2,616,906; 3,242,080; 3,250,710; 3,256,186; 3,274,135; 3,492,231; and 4,230,586. These patents are incorporated herein by reference for these disclosures.

In the present invention, the preferred hydrocarbyl-substituted carboxylic acids have relatively high molecular weights. Higher temperatures are generally used to promote contact between the acidic material, the succinic acid and the basic alkali metal compound. The higher temperatures also promote formation of the salt of the weakly acidic promoter by removal of at least some of the water. In preparing the overbased metal salts useful in the present invention, water must be removed from the reaction.

The reaction generally proceeds at temperatures from about 100° C. up to the decomposition temperature of the reaction mixture or the individual components of the reaction. The reaction may proceed at temperatures lower than 100° C., such as 60° C. or above, if a vacuum is applied. Generally, the reaction occurs at a temperature from about 110° C. to about 200° C., preferably 120° C. to about 175° C. and more preferably about 130° C. to about 150° C. Preferably, the reaction is performed in the presence of a reaction medium which includes naphtha, mineral oil, xylenes, toluenes and the like. In the present invention water may be removed by applying a vacuum, by blowing the reaction mixture with a gas such as nitrogen or by removing water as an azeotrope, such as a xylene-water azeotrope. Generally, in the present invention, the acidic material is provided as a gas, usually carbon dioxide. The carbon dioxide, while participating in the overbasing process, also removes water if the carbon dioxide is added at a rate which exceeds the rate carbon dioxide is consumed in the reaction.

The alkali metal overbased metal salts used in the present invention may be prepared incrementally (batch) or by continuous processes. One incremental process involves the following steps: (A) adding a basic alkali metal compound to a reaction mixture comprising the hydrocarbyl-substituted carboxylic acid (or mixture of carboxylic and sulfonic acids) and promoter, and removing free water from the reaction mixture to form an alkali metal salt of the acidic organic compound; (B) adding more basic alkali metal compound to the reaction mixture and removing free water from the reaction mixture; and (C) introducing the acidic material to the reaction mixture while removing water. Steps (B) and (C) are repeated until a product of the desired metal ratio is obtained.

Another method of preparing the alkali metal overbased salts is a semi-continuous process for preparing the alkali metal overbased salts. The process involves (A) adding at least one basic alkali metal compound to a reaction mixture comprising an alkali metal salt of hydrocarbyl-substituted carboxylic acid (or mixture of carboxylic acid and sulfonic acid) and removing free water from the reaction mixture; and (B) concurrently thereafter, (1) adding basic alkali metal compound to the reaction mixture; (2) adding an inorganic or lower carboxylic acidic material to the reaction mixture; and (3) removing water from the reaction mixture. The addition of basic alkali metal compounds together with the inorganic or lower carboxylic acidic material where the addition is done continuously along with the removal of water results in a shortened processing time for the reaction.

The term "free water" refers to the amount of water readily removed from the reaction mixture. This water is typically removed by azeotropic distillation. The water which remains in the reaction mixture is believed to be coordinated, associated, or solvated. The water may be in the form of water of hydration. Some basic alkali metal compounds may be delivered to the reaction mixture as aqueous solutions. The excess water added, or free water, with the basic alkali metal compound is usually then removed by azeotropic distillation, or vacuum stripping.

Any water generated during the overbasing process is desirably removed as it is formed to minimize or eliminate formation of oil-insoluble metal carbonates. During the overbasing process above, the amount of water present prior to addition of the inorganic or lower carboxylic acidic material (steps (B) and (B-1) above) is less than about 30% by weight of the reaction mixture, preferably less than 20%, more preferably less than 10%. Generally, the amount of water present after addition of the inorganic or lower carboxylic acidic material is up to about 4% by weight of the reaction mixture, more preferably up to about 2%.

In another embodiment, the alkali metal overbased salts are borated alkali metal overbased salts. Borated overbased metal salts are prepared by reacting a boron compound with the basic alkali metal salt. Boron compounds include boron oxide, boron oxide hydrate, boron trioxide, boron trifluoride, boron tribromide, boron trichloride, boron acid such as boronic acid, boric acid, tetraboric acid and metaboric acid, boron hydrides, boron amides and various esters of boron acids. The boron esters are preferably lower alkyl (1–7 carbon atoms) esters of boric acid. Preferably, the boron compounds are boric acid. Generally, the overbased metal salt is reacted with a boron compound at about 50° C. to about 250° C., preferably 100° C. to about 200° C. The reaction may be accomplished in the presence of a solvent such as mineral oil, naphtha, kerosene, toluene or xylene. The overbased metal salt is reacted with a boron compound in amounts to provide at least about 0.5%, preferably about 1% up to about 5%, preferably about 4%, more preferably about 3% by weight boron to the composition.

The following examples illustrate the alkali metal overbased salts (B) useful in the present invention and methods of making the same.

EXAMPLE B-1

A reaction vessel is charged with 1122 grams (2 equivalents) of a polybutenyl-substituted succinic anhydride derived from a polybutene ($\bar{M}n$=1000, 1:1 ratio of polybutene to maleic acid), 105 grams (0.4 equivalent) of tetrapropenyl phenol, 1122 grams of xylene and 1000 grams of 100 neutral mineral oil. The mixture is stirred and heated to 80° C. under nitrogen, and 580 grams of a 50% aqueous solution of sodium hydroxide are added to the vessel over 10 minutes. The mixture is heated from 80° C. to 120° C. over 1.3 hours. Water is removed by azeotropic reflux and the temperature rises to 150° C. over 6 hours while 300 grams of water is collected. (1) The reaction mixture is cooled to about 80° C. whereupon 540 grams of a 50% aqueous solution of sodium hydroxide are added to the vessel. (2) The reaction mixture is heated to 140° C. over 1.7 hours and water is removed at reflux conditions. (3) The reaction mixture is carbonated at 1 standard cubic foot per hour (scfh) while removing water for 5 hours. Steps (1)–(3) are repeated using 560 grams of an aqueous sodium hydroxide solution. Steps (1)–(3) are repeated using 640 grams of an aqueous sodium hydroxide solution. Steps (1)–(3) are then repeated with another 640 grams of a 50% aqueous sodium hydroxide solution. The reaction mixture is cooled and 1000 grams of 100 neutral mineral oil are added to the reaction mixture. The reaction mixture is vacuum stripped to 115° C. at about 30 millimeters of mercury. The residue is filtered through diatomaceous earth. The filtrate has a total base number of 361, 43.4% sulfated ash, 16.0% sodium, 39.4% oil, a specific gravity of 1.11, and the overbased metal salt has a metal ratio of about 13.

EXAMPLE B-2

The overbased salt obtained in Example B-1 is diluted with mineral oil to provide a composition containing 13.75 sodium, a total base number of about 320, and 45% oil.

EXAMPLE B-3

A reaction vessel is charged with 700 grams of a 100 neutral mineral oil, 700 grams (1.25 equivalents) of the succinic anhydride of Example B-1 and 200 grams (2.5 equivalents) of a 50% aqueous solution of sodium hydroxide. The reaction mixture is stirred and heated to 80° C. whereupon 66 grams (0.25 equivalent) of tetrapropenyl phenol are added to the reaction vessel. The reaction mixture is heated from 80° C. to 140° C. over 2.5 hours while blowing of nitrogen and removing 40 grams of water. Carbon dioxide (28 grams, 1.25 equivalents) is added over 2.25 hours at a temperature from 140°–165 ° C. The reaction mixture is blown with nitrogen at 2 standard cubic foot per hour (scfh) and a total of 112 grams of water is removed. The reaction temperature is decreased to 115° C. and the reaction mixture is filtered through diatomaceous earth. The filtrate has 4.06% sodium, a total base number of 89, a specific gravity of 0.948, 44.5% oil, and the overbased salt has a metal ratio of about 2.

EXAMPLE B-4

A reaction vessel is charged with 281 grams (0.5 equivalent) of the succinic anhydride of Example B-1, 281 grams of xylene, 26 grams of tetrapropenyl substituted phenol and 250 grams of 100 neutral mineral oil. The mixture is heated to 80° C. and 272 grams (3.4 equivalents) of an aqueous sodium hydroxide solution are added to the reaction mixture. The mixture is blown with nitrogen at 1 scfh, and the reaction temperature is increased to 148° C. The reaction mixture is then blown with carbon dioxide at 1 scfh for one hour and 25 minutes while 150 grams of water are collected. The reaction mixture is cooled to 80° C. whereupon 272 grams (3.4 equivalents) of the above sodium hydroxide solution are added to the reaction mixture, and the mixture is blown with nitrogen at 1 scfh. The reaction temperature is increased to 140° C. whereupon the reaction mixture is blown with carbon dioxide at 1 scfh for 1 hour and 25 minutes while 150 grams of water are collected. The reaction temperature is decreased to 100° C., and 272 grams (3.4 equivalents) of the above sodium hydroxide solution are added while blowing the mixture with nitrogen at 1 scfh. The reaction temperature is increased to 1 48° C., and the reaction mixture is blown with carbon dioxide at 1 scfh for 1 hour and 40 minutes while 160 grams of water are collected. The reaction mixture is cooled to 90° C. and 250 grams of 100 neutral mineral oil are added to the reaction mixture. The reaction mixture is vacuum stripped at 70° C. and the residue is filtered through diatomaceous earth. The filtrate contains 50.0% sodium sulfate ash by ASTM D-874, total base number of 408, a specific gravity of 1.18, 37.1% oil, and the salt has a metal ratio of about 15.8.

EXAMPLE B-5

A reaction vessel is charged with 700 grams of the product of Example B-4. The reaction mixture is heated to 75° C. whereupon 340 grams (5.5 equivalents) of boric acid are added over 30 minutes. The reaction mixture is heated to 110° C. over 45 minutes, and the reaction temperature is maintained for 2 hours. A 100 neutral mineral oil (80 grams) is added to the reaction mixture. The reaction mixture is blown with nitrogen at 1 scfh at 160° C. for 30 minutes while 95 grams of water are collected. Xylene (200 grams) is added to the reaction mixture and the reaction temperature is maintained at 130°–140° C. for 3 hours. The reaction mixture is vacuum stripped at 150° C. and 20 millimeters of mercury. The residue is filtered through diatomaceous earth. The filtrate contains 5.84% boron and 33.1% oil. The residue has a total base number of 309.

EXAMPLE B-6

A reaction vessel is charged with 224 grams (0.4 equivalents) of the succinic anhydride of Example B-1, 21 grams (0.08 equivalent) of a tetrapropenyl phenol, 224 grams of xylene and 224 grams of 100 neutral mineral oil. The mixture is heated, and 212 grams (2.65 equivalents) of a 50% aqueous sodium hydroxide solution are added to the reaction vessel. The reaction temperature increases to 130° C. and 41 grams of water are removed by nitrogen blowing at 1 scfh. The reaction mixture is then blown with carbon dioxide at 1 scfh for 1.25 hours. Additional sodium hydroxide solution (432 grams, 5.4 equivalents) is added over four hours while blowing with carbon dioxide at 0.5 scfh at 130° C. During the addition, 301 grams of water are removed from the reaction vessel. The reaction temperature is increased to 150° C. and the rate of carbon dioxide blowing is increased to 1.5 scfh and maintained for 1 hour and 15 minutes. The reaction mixture is cooled to 150° C. and blown with nitrogen at 1 scfh while 176 grams of oil are added to the reaction mixture. The reaction mixture is blown with nitrogen at 1.8 scfh for 2.5 hours, and the mixture is then filtered through diatomaceous earth. The filtrate contains 15.7% sodium and 39% oil. The filtrate has a total base number of 380, and a metal ratio of about 14.5.

EXAMPLE B-7

A reaction vessel is charged with 561 grams (1 equivalent) of the succinic anhydride of Example B-1, 52.5 grams (0.2 equivalent) of a tetrapropenylphenol, 561 grams xylene and 500 grams of a 100 neutral mineral oil. The mixture is heated to 50° C. under nitrogen, and 373.8 grams (6.8 equivalents) of potassium hydroxide and 299 grams of water are added to the mixture. The reaction mixture is heated to 135° C. while 145 grams of water are removed. The azeotropic distillate is clear. Carbon dioxide is added to the reaction mixture at 1 scfh for two hours while 195 grams of water are removed azeotropically. The reaction mixture is cooled to 75° C. whereupon a second portion of 373.8 grams of potassium hydroxide and 150 grams of water are added to the reaction vessel. The reaction mixture is heated to 150° C. with azeotropic removal of 70 grams of water. Carbon dioxide (I scfh) is added for 2.5 hours while 115 grams of water is removed azeotropically. The reaction is cooled to 100° C. where a third portion of 373.8 grams of potassium hydroxide and 150 grams of water is added to the vessel. The reaction mixture is heated to 150° C. while 70 grams of water are removed. The reaction mixture is blown with carbon dioxide at 1 scfh for one hour while 30 grams of water are removed. The reaction temperature is decreased to 70° C. The reaction mixture is reheated to 1 50° C. under nitrogen. At 150° C. the reaction mixture is blown with carbon dioxide at 1 scfh for two hours while 80 grams of water is removed. The carbon dioxide is replaced with a nitrogen purge, and 60 grams of water is removed. The reaction is then blown with carbon dioxide at 1 scfh for three hours with removal of 64 grams of water. The reaction mixture is cooled to 75° C. where 500 grams of 100 neutral mineral are added to the reaction mixture. The reaction is vacuum stripped to 11 5° C. and 25 millimeters of mercury. The residue is filtered through diatomaceous earth. The filtrate contains 35% oil, has a base number of about 322, and a metal ratio of about 13.6.

EXAMPLE B-8

An overbased sodium sulfonate/succinate mixture is prepared by the process described in Example B-1 using 562 grams (1 equivalent) of the succinic anhydride of Example B-1 and 720 grams (0.8 equivalent) of a polybutenyl-substituted sulfonic acid derived from a polybutene (Mn=800) and 1632 grams (20.4 equivalents) of a 50% aqueous solution of sodium hydroxide.

EXAMPLE B-9

A sodium overbased monocarboxylic acid salt is prepared by the general process of Example B-1 by reacting 1 equivalent of the high molecular weight monocarboxylic acid of Example 8 with a total of 15 equivalents of sodium hydroxide.

EXAMPLE B-10

A sodium overbased succinic acid salt is prepared by the general process of Example B-1 by reacting one equivalent of the hydrocarbyl-substituted succinic reagent prepared in Example 4 with a total of 12 equivalents of sodium hydroxide.

EXAMPLE B-11

A solution is prepared by mixing into 1251 parts of a volatile hydrocarbon solvent (flash point ~110° F. (43° C.)) 159 parts of tetrapropenyl phenol, 0.052 parts of a hydrocarbon solvent diluted silicone antifoam, and 1000 parts of a polybutenyl-substituted succinic anhydride as described in Example B-1. While mixing, the temperature is adjusted to 49° C. followed by addition of 187 parts of 50% aqueous NaOH. The temperature is increased to about 68° C. and is held at 68° C. ±3° C. for 2 hours. A first portion (about 50%) of NaOH (Rayon grade caustic flake) is charged and the batch is heated to 132°–143° C., removing $H_2O$ under solvent reflux. The material is carbonated by subsurface blowing while maintaining about 132°–143° C. until a base number of <1 is attained. After the batch is cooled to 82° C. a second portion of NaOH is added followed by reheating to 132° C. and carbonation until the base number is ≦1, $H_2O$ being removed under reflux. Total NaOH as flake=1050 parts, total $CO_2$=590 parts.

The batch is heated rapidly to 149° C. and $H_2O$ is removed until analysis shows <0.50% $H_2O$. The batch is flash stripped at 160° C. at 70 mm Hg (9.3 kPa) until flash point is greater than 110° C. The residue is filtered yielding a filtrate containing about 45% oil and containing, by analysis, 12.8% Na.

The lubricating oil compositions of the present invention contain a major amount of an oil of lubricating viscosity, at least 1% by weight of the carboxylic derivative compositions (A) described above, and an amount of at least one alkali metal overbased salt (B) of a carboxylic acid or mixture of carboxylic and sulfonic acids as described above. More often, the lubricating compositions of this invention will contain at least 70% or 80% of oil. The amount of carboxylic derivative (A) included in the lubricating oil compositions of the invention may vary over a wide range provided that the oil composition contains at least about 1% by weight (on a chemical, oil-free basis) of the carboxylic derivative composition (A). In other embodiments, the oil compositions of the present invention may contain at least about 2% or 2.5% by weight or even at least about 3% by weight of the carboxylic derivative composition (A). The carboxylic derivative composition (A) provides the lubricating oil compositions of the present invention with desirable VI and dispersant properties.

As noted above, the lubricating oil compositions of the present invention also contain at least about 0.002 equivalent of alkali metal per 100 grams of lubricating oil composition. In other embodiments, the lubricating oil compositions will contain at least about 0.003 or at least about 0.005 equivalent of alkali metal per 100 grams of lubricating oil composition. The maximum amount of alkali metal present in the lubricating oil compositions may vary over a wide range depending upon the nature of the other components of the lubricating oil composition and the intended use of the lubricating oil composition. Generally, however, the lubricating oil compositions of the present invention will contain up to about 0.008 or even 0.01 equivalent of alkali metal per 100 grams of lubricating oil composition.

(C) Magnesium or Calcium Overbased Salt

The lubricating oil compositions of the present invention contain at least one magnesium or at least one calcium overbased salt of an acidic organic compound. In particular, the lubricating oil compositions of the present invention contain either (C-1) at least one magnesium overbased salt of an acidic organic compound having a metal ratio of at least 3 provided that the lubricating oil composition is free of calcium overbased salts of acidic organic compounds having a metal ratio of at least 3; or (C-2) at least one calcium overbased salt of an acidic organic compound having a metal ratio greater than 3 provided that the lubricating oil composition is free of magnesium overbased salts of acidic organic compounds having a metal ratio greater than 3.

The amount of magnesium or calcium overbased salt included in the lubricants of the present invention may be varied over a wide range, and useful amounts in any particular lubricating oil composition can be readily determined by one skilled in the art. The magnesium and calcium salts function as auxiliary or supplementary detergents. The amount of the calcium or magnesium salt contained in a lubricant of the invention may vary from about 0.01 up to about 5% or more. Generally, the magnesium or the calcium overbased salt is present in an amount of from about 0.1 to about 2% by weight.

The use of the term "free of" in this application and claims refers to compositions which are substantially free of the indicated compositions. Some of the indicated material may be present in the lubricants as a contaminant. The acidic organic compound from which the magnesium and calcium salts may be prepared may be at least one sulfur acid, carboxylic acid, phosphorus acid, phenol, or mixtures thereof.

The salts which are useful as component (C) are overbased or basic. The overbased or basic salts contain an excess of the magnesium or calcium cation. The basic or overbased salts will have metal ratios (MR) of up to about 40 and more particularly from about 1.5 or 2 up to about 30 or 40. A commonly employed method for preparing the basic (or overbased) salts comprises heating a mineral oil solution of the acid with a stoichiometric excess of a metal neutralizing agent, e.g., a metal oxide, hydroxide, carbonate, bicarbonate, sulfide, etc., at temperatures above about 50° C. in addition, various promoters may be used in the neutralizing process to aid in the incorporation of the large excess of metal. These promoters include such compounds as the phenolic substances, e.g., phenol and naphthol; alcohols such as methanol, 2-propanol, octyl alcohol and Cellosolve carbitol, amines such as aniline, phenylenediamine, and dodecyl amine, etc.

As mentioned above, the acidic organic compound from which the salt of component (C) is derived may be at least one sulfur acid, carboxylic acid, phosphorus acid, or phenol or mixtures thereof. The sulfur acids include sulfonic acids, thiosulfonic, sulfinic, sulfenic, partial ester sulfuric, sulfurous and thiosulfuric acids.

The sulfonic acids which are useful in preparing component (C) include those represented by the formulae $$R_xT(SO_3H)_y \quad \text{(XIII)}$$

and $$R'(SO_3H)_r \quad \text{(XIV)}$$

In these formulae, R' is an aliphatic or aliphatic-substituted cycloaliphatic hydrocarbon or essentially hydrocarbon group free from acetylenic unsaturation and containing up to about 60 carbon atoms. When R' is aliphatic, it usually contains at least about 15 carbon atoms; when it is an aliphatic-substituted cycloaliphatic group, the aliphatic substituents usually contain a total of at least about 12 carbon atoms. Examples of R' are alkyl, alkenyl and alkoxyalkyl radicals, and aliphatic-substituted cycloaliphatic groups wherein the aliphatic substituents are alkyl, alkenyl, alkoxy, alkoxyalkyl, carboxyalkyl and the like. Generally, the cycloaliphatic nucleus is derived from a cycloalkane or a cycloalkene such as cyclopentane, cyclohexane, cyclohexene or cyclopentene. Specific examples of R' are cetylcyclohexyl, laurylcyclohexyl, cetyloxyethyl, octadecenyl, and groups derived from petroleum, saturated and unsaturated paraffin wax, and olefin polymers including polymerized monoolefins containing about 2–8 carbon atoms per olefinic monomer unit and diolefins containing 4 to 8 carbon atoms per monomer unit. R' can also contain other substituents such as phenyl, cycloalkyl, hydroxy, mercapto, halo, nitro, amino, nitroso, lower alkoxy, lower alkylmercapto, carboxy, carbalkoxy, oxo or thio, or interrupting groups such as —NH—, —O— or —S—, as long as the essentially hydrocarbon character is not destroyed.

R in Formula XIII is generally a hydrocarbon or essentially hydrocarbon group free from acetylenic unsaturation and containing from about 4 to about 60 aliphatic carbon atoms, preferably an aliphatic hydrocarbon group such as alkyl or alkenyl. It may also, however, contain substituents or interrupting groups such as those enumerated above provided the essentially hydrocarbon character thereof is retained. In general, any non-carbon atoms present in R' or R do not account for more than 10% of the total weight thereof.

T is a cyclic nucleus which may be derived from an aromatic hydrocarbon such as benzene, naphthalene, anthracene or biphenyl, or from a heterocyclic compound such as pyridine, indole or isoindole. Ordinarily, T is an aromatic hydrocarbon nucleus, especially a benzene or naphthalene nucleus.

The subscript x is at least 1 and is generally 1–3. The subscripts r and y have an average value of about 1–2 per molecule and are generally also 1.

The sulfonic acids are generally petroleum sulfonic acids or synthetically prepared alkaryl sulfonic acids. Among the petroleum sulfonic acids, the most useful products are those prepared by the sulfonation of suitable petroleum tractions with a subsequent removal of acid sludge, and purification.

Synthetic alkaryl sulfonic acids are prepared usually from alkylated benzenes such as the Friedel-Crafts reaction products of benzene and polymers such as polypropylene. The following are specific examples of sulfonic acids useful in preparing the salts (C) . It is to be understood that such examples serve also to illustrate the salts of such sulfonic acids useful as component (C). In other words, for every sulfonic acid enumerated, it is intended that the corresponding basic metal salts thereof are also understood to be illustrated. (The same applies to the lists of other acid materials listed below.) Such sulfonic acids include mahogany sulfonic acids, bright stock sulfonic acids, petrolatum sulfonic acids, mono- and polywax-substituted naphthalene sulfonic acids, cetylchlorobenzene sulfonic acids, cetylphenol sulfonic acids, cetylphenol disulfide sulfonic acids, cetoxycapryl benzene sulfonic acids, dicetyl thianthrene sulfonic acids, dilauryl beta-naphthol sulfonic acids, dicapryl nitronaphthalene sulfonic acids, saturated paraffin wax sulfonic acids, unsaturated paraffin wax sulfonic acids, hydroxy-substituted paraffin wax sulfonic acids, tetraisobutylene sulfonic acids, tetraamylene sulfonic acids, chlorine substituted paraffin wax sulfonic acids, nitroso substituted paraffin wax sulfonic acids, petroleum naphthene sulfonic acids, cetylcyclopentyl sulfonic acids, lauryl cyclohexyl sulfonic acids, mono- and polywax substituted cyclohexyl sulfonic acids, dodecylbenzene sulfonic acids, "dimer alkylate" sulfonic acids, and the like.

Alkyl-substituted benzene sulfonic acids wherein the alkyl group contains at least 8 carbon atoms including dodecyl benzene "bottoms" sulfonic acids are particularly useful. The latter are acids derived from benzene which has been alkylated with propylene tetramers or isobutene trimers to introduce 1, 2, 3, or more branched-chain $C_{12}$ substituents on the benzene ring. Dodecyl benzene bottoms, principally mixtures of mono- and di-dodecyl benzenes, are available as by products from the manufacture of household detergents. Similar products obtained from alkylation bottoms formed during manufacture of linear alkyl sulfonates (LAS) are also useful in making the sulfonates used in this invention.

The production of sulfonates from detergent manufacture by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

Other descriptions of basic magnesium or calcium sulfonate salts which can be incorporated into the lubricating oil compositions of this invention as component (C), and techniques for making them can be found in the following U.S. Pat. Nos.: 2,174,110; 2,202,781; 2,239,974; 2,319,121; 2,337,552; 3,488,284; 3,595,790; and 3,798,012. These are hereby incorporated by reference for their disclosures in this regard.

Suitable carboxylic acids from which useful alkaline earth metal salts (C) can be prepared include aliphatic, cycloaliphatic and aromatic mono and polybasic carboxylic acids including naphthenic acids, alkyl- or alkenyl-substituted cyclopentanoic acids, alkyl- or alkenyl-substituted cyclohexanoic acids, and alkyl- or alkenyl-substituted aromatic carboxylic acids. The aliphatic acids generally contain from about 8 to about 50, and preferably from about 12 to about 25 carbon atoms. The cycloaliphatic and aliphatic carboxylic acids are preferred, and they can be saturated or unsaturated. Specific examples include 2-ethylhexanoic acid, linolenic acid, propylene tetramer-substituted maleic acid, behenic acid, isostearic acid, pelargonic acid, capric acid, palmitoleic acid, linoleic acid, laurie acid, oleic acid, ricinoleic acid, unclecyclic acid, dioctylcyclopentanecarboxylic acid, myristic acid, dilauryldecahydronaphthalenecarboxylic acid, stearyl-octahydroindenecarboxylic acid, palmitic acid, alkyl- and alkenylsuccinic acids, acids formed by oxidation of petrolatum or of hydrocarbon waxes, and commercially available mixtures of two or more carboxylic acids such as tall oil acids, rosin acids, and the like.

The equivalent weight of the acidic organic compound is its molecular weight divided by the number of acidic groups (i.e., sulfonic acid or carboxy groups) present per molecule.

The pentavalent phosphorus acids useful in the preparation of component (C) may be an organophosphoric, phosphonic or phosphinic acid, or a thio analog of any of these.

Component (C) may also be prepared from phenols; that is, compounds containing a hydroxy group bound directly to an aromatic ring. The term "phenol" as used herein includes compounds having more than one hydroxy group bound to an aromatic ring, such as catechol, resorcinol and hydroquinone. It also includes alkylphenols such as the cresols and ethylphenols, and alkenylphenols. Preferred are phenols containing at least one alkyl substituent containing about 3–100 and especially about 6–50 carbon atoms, such as heptylphenol, octylphenol, dodecylphenol, tetrapropene-alkylated phenol, octadecylphenol and polybutenylphenols. Phenols containing more than one alkyl substituent may also be used, but the monoalkylphenols are preferred because of their availability and ease of production.

Also useful are condensation products of the above-described phenols with at least one lower aldehyde or ketone, the term "lower" denoting aldehydes and ketones containing not more than 7 carbon atoms. Suitable aldehydes include formaldehyde, acetaldehyde, propionaldehyde, etc.

The equivalent weight of the acidic organic compound is its molecular weight divided by the number of acidic groups (i.e., sulfonic acid or carboxy groups) present per molecule.

The following examples illustrate the preparation of the overbased magnesium and calcium salts useful as component (C).

EXAMPLE C-1

A mixture of 906 grams of an oil solution of an alkyl phenyl sulfonic acid (having an average molecular weight of 450, vapor phase osmometry), 564 grams mineral oil, 600 grams toluene, 98.7 grams magnesium oxide and 120 grams water is blown with carbon dioxide at a temperature of 78°–85° C. for 7 hours at a rate of about 3 cubic feet of carbon dioxide per hour. The reaction mixture is constantly agitated throughout the carbonation. After carbonation, the reaction mixture is stripped to 165° C./20 torr and the residue filtered. The filtrate is an oil solution (34% oil) of the desired overbased magnesium sulfonate having a metal ratio of about 3.

EXAMPLE C-2

A mixture of 160 grams of blend oil, 111 grams of polyisobutenyl (number average Mw=950) succinic anhydride, 52 grams of n-butyl alcohol, 11 grams of water, 1.98 grams of Peladow (a product of Dow Chemical identified as containing 94–97% $CaCl_2$) and 90 grams of hydrated lime are mixed together. Additional hydrated lime is added to neutralize the subsequently added sulfonic acid, the amount of said additional lime being dependent upon the acid number of the sulfonic acid. An oil solution (1078 grams, 58% by weight of oil) of a straight chain dialkyl benzene sulfonic acid (Mw=430) is added with the temperature of the reaction mixture not exceeding 79° C. The temperature is adjusted to 60° C. The reaction product of heptyl phenol, lime and formaldehyde (64.5 grams), and 217 grams of methyl alcohol are added. The reaction mixture is blown with carbon dioxide to a base number Coromophenol blue) of 20–30. Hydrated lime (112 grams) is added to the reaction mixture, and the mixture is blown with carbon dioxide to a base number Coromophenol blue) of 45–60, while maintaining the temperature of the reaction mixture at 46°–52° C. The latter step of hydrated lime addition followed by carbon dioxide blowing is repeated three more times with the exception with the last repetition the reaction mixture is carbonated to a base number (bromophenol blue) of 45–55. The reaction mixture is flash dried at 93°–104° C., kettle dried at 149°–160° C., filtered and adjusted with oil to a 12.0% Ca level. The product is an overbased calcium sulfonate having a base number (bromophenol blue) of 300, a metal content of 12.0% by weight, a metal ratio of 12, a sulfate ash content of 40.7% by weight, and a sulfur content of 1.5% by weight. The oil content is 53% by weight.

EXAMPLE C-3

A reaction mixture comprising 135 grams mineral oil, 330 grams xylene, 200 grams (0.235 equivalent) of a mineral oil solution of an alkylphenyl-sulfonic acid (average molecular weight 425), 19 grams (0.068 equivalent) of tall oil acids, 60 grams (about 2.75 equivalents) of magnesium oxide, 83 grams methanol, and 62 grams water is carbonated at a rate of 15 grams of carbon dioxide per hour for about two hours at the methanol reflux temperature. The carbon dioxide inlet rate is then reduced to about 7 grams per hour, and the methanol is removed by raising the temperature to about 98° C. over a three hour period. Water (47 grams) is added and carbonation is continued for an additional 3.5 hours at a temperature of about 95° C. The carbonated mixture is then stripped by heating to a temperature of 140°– 145° C. over a 2.5 hour period. This results in an oil solution of a basic magnesium salt characterized by a metal ratio of about 10.

The carbonated mixture is cooled to about 60°–65° C., and 208 grams xylene, 60 grams magnesium oxide, 83 grams methanol and 62 grams water are added thereto. Carbonation is resumed at a rate of 15 grams per hour for two hours at the methanol reflux temperature. The carbon dioxide addition rate is reduced to 7 grams per hour and the methanol is removed by raising the temperature to about 95° C. over a three hour period. An additional 41.5 grams of water are added and carbonation is continued at 7 grams per hour at a temperature of about 90°–95° C. for 3.5 hours. The carbonated mass is then heated to about 150°–160° C. over a 3.5 hour period and then further stripped by reducing the pressure to 20 mm. (Hg.) at this temperature. The carbonated reaction product is filtered, and the filtrate is an oil-solution of the desired basic magnesium salt characterized by a metal ratio of 20.

EXAMPLE C-4

A mixture of 835 grams of 100 neutral mineral oil, 118 grams of a polybutenyl (Mw=950)-substituted succinic anhydride, 140 grams of a 65:35 molar mixture of isobutyl alcohol and amyl alcohol, 43.2 grams of a 15% calcium chloride aqueous solution and 86.4 grams of lime is prepared. While maintaining the temperature below 80° C., 1000 grams of an 859 solution of a primary bright stock mono-alkyl benzene sulfonate, having a molecular weight of about 480, a neutralization acid number of 110, and 15% by weight of an organic diluent is added to the mixture. The mixture is dried at 150° C. to about 0.7% water. The mixture is cooled to 46°–52° C. where 127 grams of the isobutyl-amyl alcohol mixture described above, 277 grams of methanol and 87.6 grams of a 31% solution of calcium overbased, formaldehyde-coupled, heptylphenol having a metal ratio of 8 and 2.2% calcium are added to the mixture. Three increments of 171 grams of lime are added separately and carbonated to a neutralization base number in the range of 50–60. A fourth lime increment of 171 grams is added and carbonated to a neutralization base number of 45–55. Approximately 331 grams of carbon dioxide are used. The mixture is dried at 1 50° C. to approximately 0.5% water. The reaction mixture is filtered and the filtrate is the desired product. The product contains 41% oil, 12% calcium and has a metal ratio of 11.

(D) Metal Dihydrocarbyl Dithiophosphate

In addition to the carboxylic dispersant (A), the alkali metal overbased metal salt (B) and either the magnesium salt (C-1) or the calcium salt (C-2), the lubricating oil compositions of the present invention may contain and generally do contain other additive components including antiwear agents such as metal salts of dihydrocarbyl dithiophosphates.

The metal dihydrocarbyl dithiophosphate which may be included in the oil compositions are characterized by the formula

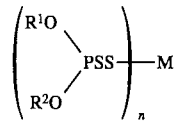

(XV)

wherein $R^1$ and $R^2$ are each independently hydrocarbyl groups containing from 3 to about 13 carbon atoms, M is a metal, and n is an integer equal to the valence of M.

Generally, the oil compositions of the present invention will contain varying amounts of one or more of the above-identified metal dithiophosphates such as from about 0.01 up to about 2% or to 5% by weight, and more generally from about 0.01 to about 1% by weight based on the weight of the total oil composition.

More typically, the metal dithiophosphates are used in amounts to provide from about 0.02 to about 0.15% by weight of phosphorus to the lubricant. In one embodiment, lubricating oil compositions contain from about 0.1% to about 0.12% by weight of phosphorus as metal dithiophosphate. In another embodiment, lubricants contain from about 0.08% to about 0.10% by weight of phosphorus and in still another embodiment, up to about 0.05% by weight of phosphorus as metal dithiophosphate.

Current trends are toward use of reduced levels of phosphorus as metal dithiophosphate because it is suspected that phosphorus may contribute toward poisoning of the noble metal catalysts employed to reduce harmful exhaust emissions.

Since it is believed that phosphorus contributes to the antiwear properties of lubricants, it is important that other components making up the lubricant composition do not adversely affect wear to such an extent that lower levels of phosphorus are rendered ineffective.

The metal dithiophosphates are added to the lubricating oil compositions of the invention to improve the anti-wear and antioxidant properties of the oil compositions.

The hydrocarbyl groups $R^1$ and $R^2$ in the dithiophosphate may be alkyl, cycloalkyl, aralkyl or alkaryl groups, or a substantially hydrocarbon group of similar structure. By "substantially hydrocarbon" is meant hydrocarbons which contain substituent groups such as ether, ester, nitro, or halogen which do not materially affect the hydrocarbon character of the group.

Illustrative alkyl groups include isopropyl, isobutyl, n-butyl, sec-butyl, the various amyl groups, n-hexyl, methylisobutyl carbinyl, heptyl, 2-ethylhexyl, diisobutyl, isooctyl, nonyl, behenyl, decyl, dodecyl, tridecyl, etc. Illustrative lower alkylphenyl groups include butylphenyl, amylphenyl, heptylphenyl, etc. Cycloalkyl groups likewise are useful and these include chiefly cyclohexyl and the lower alkyl-cyclohexyl radicals. Many substituted hydrocarbon groups may also be used, e.g., chloropentyl, dichlorophenyl, and dichlorodecyl.

In another embodiment, at least one of $R^1$ and $R^2$ in Formula XV is an isopropyl or secondary butyl group. In yet another embodiment, both and $R^2$ are secondary alkyl groups.

The phosphorodithioic acids from which the metal salts useful in this invention are prepared are well known. Examples of dihydrocarbyl phosphorodithioic acids and metal salts, and processes for preparing such acids and salts are found in, for example, U.S. Pat. Nos. 4,263,150; 4,289,635; 4,308,154; and 4,417,990. These patents are hereby incorporated by reference for such disclosures.

The phosphorodithioic acids are prepared by the reaction of phosphorus pentasulfide with an alcohol or phenol or mixtures of alcohols. The reaction involves four moles of the alcohol or phenol per mole of phosphorus pentasulfide, and may be carried out within the temperature range from about 50° C. to about 200° C. Thus the preparation of O,O-di-n-hexyl phosphorodithioic acid involves the reaction of phosphorus pentasulfide with four moles of n-hexyl alcohol at about 100° C. for about two hours. Hydrogen sulfide is liberated and the residue is the defined acid. The preparation of the metal salt of this acid may be effected by reaction with metal oxide. Simply mixing and heating these two reactants is sufficient to cause the reaction to take place and the resulting product is sufficiently pure for the purposes of this invention.

The metal salts of dihydrocarbyl dithiophosphates which are useful in this invention include those salts containing Group I metals, Group II metals, aluminum, lead, tin, molybdenum, manganese, cobalt, and nickel. Group I and Group II (including Ia, Ib, IIa and IIb) are defined in the Periodic Table of the Elements in the Merck Index, 9th edition (1976). The Group II metals, aluminum, tin, iron, cobalt, lead, molybdenum, manganese, nickel and copper are among the preferred metals. Zinc and copper are especially useful metals. In one embodiment, the lubricant compositions of the invention contain a zinc dihydrocarbyl dithiophosphate and a copper dihydrocarbyl dithiophosphate. Examples of metal compounds which may be reacted with the acid include lithium oxide, lithium hydroxide, sodium hydroxide, sodium carbonate, potassium hydroxide, potassium carbonate, silver oxide, magnesium oxide, magnesium hydroxide, calcium oxide, zinc hydroxide, strontium hydroxide, cadmium oxide, cadmium hydroxide, barium oxide, aluminum oxide, iron carbonate, copper hydroxide, lead hydroxide, tin butylate, cobalt hydroxide, nickel hydroxide, nickel carbonate, etc.

In some instances, the incorporation of certain ingredients such as small amounts of the metal acetate or acetic acid in conjunction with the metal reactant will facilitate the reaction and result in an improved product. For example, the use of up to about 5% of zinc acetate in combination with the required amount of zinc oxide facilitates the formation of a zinc phosphorodithioate.

In one preferred embodiment, the alkyl groups $R^1$ and $R^2$ are derived from secondary alcohols such as isopropyl alcohol, secondary butyl alcohol, 2-pentanol, 2-methyl-4-pentanol, 2-hexanol, 3-hexanol, etc.

Especially useful metal phosphorodithioates can be prepared from phosphorodithioic acids which in turn are prepared by the reaction of phosphorus pentasulfide with mixtures of alcohols. In addition, the use of such mixtures enables the utilization of cheaper alcohols which in themselves may not yield oil-soluble phosphorodithioic acids.

Useful mixtures of metal salts of dihydrocarbyl dithiophosphoric acid are obtained by reacting phosphorus pentasulfide with a mixture of (a) isopropyl or secondary butyl alcohol, and (b) an alcohol containing at least 5 carbon atoms wherein at least 10 mole percent, preferably 20 or 25 mole percent, of the alcohol in the mixture isopropyl alcohol, secondary butyl alcohol or a mixture thereof.

Thus a mixture of isopropyl and hexyl alcohols can be used to produce a very effective, oil-soluble metal phosphorodithioate. For the same reason mixtures of phosphorodithioic acids can be reacted with the metal compounds to form less expensive, oil-soluble salts.

The mixtures of alcohols may be mixtures of different primary alcohols, mixtures of different secondary alcohols or mixtures of primary and secondary alcohols. Examples of useful mixtures include: n-butanol and n-octanol; n-pentanol and 2-ethyl-1-hexanol; isobutanol and n-hexanol; isobutanol and isoamyl alcohol; isopropanol and 2-methyl-4-pentanol; isopropanol and sec-butyl alcohol; isopropanol and isooctyl alcohol; etc. Particularly useful alcohol mixtures are mixtures of secondary alcohols containing at least about 20 mole percent of isopropyl alcohol, and in a preferred embodiment, at least 40 mole percent of isopropyl alcohol.

The following examples illustrate the preparation of metal phosphorodithioates prepared from mixtures of alcohols.

EXAMPLE D-1

A phosphorodithioic acid is prepared by reacting a mixture of alcohols comprising 6 moles of 4-methyl-2-pentanol and 4 moles of isopropyl alcohol with phosphorus pentasulfide. The phosphorodithioic acid then is reacted with an oil slurry of zinc oxide. The amount of zinc oxide in the slurry is about 1.08 times the theoretical amount required to completely neutralize the phosphorodithioic acid. The oil solution of the zinc phosphorodithioate obtained in this manner (10% oil) contains 9.5% phosphorus, 20.0% sulfur and 10.5% zinc.

EXAMPLE D-2

A phosphorodithioic acid is prepared by reacting finely powdered phosphorus pentasulfide with an alcohol mixture containing 11.53 moles (692 parts by weight) of isopropyl alcohol and 7.69 moles (1000 parts by weight) of isooctanol. The phosphorodithioic acid obtained in this manner has an acid number of about 178–186 and contains 10.0% phosphorus and 21.0% sulfur. This phosphorodithioic acid is then reacted with an oil slurry of zinc oxide. The quantity of zinc oxide included in the oil slurry is 1.10 times the theoretical equivalent of the acid number of the phosphorodithioic acid. The oil solution of the zinc salt prepared in this manner contains 12% oil, 8.6% phosphorus, 18.5% sulfur and 9.5% zinc.

EXAMPLE D-3

A phosphorodithioic acid is prepared by reacting a mixture of 1560 parts (12 moles) of isooctyl alcohol and 180 parts (3 moles) of isopropyl alcohol with 756 parts (3.4 moles) of phosphorus pentasulfide. The reaction is conducted by heating the alcohol mixture to about 55° C. and thereafter adding the phosphorus pentasulfide over a period of 1.5 hours while maintaining the reaction temperature at about 60°–75° C. After all of the phosphorus pentasulfide is added, the mixture is heated and stirred for an additional hour at 70°–75 C., and thereafter filtered through a filter aid.

Zinc oxide (282 parts, 6.87 moles) is charged to a reactor with 278 parts of mineral oil. The above-prepared phosphorodithioic acid (2305 parts, 6.28 moles) is charged to the zinc oxide slurry over a period of 30 minutes with an exotherm to 60° C. The mixture then is heated to 80° C. and maintained at this temperature for 3 hours. After stripping to 100° C. and 6 mm.Hg., the mixture is filtered twice through a filter aid, and the filtrate is the desired oil solution of the zinc salt containing 10% oil, 7.97% zinc (theory 7.40); 7.21% phosphorus (theory 7.06); and 15.64% sulfur (theory 14.57).

EXAMPLE D-4

Isopropyl alcohol (396 parts, 6.6 moles) and 1287 parts (9.9 moles) of isooctyl alcohol are charged to a reactor and heated with stirring to 59° C. Phosphorus pentasulfide (833 parts, 3.75 moles) is then added under a nitrogen sweep. The addition of the phosphorus pentasulfide is completed in about 2 hours at a reaction temperature between 59°–63° C. The mixture then is stirred at 45°–63° C. for about 1.45 hours and filtered. The filtrate is the desired phosphorodithioic acid.

A reactor is charged with 312 parts (7.7 equivalents) of zinc oxide and 580 parts of mineral oil. While stirring at room temperature, the above-prepared phosphorodithioic acid (2287 parts, 6.97 equivalents) is added over a period of about 1.26 hours with an exotherm to 54° C. The mixture is heated to 78° C. and maintained at 78°–85° C. for 3 hours. The reaction mixture is vacuum stripped to 100° C. at 19 mm.Hg. The residue is filtered through a filter aid, and the filtrate is an oil solution (19.2% oil) of the desired zinc salt containing 7.86% zinc, 7.76% phosphorus and 14.8% sulfur.

EXAMPLE D-5

The general procedure of Example D-4 is repeated except that the mole ratio of isopropyl alcohol to isooctyl alcohol is 1:1. The product obtained in this manner is an oil solution (10% oil) of the zinc phosphorodithioate containing 8.96% zinc, 8.49% phosphorus and 18.05% sulfur.

EXAMPLE D-6

A phosphorodithioic acid is prepared in accordance with the general procedure of Example D-4 utilizing an alcohol mixture containing 520 parts (4 moles) of isooctyl alcohol and 360 parts (6 moles) of isopropyl alcohol with 504 parts (2.27 moles) of phosphorus pentasulfide. The zinc salt is prepared by reacting an oil slurry of 116.3 parts of mineral oil and 141.5 parts (3.44 moles) of zinc oxide with 950.8 parts (3.20 moles) of the above-prepared phosphorodithioic acid. The product prepared in this manner is an oil solution (10% mineral oil) of the desired zinc salt, and the oil solution contains 9.36% zinc, 8.81% phosphorus and 18.65% sulfur.

EXAMPLE D-7

A mixture of 520 parts (4 moles) of isooctyl alcohol and 559.8 parts (9.33 moles) of isopropyl alcohol is prepared and heated to 60° C. at which time 672.5 parts (3.03 moles) of phosphorus pentasulfide are added in portions while stirring. The reaction then is maintained at 60°–65° C. for about one hour and filtered. The filtrate is the desired phosphorodithioic acid.

An oil slurry of 188.6 parts (4 moles) of zinc oxide and 144.2 parts of mineral oil is prepared, and 1145 parts of the above-prepared phosphorodithioic acid are added in portions while maintaining the mixture at about 70° C. After all of the acid is charged, the mixture is heated at 80° C. for 3 hours. The reaction mixture then is stripped of water to 110° C. The residue is filtered through a filter aid, and the filtrate is an oil solution (10% mineral oil) of the desired product containing 9.99% zinc, 19.55% sulfur and 9.33% phosphorus.

EXAMPLE D-8

A phosphorodithioic acid is prepared by the general procedure of Example D-4 utilizing 260 parts (2 moles) of isooctyl alcohol, 480 parts (8 moles) of isopropyl alcohol, and 504 parts (2.27 moles) of phosphorus pentasulfide. The phosphorodithioic acid (1094 parts, 3.84 moles) is added to an oil slurry containing 181 parts (4.41 moles) of zinc oxide and 135 parts of mineral oil over a period of 30 minutes. The mixture is heated to 80° C. and maintained at this temperature for 3 hours. After stripping to 100° C. and 19 mm.Hg., the mixture is filtered twice through a filter aid, and the filtrate is an oil solution (10% mineral oil) of the zinc salt containing 10.06% zinc, 9.04% phosphorus, and 19.2% sulfur.

Additional specific examples of metal phosphorodithioates useful as component (D) in the lubricating oils of the present invention are listed in the following table. Examples D-9 to D-14 are prepared from single alcohols, and Examples D-15 to D-19 are prepared from alcohol mixtures following the general procedure of Example D-1.

TABLE

Component D: Metal Phosphorodithioates

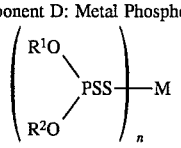

(XV)

| Example | $R^1$ | $R^2$ | M | n |
|---|---|---|---|---|
| D-9 | n-nonyl | n-nonyl | Ba | 2 |
| D-10 | cyclohexyl | cyclohexyl | Zn | 2 |
| D-11 | isobutyl | isobutyl | Zn | 2 |
| D-12 | hexyl | hexyl | Ca | 2 |
| D-13 | n-decyl | n-decyl | Zn | 2 |
| D-14 | 4-methyl-2-pentyl | 4-methyl-2-pentyl | Cu | 2 |
| D-15 | (n-butyl + dodecyl) (1:1)w | | Zn | 2 |
| D-16 | (isopropyl + isooctyl) (1:1)w | | Ba | 2 |
| D-17 | (isopropyl + 4-methyl-2 pentyl) (40:60)m | | Cu | 2 |
| D-18 | (isobutyl + isoamyl) (65:35)m | | Zn | 2 |
| D-19 | (isopropyl+ sec-butyl) (40:60)m | | Zn | 2 |

Another class of the phosphorodithioate additives contemplated for use in the lubricating composition of this invention comprises the adducts of the metal phosphorodithioates described above with an epoxide. The metal phosphorodithioates useful in preparing such adducts are for the most part the zinc phosphorodithioates. The epoxides may be alkylene oxides or arylalkylene oxides. The arylalkylene oxides are exemplified by styrene oxide, p-ethylstyrene oxide, alpha-methylstyrene oxide, 3-beta-naphthyl-1, 1,3-butylene oxide, m-dodecylstyrene oxide, and p-chlorostyrene oxide. The alkylene oxides include principally the lower alkylene oxides in which the alkylene radical contains 8 or less carbon atoms. Examples of such lower alkylene oxides are ethylene oxide, propylene oxide, 1,2-butene oxide, trimethylene oxide, tetramethylene oxide, butadiene monoepoxide, 1,2-hexene oxide, and epichlorohydrin. Other epoxides useful herein include, for example, butyl 9,10-epoxy stearate, epoxidized soya bean oil, epoxidized tung oil, and epoxidized copolymer of styrene with butadiene.

The adduct may be obtained by simply mixing the metal phosphorodithioate and the epoxide. The reaction is usually exothermic and may be carried out within wide temperature limits from about 0° C. to about 300° C. Because the reaction is exothermic, it is best carried out by adding one reactant, usually the epoxide, in small increments to the other reactant in order to obtain convenient control of the temperature of the reaction. The reaction may be carried out in a solvent such as benzene, mineral oil, naphtha, or n-hexene.

The chemical structure of the adduct is not known. For the purpose of this invention adducts obtained by the reaction of one mole of the phosphorodithioate with from about 0.25 mole to 5 moles, usually up to about 0.75 mole or about 0.5 mole of a lower alkylene oxide, particularly ethylene oxide and propylene oxide, have been found to be especially useful and therefore are preferred.

The preparation of such adducts is more specifically illustrated by the following example.

EXAMPLE D-20

A reactor is charged with 2365 parts (3.33 moles) of the zinc phosphorodithioate prepared in Example D-2, and while stirring at room temperature, 38.6 parts (0.67 mole) of propylene oxide are added with an exotherm of from 24°–31° C. The mixture is maintained at 80°–90° C. for 3 hours and then vacuum stripped to 101° C. at 7 mm. Hg. The residue is filtered using a filter aid, and the filtrate is an oil solution (11.8% oil) of the desired salt containing 17.1% sulfur, 8.17% zinc and 7.44% phosphorus.

In one embodiment, the metal dihydrocarbyl dithiophosphates which are utilized as component (D) in the lubricating oil compositions of the present invention will be characterized as having at least one of the hydrocarbyl groups ($R^1$ or $R^2$) attached to the oxygen atoms through a secondary carbon atom. In one preferred embodiment, both of the hydrocarbyl groups $R^1$ and $R^2$ are attached to the oxygen atoms of the dithiophosphate through secondary carbon atoms. In a further embodiment, the dihydrocarbyl dithiophosphoric acids used in the preparation of the metal salts are obtained by reacting phosphorus pentasulfide with a mixture of aliphatic alcohols wherein at least 20 mole percent of the mixture is isopropyl alcohol. More generally, such mixtures will contain at; least 40 mole percent of isopropyl alcohol. The other alcohols in the mixtures may be either primary or secondary alcohols. In some applications, such as in passenger car crankcase oils, metals phosphorodithioates derived from a mixture of isopropyl and another secondary alcohol (e.g., 2-methyl-4-pentanol) appear to provide improved results. For oils designed for use in both compression and spark-ignited engines, improved results are obtained when the phosphorodithioic acid is prepared from a mixture of isopropyl alcohol and a primary alcohol such as isooctyl alcohol.

Another class of the phosphorodithioate additives (D) contemplated as useful in the lubricating compositions of the invention comprises mixed metal salts of (a) at least one phosphorodithioic acid as defined and exemplified above, and (b) at least one aliphatic or alicyclic carboxylic acid. The carboxylic acid may be a monocarboxylic or polycarboxylic acid, usually containing from 1 to about 3 carboxy groups and preferably only 1. It may contain from about 2 to about 40, preferably from about 2 to about 20 carbon atoms, and advantageously about 5 to about 20 carbon atoms. The preferred carboxylic acids are those having the formula $R^3COOH$, wherein $R^3$ is an aliphatic or alicyclic hydrocarbon-based radical preferably free from acetylenic unsaturation. Suitable acids include the butanoic, pentanoic, hexanoic, octanoic, nonanoic, decanoic, dodecanoic, octadecanoic and eicosanoic acids, as well as olefinic acids such as oleic, linoleic, and linolenic acids and linoleic acid dimer. For the most part, $R^3$ is a saturated aliphatic group and especially a branched alkyl group such as the isopropyl or 3-heptyl group. Illustrative polycarboxylic acids are succinic, alkyl and alkenylsuccinic, adipic, sebacic and citric acids.

The mixed metal salts may be prepared by merely blending a metal salt of a phosphorodithioic acid with a metal salt of a carboxylic acid in the desired ratio. The ratio of equivalents of phosphorodithioic to carboxylic acid salts is between about 0.5:1 to about 400:1. Preferably, the ratio is between about 0.5:1 and about 200:1. Advantageously, the ratio can be from about 0.5:1 to about 100:1, preferably from about 0.5:1 to about 50:1, and more preferably from about 0.5:1 to about 20:1. Further, the ratio can be from about 0.5:1 to about 4.5:1, preferably about 2.5:1 to about 4.25:1. For this purpose, the equivalent weight of a phosphorodithioic acid is its molecular weight divided by the number of —PSSH groups therein, and that of a carboxylic acid is its molecular weight divided by the number of carboxy groups therein.

A second and preferred method for preparing the mixed metal salts useful in this invention is to prepare a mixture of the acids in the desired ratio and to react the acid mixture with a suitable metal base. When this method of preparation is used, it is frequently possible to prepare a salt containing an excess of metal with respect to the number of equivalents of acid present; thus, mixed metal salts containing as many as 2 equivalents and especially up to about 1.5 equivalents of metal per equivalent of acid may be prepared. The equivalent of a metal for this purpose is its atomic weight divided by its valence.

Variants of the above-described methods may also be used to prepare the mixed metal salts useful in this invention. For example, a metal salt of either acid may be blended with an acid of the other, and the resulting blend reacted with additional metal base.

Suitable metal bases for the preparation of the mixed metal salts include the free metals previously enumerated and their oxides, hydroxides, alkoxides and basic salts. Examples are sodium hydroxide, potassium hydroxide, magnesium oxide, calcium hydroxide, zinc oxide, lead oxide, nickel oxide and the like.

The temperature at which the mixed metal salts are prepared is generally between about 30° C. and about 150° C., preferably up to about 125 ° C. If the mixed salts are prepared by neutralization of a mixture of acids with a metal base, it is preferred to employ temperatures above about 50° C. and especially above about 75° C. It is frequently advantageous to conduct the reaction in the presence of a substantially inert, normally liquid organic diluent such as naphtha, benzene, xylene, mineral oil or the like. If the diluent is mineral oil or is physically and chemically similar to mineral oil, it frequently need not be removed before using the mixed metal salt as an additive for lubricants or functional fluids.

U.S. Pat. Nos. 4,308,154 and 4,417,970 describe procedures for preparing these mixed metal salts and disclose a number of examples of such mixed salts. Such disclosures of these patents are hereby incorporated by reference.

The preparation of the mixed salts is illustrated by the following example.

EXAMPLE D-21

A mixture of 67 pans (1.63 equivalents) of zinc oxide and 48 parts of mineral oil is stirred at room temperature and a mixture of 401 parts (1 equivalent) of di-(2-ethylhexyl) phosphorodithioic acid and 36 parts (0.25 equivalent) of 2-ethylhexanoic acid is added over 10 minutes. The temperature increases to 40° C. during the addition. When addition is complete, the temperature is increased to 80° C. for 3 hours. The mixture is then vacuum stripped at 100° C. to yield the desired mixed metal salt as a 91% solution in mineral oil.

(E) Antioxidant

The lubricating oil compositions of the present invention also may include an antioxidant (E), with the proviso that (E) the antioxidant and (D) the metal dithiophosphate are not the same. For instance, (D) and (E) may both be metal dithiophosphates provided that the metal of (D) is not the same as the metal of (E). In one embodiment, the antioxidants are selected from the group consisting of: sulfur-containing compositions, alkylated aromatic amines, phenols, and oil-soluble transition metal containing compounds. When present, the lubricating oil compositions may contain from about 0.01 to about 2% or even 5% of at least one antioxidant.

The antioxidant may be one or more sulfur-containing compositions. Materials which may be sulfurized to form the sulfurized organic compositions of the present invention include oils, fatty acids or esters, olefins or polyolefins made thereof or Diels-Alder adducts.

Oils which may be sulfurized are natural or synthetic oils including mineral oils, lard oil, carboxylic acid esters derived from aliphatic alcohols and fatty acids or aliphatic carboxylic acids (e.g., myristyl oleate and oleyl oleate) sperm whale oil, synthetic sperm whale oil substitutes and synthetic unsaturated esters or glycerides.

Fatty acids generally contain from about 8 to about 30 carbon atoms. The unsaturated fatty acids generally contained in the naturally occurring vegetable or animal fats and such acids include palmitoleic acid, oleic acid, linoleic acid, linolenic acid, and erucic acid. The fatty acids may comprise mixtures of acids, such as those obtained from naturally occurring animal and vegetable oils, including beef tallow, depot fat, lard oil, tall oil, peanut oil, corn oil, safflower oil, sesame oil, poppy-seed oil, soybean oil, cottonseed oil, sunflower seed oil, or wheat germ oil. Tall oil is a mixture of rosin acids, mainly abietic acid, and unsaturated fatty acids, mainly oleic and linoleic acids. Tall oil is a by-product of the sulfate process for the manufacture of wood pulp.

The fatty acid esters also may be prepared from aliphatic olefinic acids of the type described above by reaction with any of the above-described alcohols and polyols. Examples of aliphatic alcohols include monohydric alcohols such as methanol, ethanol; n- or isopropanol; n-, iso-, sec-, or tertbutanol, etc.; and polyhydric alcohols including ethylene glycol, propylene glycol, trimethylene glycol, neopentyl glycol, glycerol, etc.

The olefinic compounds which may be sulfurized are diverse in nature. They contain at least one olefinic double bond, which is defined as a non-aromatic double bond; that is, one connecting two aliphatic carbon atoms. In its broadest sense, the olefin may be defined by the formula $R^{*1}R^{*2}C{=}CR^{*3}{-}R^{*4}$, wherein each of $R^{*1}$, $R^{*2}$, $R^{*3}$ and $R^{*4}$ is hydrogen or an organic group. In general, the R groups in the above formula which are not hydrogen may be satisfied by such groups as $-C(R^{*5})_3-COOR^{*5}$, $-CON(R^{*5})_2$, $-COON(R^{*5})_4$, —COOM, —CN, —X, $-YR^{*5}$ or —Ar, wherein:

each $R^{*5}$ is independently hydrogen, alkyl, alkenyl, aryl, substituted alkyl, substituted alkenyl or substituted aryl, with the proviso that any two $R^{*5}$ groups can be alkylene or substituted alkylene whereby a ring of up to about 12 carbon atoms is formed;

M is one equivalent of a metal cation (preferably Group I or II, e.g., sodium, potassium, barium, calcium);

X is halogen (e.g., chloro, bromo, or iodo);

Y is oxygen or divalent sulfur;

Ar is an aryl or substituted aryl group of up to about 12 carbon atoms.

Any two of $R^{*1}$, $R^{*2}$, $R^{*3}$ and $R^{*4}$ may also together form an alkylene or substituted alkylene group; i.e., the olefinic compound may be alicyclic. The olefinic compound is usually one in which each R group which is not hydrogen is independently alkyl, alkenyl or aryl group. Monoolefinic and diolefinic compounds, particularly the former, are preferred, and especially terminal monoolefinic hydrocarbons; that is, those compounds in which $R^{*3}$ and $R^{*4}$ are hydrogen and $R^{*1}$ and $R^{*2}$ are alkyl or aryl, especially alkyl (that is, the olefin is aliphatic) having 1 to about 30, preferably 1 to about 16, more preferably 1 to about 8, and more preferably 1 to about 4 carbon atoms. Olefinic compounds having about 3 to 30 and especially about 3 to 16 (most often less than 9) carbon atoms are particularly desirable.

Isobutene, propylene and their dimers, trimers and tetramers, and mixtures thereof are especially preferred olefinic compounds. Of these compounds, isobutylene and diisobutylene are particularly desirable because of their availability and the particularly high sulfur containing compositions which can be prepared therefrom.

In another embodiment, the sulfurized organic compound is a sulfurized terpene compound. The term "terpene compound" as used in the specification and claims is intended to include the various isomeric terpene hydrocarbons having the empirical formula $C_{10}H_{16}$, such as contained in turpentine, pine oil and dipentenes, and the various synthetic and naturally occurring oxygen-containing derivatives. Mixtures of these various compounds generally will be utilized, especially when natural products such as pine oil and turpentine are used. Pine oil, for example, comprises a mixture of alpha-terpineol, beta-terpineol, alpha-fenchol, camphor, borneol/isoborneol, fenchone, estragole, dihydro alpha-terpineol, anethole, and other mono-terpene hydrocarbons. The specific ratios and amounts of the various components in a given pine oil will depend upon the particular source and the degree of purification. A group of pine oil-derived products is available commercially from Hercules Incorporated. It has been found that the pine oil products generally known as terpene alcohols available from Hercules Incorporated are particularly useful in the preparation of the sulfurized products of the invention. Pine oil products are available from Hercules under such designations as alpha-Terpineol, Terpineol 318 Prime, Yarmor 302, Herco pine oil, Yarmor 302W, Yarmor F and Yarmor 60.

In another embodiment, the sulfurized organic composition is at least one sulfur-containing material which comprises the reaction product of a sulfur source and at least one Diels-Alder adduct. Generally, the molar ratio of sulfur source to Diels-Alder adduct is in a range of from about 0.75 to about 4.0, preferably about 1 to about 2.5, more preferably about 1 to about 1.8. In one embodiment the molar ratio of sulfur to adduct is from about 0.8:1 to 1.2:1.

The Diels-Alder adducts are a well-known, art-recognized class of compounds prepared by the diene synthesis or Diels-Alder reaction. A summary of the prior art relating to this class of compounds is found in the Russian monograph, *Dienovyi Sintes,* Izdatelstwo Akademii Nauk SSSR, 1963 by A. S. Onischenko. (Translated into the English language by L. Mandel as A. S. Onischenko, *Diene Synthesis,* N.Y., Daniel Davey and Co., Inc., 1964.) This monograph and references cited therein are incorporated by reference into the present specification.

Basically, the diene synthesis (Diels-Alder reaction) involves the reaction of at least one conjugated diene with at least one ethylenically or acetylenically unsaturated compound, these latter compounds being known as dienophiles. Piperylene, isoprene, methylisoprene, chloroprene, and 1,3-butadiene are among the preferred dienes for use in preparing the Diels-Alder adducts. Examples of cyclic dienes are the cyclopentadienes, fulvenes, 1,3-cyclohexadienes, 1,3-cycloheptadienes, 1,3,5-cycloheptatrienes, cyclooctatetraene, and 1,3,5-cyclononatrienes.

A preferred class of dienophiles are those having at least one electron-accepting groups selected from groups such as formyl, cyano, nitro, carboxy, carbohydrocarbyloxy, etc. Usually the hydrocarbyl and substituted hydrocarbyl groups, if not present, will not contain more than 10 carbon atoms each.

One preferred class of dienophiles are those wherein at least one carboxylic ester group represented by —C(O)O—$R_o$ where $R_o$ is the residue of a saturated aliphatic alcohol of up to about 40 carbon atoms, the aliphatic alcohol from which —$R_o$ is derived can be any of the above-described mono or polyhydric alcohols. Preferably the alcohol is a lower aliphatic alcohol, more preferably methanol, ethanol, propanol, or butanol.

In addition to the ethylenically unsaturated dienophiles, there are many useful acetylenically unsaturated dienophiles such as propiolaldehyde, methyl-ethynylketone, propylethynylketone, propenylethynylketone, propiolic acid, propiolic acid nitrile, ethyl-propiolate, tetrolic acid, propargylaldehyde, acetylene-dicarboxylic acid, the dimethyl ester of acetylenedicarboxylic acid, dibenzoylacetylene, and the like.

Normally, the adducts involve the reaction of equimolar amounts of diene and dienophile. However, if the dienophile has more than one ethylenic linkage, it is possible for additional diene to react if present in the reaction mixture.

It is frequently advantageous to incorporate materials useful as sulfurization promoters in the reaction mixture. These materials may be acidic, basic or neutral. Useful neutral and acidic materials include acidified clays such as "Super Filtrol" (sulfuric acid treated diatomaceous earth), p-toluenesulfonic acid, phosphorus-containing reagents such as phosphorus acids (e.g., dialkyl-phosphorodithioic acids, phosphorus acid esters (e.g., triphenyl phosphate), phosphorus sulfides such as phosphorus pentasulfide and surface active agents such as lecithin.

The preferred promoters are basic materials. These may be inorganic oxides and salts such as sodium hydroxide, calcium oxide and sodium sulfide. The most desirable basic promoters, however, are nitrogen bases including ammonia and amines.

The amount of promoter material used is generally about 0.0005–2.0% of the combined weight of the terpene and olefinic compounds. In the case of the preferred ammonia and amine catalysts, about 0.0005–0.5 mole per mole of the combined weight is preferred, and about 0.001–0.1 is especially desirable.

Water is sometimes present in the reaction mixture either as a promoter or as a diluent for one or more of the promoters recited hereinabove. The amount of water, when present, is usually about 1–25% by weight of the olefinic compound. The presence of water is, however, not essential and when certain types of reaction equipment are used it may be advantageous to conduct the reaction under substantially anhydrous conditions.

When promoters are incorporated into the reaction mixture as described hereinabove, it is generally observed that the reaction can be conducted at lower temperatures, and the product generally is lighter in color.

The sulfur source or reagent used for preparing any of the sulfur-containing materials of this invention may be, for example, sulfur, a sulfur halide such as sulfur monochloride or sulfur dichloride, a mixture of hydrogen sulfide and sulfur or sulfur dioxide, or the like. Sulfur, or mixtures of sulfur and hydrogen sulfide often are preferred. However, it will be understood that other sulfurization reagents may, when appropriate, be substituted therefor. Commercial sources of all the sulfurizing reagents are normally used for the purpose of this invention, and impurities normally associated with these commercial products may be present without adverse results.

When the sulfurization reaction is effected by the use of sulfur alone, the reaction is effected by merely heating the reagents with the sulfur at temperatures of from about 50° to 250° C., usually, from about 150° to about 210° C. The weight ratio of the materials to be sulfurized to sulfur is between about 5:1 and about 15:1, generally between about 5:1 and about 10:1. The sulfurization reaction is conducted with efficient agitation and generally in an inert atmosphere (e.g., nitrogen). If any of the components or reagents are appreciably volatile at the reaction temperature, the reaction vessel may be sealed and maintained under pressure. It is frequently advantageous to add the sulfur portionwise to the mixture of the other components.

When mixtures of sulfur and hydrogen sulfide are utilized in the process of the invention, the amounts of sulfur and hydrogen sulfide per mole of component(s) to be sulfurized are, respectively, usually about 0.3 to about 3 gram-atoms and about 0.1 to about 1.5 moles. A preferred range is from about 0.5 to about 2.0 gram-atoms and about 0.4 to about 1.25 moles, respectively, and the most desirable ranges are about 0.8 to about 1.8 gram-atoms, and about 0.4 to about 0.8 mole, respectively. In reaction mixture operations, the components are introduced at levels to provide these ranges. In semi-continuous operations, they may be admixed at any ratio, but on a mass balance basis, they are present so as to be consumed in amounts within these ratios. Thus, for example, if the reaction vessel is initially charged with sulfur alone, the terpene and/or olefinic compound and hydrogen sulfide are added incrementally at a rate such that the desired ratio is obtained.

When mixtures of sulfur and hydrogen sulfide are utilized in the sulfurization reaction, the temperature range of the sulfurization reaction is generally from about 50° to about 350° C. The preferred range is about 100° to about 200° C. with about 120° to about 180° C. being especially suitable. The reaction often is conducted under super atmospheric pressure which may be and usually is autogenous pressure (i.e., pressure which naturally developed during the course of the reaction), but may also be externally applied pressure. The exact pressure developed during the reaction is dependent upon such factors as design and operation of the system, the reaction temperature, and the vapor pressure of the reactants and products, and it may vary during the course of the reaction.

While it is preferred generally that the reaction mixture consists entirely of the components and reagents described above, the reaction also may be effected in the presence of an inert solvent (e.g., an alcohol, ether, ester, aliphatic hydrocarbon, halogenated aromatic hydrocarbon, etc.) which is liquid within the temperature range employed. When the reaction temperature is relatively high, for example, at about 200° C., there may be some evolution of sulfur from the product which is avoided if a lower reaction temperature such as from about 150°–170° C. is used. In some instances, it may be desirable to treat the sulfurized product obtained in accordance with the procedures described herein to reduce active sulfur. The term "active sulfur" includes sulfur in a form which can cause staining of copper and similar materials, and standard tests are available to determine sulfur activity. As an alternative to the treatment to reduce active sulfur, metal deactivators can be used with the lubricants containing sulfurized compositions.

The following examples relate to sulfurized compositions useful in the present invention.

EXAMPLE E-1

A reaction vessel is charged with 780 parts isopropyl alcohol, 752 parts water, 35 parts of a 50% by weight aqueous solution of sodium hydroxide, 60 parts of sulfuric acid treated diatomaceous earth (Super Filtrol available from Engelhard Corporation, Menlo Park, N.J.) and 239 parts of sodium sulfide. The mixture is stirred and heated to 77°–80° C. The reaction temperature is maintained for two hours. The mixture is cooled to 71 ° C. whereupon 1000 parts of the sulfurized olefin prepared by reacting 337 parts of sulfur monochloride with 1000 parts of a mixture of 733 parts of 1-dodecene and 1000 parts of Neodene 1618, a $C_{16-18}$ olefin mixture available from Shell Chemical, are added to the mixture. The reaction mixture is heated to 77°–80° C. and the temperature is maintained until the chlorine content is a maximum of 0.5. The reaction mixture is vacuum stripped to 80° C. and 20 millimeters of mercury. The residue is filtered through diatomaceous earth. The filtrate has 19.0% sulfur and a specific gravity of 0.95.

EXAMPLE E-2

A mixture of 100 parts of soybean oil and 50 parts of commercial $C_{16}$ a-olefins is heated to 175° C. under nitrogen and 17.4 parts of sulfur are added gradually, whereupon an exothermic reaction causes the temperature to rise to 205° C. The mixture is heated at 188°–200° C. for 5 hours, allowed to cool gradually to 90° C. and filtered to yield the desired product containing 10.13% sulfur.

EXAMPLE E-3

A mixture of 100 parts of soybean oil, 3.7 parts of tall oil acid and 46.3 parts of commercial $C_{15-18}$ α-olefins is heated to 165° C. under nitrogen and 17.4 parts of sulfur are added. The temperature of the mixture rises to 191 ° C. It is maintained at 165°–200° C. for 7 hours and is then cooled to 90° C. and filtered. The product contains 10.13% sulfur.

EXAMPLE E-4

A mixture of 93 parts (0.5 equivalent) of pine oil and 48 parts (1.5 equivalents) of sulfur is charged to a reaction vessel equipped with condenser, thermometer and stirrer. The mixture is heated to about 140° C. with nitrogen blowing and maintained at this temperature for about 28 hours. After cooling, 111 parts of a $C_{16}$ alpha-olefin (available from Gulf Oil Chemicals Company under the general trade name Gulftene 16) are added through an addition funnel, and after addition is complete, the addition funnel is replaced with a nitrogen tube. The reaction mixture is heated to 170° C. with nitrogen blowing and maintained at the temperature for about 5 hours. The mixture is cooled and filtered through a filter aid. The filtrate is the desired product having a sulfur content of 19.01% (theory 19.04%).

EXAMPLE E-5

(a) A mixture comprising 400 grams of toluene and 66.7 grams of aluminum chloride is charged to a two- liter flask fitted with a stirrer, nitrogen inlet tube, and a solid carbon dioxide-cooled reflux condenser. A second mixture comprising 640 grams (5 moles) of butylacrylate and 240.8 grams of toluene is added to the $AlCl_3$ slurry over a 0.25-hour period while maintaining the temperature within the range of 37°–58° C. Thereafter, 313 grams (5.8 moles) of butadiene are added to the slurry over a 2.75-hour period while maintaining the temperature of the reaction mass at 60°–61° C. by means of external cooling. The reaction mass is blown with nitrogen for about 0.33-hour and then transferred to a four-liter separatory funnel and washed with a solution of 150 grams of concentrated hydrochloric acid in 1100 grams of water. Thereafter, the product is subjected to two additional water washings using 1000 ml of water for each wash. The washed reaction product is subsequently distilled to remove unreacted butylacrylate and toluene. The residue of this first distillation step is subjected to further distillation at a pressure of 9–10 millimeters of mercury whereupon 785 grams of the desired adduct are collected over the temperature of 105°–115° C.

(b) The above-prepared butadiene-butylacrylate Diels-Alder adduct (4550 grams, 25 moles) and 1600 grams (50 moles) of sulfur flowers are charged to a 12 liter flask, fitted with stirrer, reflux condenser, and nitrogen inlet tube. The reaction mixture is heated at a temperature within the range of 150°–155° C. for 7 hours while passing nitrogen therethrough at a rate of about 0.5 cubic feet per hour. After heating, the mass is permitted to cool to room temperature and filtered, the sulfur-containing product being the filtrate.

The antioxidant (E) may also be an alkylated aromatic amine. Alkylated aromatic amines include compounds represented by the formula

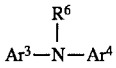

wherein $Ar^3$ and $Ar^4$ are independently mononuclear or polynuclear, substituted or unsubstituted aromatic groups; and $R^6$ is hydrogen, halogen, OH, $NH_2$, SH, $NO_2$ or a hydrocarbyl group of from 1 to about 50 carbon atoms. $Ar^3$ and $Ar^4$ may be any of the above-described aromatic groups. When $Ar^3$ and/or $Ar^4$ are substituted aromatic groups, the number of substituents on $Ar^3$ and/or $Ar^4$ range independently up to the number of positions available on $Ar^3$ and/or $Ar^4$ for substitution. These substituents are independently selected from the group consisting of halogen (e.g., chlorine, bromine, etc.), OH, $NH_2$, SH, $NO_2$ or hydrocarbyl groups of from 1 to about 50 carbon atoms.

In a preferred embodiment, antioxidant (E) is represented by the formula

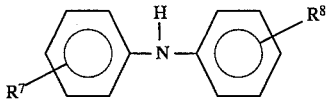

(XVI)

wherein $R^7$ and $R^8$ are independently hydrogen or hydrocarbyl groups of from 1 to about 50 carbon atoms, preferably hydrocarbyl groups of from about 4 to about 20 carbon atoms. Examples of aromatic amines include p,p'-dioctyldiphenylamine; octylphenyl-beta-naphthylamine;octylphenyl-alpha-naphthylamine, phenyl-alpha-naphthylamine; phenyl-beta-naphthylamine; p-octylphenyl-alphanaphthylamine and 4-octylphenyl-1-octyl-beta-naphthylamine and di(nonylphenyl)amine, with di(nonylphenyl)amine preferred.

U.S. Pat. Nos. 2,558,285; 3,601,632; 3,368,975; and 3,505,225 disclose diarylamines within the scope of component (E). These patents are incorporated herein by reference.

The antioxidants (E) used in the present invention may be one or more of several types of phenolic compounds which may be metal-free phenolic compounds.

In one embodiment, the antioxidant of the present invention includes at least one metal-free hindered phenol. Alkylene coupled derivatives of said hindered phenols also can be used. Hindered phenols are defined (in the specification and claims) as those containing a sterically hindered hydroxyl group, and these include those derivatives of dihydroxy aryl compounds wherein the hydroxyl groups are in the o- or p-position to each other.

The metal-free hindered phenols may be represented by the following Formulae XVII, XVIII and XIX.

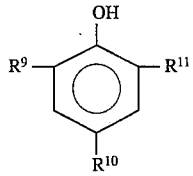

(XVII)

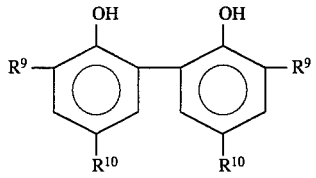

(XVIII)

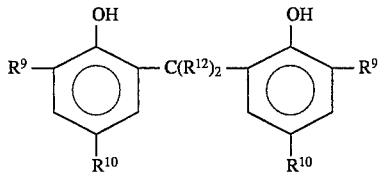

(XIX)

wherein each $R^9$ is independently an alkyl group containing from 3 to about 9 carbon atoms, each $R^{10}$ is hydrogen or an alkyl group, $R^{11}$ is hydrogen or an alkyl group containing from 1 to about 9 carbon atoms, and each $R^{12}$ is independently hydrogen or a methyl group. In the preferred embodiment, $R^{10}$ is an alkyl group containing from about 3 to about 50 carbon atoms, preferably about 6 to about 20, more preferably from about 6 to about 12. Examples of such groups include hexyl, heptyl, octyl, decyl, dodecyl, tripropenyl, tetrapropenyl, etc. Examples of $R^9$, $R^{10}$ and $R^{11}$ groups include propyl, isopropyl, butyl, secondary butyl, tertiary butyl, heptyl, octyl, and nonyl. Preferably, each $R^9$ and $R^{11}$ are tertiary groups such as tertiary butyl, tertiary amyl, etc. The phenolic compounds of the type represented by Formula XVII may be prepared by various techniques, and in one embodiment, such phenols are prepared in stepwise manner by first preparing the para-substituted alkyl phenol, and thereafter alkylating the para-substituted phenol in the 2- and/or 6-position as desired. When it is desired to prepare coupled phenols of the type represented by Formulae XVIII and XIX, the second step alkylation is conducted under conditions which result in the alkylation of only one of the positions ortho to the hydroxyl group.

Examples of useful phenolic materials of the type represented by Formula XVII include: 2-t-butyl-4-heptyl phenol; 2-t-butyl-4-octyl phenol; 2-t-butyl- 4-dodecyl phenol; 2,6-di-t-butyl-4-butylphenol; 2,6-di-t-butyl-4-heptyl phenol; 2,6-di-t-butyl-4-dodecyl phenol; 2-methyl-6-di-t-butyl-4-heptyl phenol; 2,4-dimethyl-6-t-butyl phenol; 2,6-t-butyl-4-ethyl phenol; 4-t-butyl catechol; 2,4di-t-butyl-p-cresol; 2,6-di-t-butyl-4-methyl phenol; and 2-methyl- 6-di-t-butyl-4-dodecyl phenol.

Examples of the ortho coupled phenols of the type represented by Formula XVIII include: 2,2'-bis(6-t-butyl-4-heptyl phenol); 2,2'-bis(6-t-butyl- 4-octyl phenol); 2,6-bis (1-methylcyclohexyl)-4-methyl phenol; and 2,2'-bis( 6-t-butyl-4-dodecyl phenol).

Alkylene-coupled phenolic compounds of the type represented by Formula XIX can be prepared from the phenols represented by Formula XV wherein R1 1 is hydrogen by reaction of the phenolic compound with an aldehyde such as formaldehyde, acetaldehyde, etc. or a ketone such as acetone. Procedures for coupling of phenolic compounds with aldehydes and ketones are well known in the art, and the procedures do not need to be described in detail herein. To illustrate the process, a phenolic compound of the type represented by Formula wherein $R^{11}$ is hydrogen is heated with a base or an acid, such as sulfuric acid, in a diluent such as toluene or xylene, and this mixture is then contacted with an aldehyde or ketone while heating the mixture to reflux and removing water as the reaction progresses.

Examples of phenolic compounds of the type represented by Formula XIX include 2,2'-methylene-bis(6-t-butyl-4-heptyl phenol); 2,2'-methylene-bis( 6-t-butyl-4-octyl phenol); 2,2'-methylene-bis-(4-dodecyl-6-t-butyl phenol); 2,2'-methylene-bis-(4-octyl-6-t-butyl phenol); 2,2'-methylene-bis-(4-octyl phenol); 2,2'-methylene-bis-(4-dodecyl phenol); 2,2'-methylene-bis-(4-heptyl phenol); 2,2'-methylene-bis(6-t-butyl-4-dodecyl phenol); 2,2 '-methylene-bis( 6-t-butyl-4-tetrapropenyl phenol); and 2,2'methylene-bis(6-t-butyl-4-butyl phenol).

The alkylene-coupled phenols may be obtained by reacting a phenol (2 equivalents) with 1 equivalent of an aldehyde or ketone. Lower molecular weight aldehydes are preferred and particularly preferred examples of useful aldehydes include formaldehyde, a reversible polymer thereof such as paraformaldehyde, trioxane, acetaldehyde, etc. As used in this specification and claims, the word "formaldehyde" shall be deemed to include such reversible polymers. The alkylene-coupled phenols can be derived from phenol or substituted alkyl phenols, and substituted alkyl phenols are preferred. The phenol must have an ortho or para position available for reaction with the aldehyde.

In one embodiment, the phenol will contain one or more alkyl groups which may or may not result in a sterically hindered hydroxyl group. Examples of hindered phenols which can be used in the formation of the alkylene coupled phenols include: 2,4-dimethylphenol; 2,4-di-t-butyl phenol, 2,6-di-t-butyl phenol; 4-octyl-6-t-butyl phenol; etc.

In one preferred embodiment, the phenol from which the alkylene-coupled phenols are prepared are phenols substituted in the para position with aliphatic groups containing at least 6 carbon atoms as described above. Generally, the alkyl groups contain from 6 to 12 carbon atoms. Preferred alkyl groups are derived from polymers of ethylene, propylene, 1-butene and isobutene, preferably propylene tetramer or trimer.

The reaction between the phenol and the aldehyde, polymer thereof or ketone is usually carried out between room temperature and about 150° C., preferably about 50°–125° C. The reaction preferably is carried out in the presence of an acidic or basic material such as hydrochloric acid, acetic acid, sulfuric acid, ammonium hydroxide, sodium hydroxide or potassium hydroxide. The relative amounts of the reagents used are not critical, but it is generally convenient to use about 0.3 to about 2.0 moles of phenol per equivalent of formaldehyde or other aldehyde.

The following examples illustrate the preparation of phenolic compounds of the type represented by Formulae XVII and XIX.

EXAMPLE E-6

A reaction vessel is charged with 3192 parts (12 moles) of a 4-tetrapropenyl phenol. The phenol is heated to 80° C. in 30 minutes and 21 parts (0.2 mole) of a 93% sulfuric acid solution are added to the vessel. The mixture is heated to 85° C. and 1344 parts (24 moles) of isobutylene are added over 6 hours. The temperature is maintained between 85°–91° C. After introduction of the isobutylene, the reaction is blown with nitrogen at 2 standard cubic feet per hour for 30 minutes at 85° C. Calcium hydroxide (6 parts, 0.2 mole) along with 12 parts of water are added to the reaction vessel. The mixture is heated to 130° C. under nitrogen for 1.5 hours. The reaction is vacuum stripped at 130° C. and 20 millimeters of mercury for 30 minutes. The residue is cooled to 90° C. and the residue is filtered through diatomaceous earth to give the desired product. The desired product filtrate has a specific gravity of 0.901 and a percent hydroxyl (Grignard) equals 4.25 (theoretical 4.49).

EXAMPLE E-7

A reaction vessel is charged with 798 parts (3 moles) of 4-tetrapropenyl phenol. The phenol is heated to 95°–100° C. whereupon 5 parts of a 93% solution of sulfuric acid are added to the vessel. Isobutylene (168 parts, 3 moles) is added to the vessel over 1.7 hours at 100° C. After introduction of the isobutylene the reaction is blown with nitrogen at 2 standard cubic feet per hour for one-half hour at 100° C. An additional 890 parts of the above-described phenol (2.98 moles) are added to a reaction vessel and heated to 34°–40° C. A 37% aqueous formaldehyde solution (137 grams, 1.7 moles) is added to the vessel. The mixture is heated to 135° C. with removal of water. Nitrogen blowing at 1.5 scfh begins at 105°–110° C. The reaction mixture is held at 120° C. for 3 hours under nitrogen and cooled to 83° C. whereupon 4 parts (0.05 mole) of a 50% aqueous sodium hydroxide solution are added to the vessel. The reaction mixture is heated to 135° C. under nitrogen. The reaction mixture is vacuum stripped to 135° C. and 20 millimeters of mercury for 10 minutes, cooled to 95° C., and the residue is filtered through diatomaceous earth. The product has a percent hydroxyl (Grignard) of 5.47 (theoretical 5.5) and a molecular weight (vapor phase osmometry) of 682 (theoretical 667).

EXAMPLE E-8

The general procedure of Example E-6 is repeated except that the 4-heptyl phenol is replaced by an equivalent amount of tri-propylene phenol. The substituted phenol obtained in this manner contains 5.94% hydroxyl.

EXAMPLE E-9

The general procedure of Example E-7 is repeated except that the phenol of Example E-6 is replaced by the phenol of Example E-8. The methylene coupled phenol prepared in this manner contains 5.74% hydroxyl.

In another embodiment, the lubricant compositions of the present invention may contain a metal-free (or ashless) alkyl phenol sulfide. The alkyl phenols from which the sulfides are prepared also may comprise phenols of the type discussed above and represented by Formula XVII wherein $R^{11}$ is hydrogen. For example, the alkyl phenols which can be converted to alkyl phenol sulfides include: 2-t-butyl-4-heptyl phenol; 2-t-butyl-4-octyl phenol; and 2-t-butyl-4-dodecyl phenol.

The term "alkylphenol sulfides" is meant to include di-(alkylphenol)monosulfides, disulfides, polysulfides, and other products obtained by the reaction of the alkylphenol with sulfur monochloride, sulfur dichloride or elemental sulfur. One mole of phenol is reacted with about 0.5–1.5 mole, or higher, or sulfur compound. For example, the alkyl phenol sulfides are readily obtained by mixing, one mole of an alkylphenol and 0.5–1.0 mole of sulfur dichloride. The reaction mixture is usually maintained at about 150°– 160° F. for about 2–5 hours, after which time the resulting sulfide is dried and filtered. When elemental sulfur is used, one mole of alkyl phenol is reacted with 0.5 to 2.0 moles of elemental sulfur, and temperatures of about 150°–250° C. or higher are typically used. It is also desirable that the drying operation be conducted under nitrogen or a similar inert gas.

Suitable basic alkyl phenol sulfides are disclosed, for example, in U.S. Pat. Nos. 3,372,116; 3,410,798; and 4,021,419, which are hereby incorporated by reference.

These sulfur-containing phenolic compositions described in U.S. Pat. No. 4,021,419 are obtained by sulfurizing a substituted phenol with sulfur or a sulfur halide and thereafter reacting the sulfurized phenol with formaldehyde or a reversible polymer thereof. Alternatively the substituted phenol can be first reacted with formaldehyde and thereafter reacted with sulfur or a sulfur halide to produce the desired alkyl phenol sulfide. The disclosure of U.S. Pat. No. 4,021,419 is hereby incorporated by reference for its disclosure of such compounds, and methods for preparing such compounds. A synthetic oil of the type described below is used in place of any mineral or natural oils used in the preparation of the salts for use in this invention.

In another embodiment, the antioxidant (E) may be phenothiazine, substituted phenothiazines, or derivatives such as represented by Formula XX

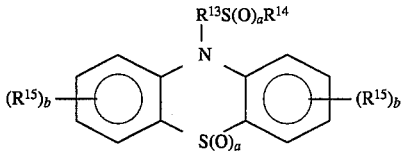

(XX)

wherein $R^{14}$ is selected from the group consisting of higher alkyl groups, or an alkenyl, aryl, alkaryl or aralkyl group and mixtures thereof; $R^{13}$ is an alkylene, alkenylene or an aralkylene group, or mixtures thereof; each $R^{15}$ is independently alkyl, alkenyl, aryl, alkaryl, arylalkyl, halogen, hydroxyl, alkoxy, alkylthio, arylthio, or fused aromatic rings, or mixtures thereof; a and b are each independently O or greater.

In another embodiment, the phenothiazine derivatives may be represented by Formula XXI

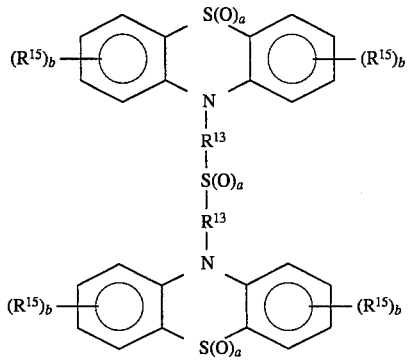

(XXI)

wherein $R^{13}$, $R^{14}$, $R^{15}$, a and b are as defined with respect to Formula XX.

The above-described phenothiazine derivatives, and methods for their preparation are described in U.S. Pat. No. 4,785,095, and the disclosure of this patent is hereby incorporated by reference for its teachings of such methods and compounds. In one embodiment, a dialkyldiphenylamine is treated with sulfur at an elevated temperature such as in the range of 145° C. to 205° C. for a sufficient time to complete the reaction. A catalyst such as iodine may be utilized to establish the sulfur bridge.

Phenothiazine and its various derivatives can be converted to compounds of Formula XX by contacting the phenothiazine compound containing the free NH group with a thio alcohol of the formula $R^{14}SR^{13}OH$ where $R^{14}$ and $R^{13}$ are defined with respect to Formula XX. The thio alcohol may be obtained by the reaction of a mercaptan $R^{14}SH$ with an alkylene oxide under basic conditions. Alternatively, the thio alcohol may be obtained by reacting a terminal olefin with mercaptoethanol under free radical conditions. The reaction between the thio alcohol and the phenothiazine compound generally is conducted in the presence of an inert solvent such as toluene, benzene, etc. A strong acid catalyst such as sulfuric acid or paratoluene sulfonic acid at about 1 part to about 50 parts of catalyst per 1000 parts of phenothiazine is preferred. The reaction is conducted generally at reflux temperature with removal of water as it is formed. Conveniently, the reaction temperature may be maintained between 80° C. and 170° C.

When it is desired to prepare compounds of the type represented by Formulae XX and XXI wherein a is 1 or 2, i.e., sulfones or sulfoxides, the derivatives prepared by the reaction with the thio alcohols described above are oxidized with an oxidizing agent such as hydrogen peroxide in a solvent such as glacial acetic acid or ethanol under an inert gas blanket. The partial oxidation takes place conveniently at from about 20° C. to about 150° C. The following examples illustrate the preparation of phenothiazines which may be utilized as the non-phenolic antioxidant (E) in the lubricants of the present invention.

EXAMPLE E-10

One mole of phenothiazine is placed in a one- liter, round bottom flask with 300 ml. of toluene. A nitrogen blanket is maintained in the reactor. To the mixture of phenothiazine and toluene is added 0.05 mole of sulfuric acid catalyst. The mixture is then heated to reflux temperature and 1.1 moles of n-dodecylthioethanol is added dropwise over a period of approximately 90 minutes. Water is continuously removed as it is formed in the reaction process.

The reaction mixture is continuously stirred under reflux until substantially no further water is evolved. The reaction mixture is then allowed to cool to 90° C. The sulfuric acid catalyst is neutralized with sodium hydroxide. The solvent is then removed under a vacuum of 2 KPa at 110° C. The residue is filtered giving a 95% yield of the desired product.

In another embodiment, the antioxidant (E) is a transition metal-containing composition. The transition metal-containing antioxidant is oil soluble. The compositions generally contain at least one transition metal selected from titanium, manganese, cobalt, nickel, copper, and zinc, preferably manganese, copper, and zinc, more preferably copper. The metals may be in the form of nitrates, nitrites, halides, oxyhalides, carboxylates, borates, phosphates, phosphites, sulfates, sulfites, carbonates and oxides. The transition metal-containing composition is generally in the form of a metal-organic compound complex. The organic compounds include carboxylic acids and esters, mono- and dithiophosphoric acids, dithiocarbamic acids and dispersants. Generally, the transition metal-containing compositions contain at least about 5 carbon atoms to render the compositions oil-soluble.

In one embodiment, the organic compound is a carboxylic acid. The carboxylic acid may be a mono- or polycarboxylic acid containing from 1 to about 10 carboxylic groups and 2 to about 75 carbon atoms, preferably 2 to about 30, more preferably 2 to about 24. Examples of monocarboxylic acids include 2-ethylhexanoic acid, octanoic acid, decanoic acid, oleic acid, linoleic acid, stearic acid and gluconic acid.

Examples of polycarboxylic acids include succinic, malonic, citraconic acids as well as substituted versions of these acids. The carboxylic acid may be one of the above-described hydrocarbyl-substituted carboxylic acylating agents.

In another embodiment, the organic compound is a mono- or dithiophosphoric acid. The dithiophosphoric acids may be any of the above-described phosphoric acids (see dihydrocarbyl dithiophosphate). A monothiophosphoric acid is prepared by treating a dithiophosphoric acid with steam or water.

In another embodiment, the organic compound is a mono- or dithiocarbamic acid. Mono- or dithiocarbamic acids are prepared by reacting carbon disulfide or carbon oxysulfide with a primary or secondary amine. The amines may be any of the amines described above.

In another embodiment, the organic compound may be any of the phenols, aromatic amines, or dispersants described above. In a preferred embodiment, the transition metal-containing composition is a lower carboxylic acid-transition metal-dispersant complex. The lower alkyl carboxylic acids contain from 1 to about 7 carbon atoms and include formic acid, acetic, propionic, butanoic, 2-ethylhexanoic, benzoic acid, and salicylic acid. The dispersant may be any of the dispersants described above, preferably the dispersant is a nitrogen-containing carboxylic dispersant. The transition metal complex is prepared by blending a lower carboxylic acid salt of a transition metal with a dispersant at a temperature from about 25 ° C. up to the decomposition temperature of the reaction mixture, usually from about 25° C. up to about 100° C. A solvent such a xylene, toluene, naphtha or mineral oil may be used.

EXAMPLE E-11

The metal complex is obtained by heating at 160° C. for 32 hours 50 parts of copper diacetate monohydrate, 283 parts of 100 neutral mineral oil, 250 milliliters of xylene and 507 parts of an acylated nitrogen intermediate prepared by reacting 4,392 parts of a polybutene-substituted succinic anhydride (prepared by the reaction of a chlorinated polybutene having a number average molecular weight of 1000 and a chlorine content of 4.3% and 20% molar excess of maleic anhydride) with 540 parts of an alkylene polyamine mixture of 3 parts by weight of triethylene tetramine and 1 part by weight of diethylene triamine, and 3240 parts of 100 neutral mineral oil at 130° C.–240° C. for 3.5 hours. The reaction is vacuum stripped to 110° C. and 5 millimeters of mercury. The reaction is filtered through diatomaceous earth to yield a filtrate which has 59% by weight oil, 0.3% by weight copper and 1.2% by weight nitrogen.

EXAMPLE E-12

(a) A mixture of 420 parts (7 moles) of isopropyl alcohol and 518 parts (7 moles) of n-butyl alcohol is prepared and heated to 60° C. under a nitrogen atmosphere. Phosphorus pentasulfide (647 parts, 2.91 moles) is added over a period of one hour while maintaining the temperature at 65°– 77° C. The mixture is stirred an additional hour while cooling. The material is filtered through a filter aid, and the filtrate is the desired phosphorodithioic acid.

(b) A mixture of 69 parts (0.97 equivalent) of cuprous oxide and 38 parts of mineral oil is prepared, and 239 parts (0.88 equivalent) of the phosphorodithioic acid prepared in (a) are added over a period of about 2 hours. The reaction is slightly exothermic during the addition, the mixture is thereafter stirred for an additional 3 hours while maintaining the temperature at about 70° C. The mixture is stripped to 105° C./10 mm.Hg. and filtered. The filtrate is a dark-green liquid containing 17.3% copper.

EXAMPLE E-13

A mixture of 285 parts of 100 neutral mineral oil and 260 parts (1.8 equivalents) of copper (I) oxide is prepared and heated to 93° C. Isopropyl, methylamyldithiophosphoric acid (1000 parts, 3.3 equivalents), prepared from phosphorus pentasulfide and a 60:40 molar mixture of methylamyl alcohol and isopropyl alcohol, is added over 3 hours to the mixture, while the temperature is maintained at about 95° C. The reaction mixture is steam blown at 105°–110° C. for 3 hours. The reaction mixture is then nitrogen blown at 82°–88° C. for one hour. The residue is filtered through diatomaceous earth. The filtrate is the desired product and contains 20% oil and 15.35% copper.

(F) Friction Modifiers

The lubricating oil compositions of the present invention also may contain friction modifiers which provide the lubricating oil with additional desirable frictional characteristics. Generally from about 0.01 to about 2 or 3% by weight of the friction modifiers is sufficient to provide improved performance. Various amides and amines, particularly tertiary amines are effective friction modifiers. Examples of tertiary amine friction modifiers include N-fatty alkyl-N,N-diethanol amines, N-fatty alkyl-N,N-diethoxy ethanol amines, etc. Such tertiary amines can be prepared by reacting a fatty alkyl amine with an appropriate number of moles of ethylene oxide. Tertiary amines derived from naturally occurring substances such as coconut oil and oleoamine are available from Akzo, Inc., Chicago, Ill. under the trade designation "Ethomeen". Particular examples are the Ethomeen-C and the Ethomeen-O series. Amides include fatty acid amides wherein the fatty acid contains from 8 to 22 carbon atoms. Examples include oleylamides, stearylamides, laurylamides, etc.

Partial fatty acid esters of polyhydric alcohols also are useful as friction modifiers. The fatty acids generally contain from about 8 to about 22 carbon atoms, and the esters may be obtained by reaction with dihydric or polyhydric alcohols containing 2 to about 8 or 10 hydroxyl groups. Suitable fatty acid esters include sorbitan monooleate, sorbitan dioleate, glycerol monooleate, glycerol dioleate, and mixtures thereof including commercial mixtures such as Emerest 2421 (Emery Industries Inc.), etc. Other examples of partial fatty acid esters of polyhydric alcohols may be found in K. S. Markley, Ed., "Fatty Acids", second edition, parts I and V, Interscience Publishers (1968).

Sulfur containing compounds such as sulfurized $C_{12-24}$ fats, alkyl sulfides and polysulfides wherein the alkyl groups contain from 1 to 8 carbon atoms, and sulfurized polyolefins also may function as friction modifiers in the lubricating oil compositions of the invention.

(SD) Supplemental Dispersants

The lubricating compositions of the present invention may include other additives such as supplementary dispersants, antiwear agents, extreme pressure agents, emulsifiers, demulsifiers, antirust agents, corrosion inhibitors, viscosity improvers, pour point depressants, dyes, and foam inhibitors. These additives may be present in various amounts depending on the needs of the final product.

The supplementary dispersants may be selected from the group consisting of: (a) amine dispersants other than the carboxylic derivatives (A) described above, (b) ester dispersants, (c) Mannich dispersants, (d) dispersant viscosity improvers and (e) mixtures thereof. In one embodiment, the dispersants may be post-treated with such reagents as urea, thiourea, carbon disulfide, aldehydes, ketones, carboxylic acids, hydrocarbon-substituted succinic anhydrides, nitriles, epoxides, boron compounds, phosphorus compounds, etc.

(a) Amine dispersants are hydrocarbyl-substituted amines. These hydrocarbyl-substituted amines are well known to those skilled in the art. These amines are disclosed in U.S. Pat. Nos. 3,275,554; 3,438,757; 3,454,555; 3,565,804; 3,755,433; and 3,822,289. These patents are hereby incorporated by reference for their disclosure of hydrocarbyl amines and methods of making the same.

Typically, amine dispersants are prepared by reacting olefins and olefin polymers (polyalkenes) with amines (mono- or polyamines). The polyalkene may be any of the polyalkenes described above. The amines may be any of the amines described above. Examples of amine dispersants include poly(propylene)amine; N,N-dimethyl-N-poly(ethylene/propylene)amine, (50:50 mole ratio of monomers); polybutene amine; N,N-di(hydroxyethyl)-N-polybutene amine; N-(2hydroxypropyl)-N-polybuteneamine; N-polybutene-aniline; N-polybutenemorpholine; N-poly(butene-)ethylenediamine; N-poly(propylene)trimethylenediamine; Npoly(butene)diethylenetriamine; N',N'-poly(butene)tetraethylenepentamine; N,Ndimethyl-N'-poly(propylene)-1,3-propylenediamine and the like.

(b) In another embodiment, the supplementary dispersant may be an ester dispersant. The ester dispersant is prepared by reacting at least one of the hydrocarbyl-substituted carboxylic acylating agents described above as (A-1) with at least one organic hydroxy compound and optionally an amine. In another embodiment, the ester dispersant is prepared by reacting the acylating agent with at least one of the above-described hydroxy amine.

The organic hydroxy compound includes compounds of the general formula $R''(OH)_m$ wherein R" is a monovalent or polyvalent organic group joined to the —OH groups through a carbon bond, and m is an integer of from 1 to about 10 wherein the hydrocarbyl group contains at least about 8 aliphatic carbon atoms. The hydroxy compounds may be aliphatic compounds such as monohydric and polyhydric alcohols, or aromatic compounds such as phenols and naphthols. The aromatic hydroxy compounds from which the esters may be derived are illustrated by the following specific examples: phenol, beta-naphthol, alphanaphthol, cresol, resorcinol, catechol, p,p'-dihydroxybiphenyl, 2-chlorophenol, 2,4-dibutylphenol, etc.

The alcohols from which the esters may be derived preferably contain up to about 40 aliphatic carbon atoms, preferably from 2 to about 30, more preferably 2 to about 10. They may be monohydric alcohols such as methanol, ethanol, isooctanol, dodecanol, cyclohexanol, etc. In one embodiment, the hydroxy compounds are polyhydric alcohols, such as alkylene polyols. Preferably, the polyhydric alcohols contain from 2 to about 40 carbon atoms, more preferably 2 to about 20; and preferably from 2 to about 10 hydroxyl groups, more preferably 2 to about 6. Polyhydric alcohols include ethylene glycols, including di-, tri- and tetraethylene glycols; propylene glycols, including di-, tri- and tetrapropylene glycols; glycerol; butane diol; hexane diol; sorbitol; arabitol; mannitol; sucrose; fructose; glucose; cyclohexane diol; erythritol; and pentaerythritols, including di- and tripentaerythritol; preferably, diethylene glycol, triethylene glycol, glycerol, sorbitol, pentaerythritol and dipentaerythritol.

The polyhydric alcohols may be esterified with monocarboxylic acids having from 2 to about 30 carbon atoms, preferably about 8 to about 18, provided that at least one hydroxyl group remains unesterified. Examples of monocarboxylic acids include acetic, propionic, butyric and fatty carboxylic acids. The fatty monocarboxylic acids have from about 8 to about 30 carbon atoms and include octanoic, oleic, stearic, linoleic, dodecanoic and tall oil acids. Specific examples of these esterified polyhydric alcohols include sorbitol oleate, including mono- and dioleate, sorbitol stearate, including mono- and distearate, glycerol oleate, including glycerol mono-, di- and trioleate and erythritol octanoate.

The carboxylic ester dispersants may be prepared by any of several known methods. The method which is preferred because of convenience and the superior properties of the esters it produces, involves the reaction of a the carboxylic acylating agents described above with one or more alcohols or phenols in ratios of from about 0. 5 equivalent to about 4 equivalents of hydroxy compound per equivalent of acylating agent. The esterification is usually carried out at a temperature above about 100° C., preferably between 150° C. and 300° C. The water formed as a by-product is removed by distillation as the esterification proceeds. The preparation of useful carboxylic ester dispersant is described in U.S. Pat. Nos. 3,522,179 and 4,234,435.

The carboxylic ester dispersants may be further reacted with at least one of the above described amines and preferably at least one of the above described polyamines. The amine is added in an amount sufficient to neutralize any nonesterifed carboxyl groups. In one preferred embodiment, the nitrogen-containing carboxylic ester dispersants are prepared by reacting about 1.0 to 2.0 equivalents, preferably about 1.0 to 1.8 equivalents of hydroxy compounds, and up to about 0.3 equivalent, preferably about 0.02 to about 0.25 equivalent of polyamine per equivalent of acylating agent.

In another embodiment, the carboxylic acid acylating agent may be reacted simultaneously with both the alcohol and the amine. There is generally at least about 0.01 equivalent of the alcohol and at least 0.01 equivalent of the amine although the total amount of equivalents of the combination should be at least about 0.5 equivalent per equivalent of acylating agent. These nitrogen-containing carboxylic ester dispersant compositions are known in the art, and the preparation of a number of these derivatives is described in, for example, U.S. Pat. Nos. 3,957,854 and 4,234,435 which have been incorporated by reference previously.

The carboxylic ester dispersants and methods of making the same are known in the art and are disclosed in U.S. Pat. Nos. 3,219,666; 3,381,022; 3,522,179; and 4,234,435 which are hereby incorporated by reference for their disclosures of the preparation of carboxylic ester dispersants.

The following examples illustrate the ester dispersants and the processes for preparing such esters.

EXAMPLE SD-1

A substantially hydrocarbon-substituted succinic anhydride is prepared by chlorinating a polybutene having a number average molecular weight of 1000 to a chlorine content of 4.5% and then heating the chlorinated polybutene with 1.2 molar proportions of maleic anhydride at a temperature of 150°–220° C. A mixture of 874 grams (1 mole) of the succinic anhydride and 104 grams (1 mole) of neopentyl glycol is maintained at 240°–250° C./30 mm for 12 hours. The residue is a mixture of the esters resulting from the esterification of one and both hydroxy groups of the glycol.

EXAMPLE SD-2

A mixture of 3225 parts (5.0 equivalents) of the polybutene-substituted succinic acylating agent prepared in Example II, 289 parts (8.5 equivalents) of pentaerythritol and 5204 parts of mineral oil is heated at 224°–235° C. for 5.5 hours. The reaction mixture is filtered at 130° C. to yield an oil solution of the desired product.

The carboxylic ester derivatives which are described above resulting from the reaction of an acylating agent with a hydroxy-containing compound such as an alcohol or a phenol may be further reacted with any of the above-described amines, and particularly polyamines in the manner described previously for the nitrogen-containing dispersants.

In another embodiment, the carboxylic acid acylating agent may be reacted simultaneously with both the alcohol and the amine. There is generally at least about 0.01 equivalent of the alcohol and at least 0.01 equivalent of the amine although the total amount of equivalents of the combination should be at least about 0.5 equivalent per equivalent of acylating agent. These carboxylic ester derivative compositions are known in the art, and the preparation of a number of these derivatives is described in, for example, U.S. Pat. Nos. 3,957,854 and 4,234,435 which are hereby incorporated by reference. The following specific example illustrates the preparation of the esters wherein both an alcohol and an amine are reacted with the acylating agent.

EXAMPLE SD-3

A mixture of 1000 parts of polybutene having a number average molecular weight of about 1000 and 108 parts (1.1 moles) of maleic anhydride is heated to about 190° C. and 100 parts (1.43 moles) of chlorine are added beneath the surface over a period of about 4 hours while maintaining the temperature at about 185°–190° C. The mixture then is blown with nitrogen at this temperature for several hours, and the residue is the desired polybutenyl-substituted succinic acylating agent.

A solution of 1000 parts of the above-prepared acylating agent in 857 parts of mineral oil is heated to about 150° C. with stirring, and 109 parts (3.2 equivalents) of pentaerythritol are added with stirring. The mixture is blown with nitrogen and heated to about 200° C. over a period of about 14 hours to form an oil solution of the desired carboxylic ester intermediate. To the intermediate, there are added 19.25 parts (0.46 equivalent) of a commercial mixture of ethylene polyamines having an average of about 3 to about 10 nitrogen atoms per molecule. The reaction mixture is stripped by heating at 205° C. with nitrogen blowing for 3 hours and filtered. The filtrate is an oil solution (45% 100 neutral mineral oil) of the desired amine-modified carboxylic ester which contains 0.35% nitrogen.

The supplementary dispersant may also be a Mannich dispersant. Mannich dispersants are generally formed by the reaction of at least one aldehyde, at least one of the above described amine and at least one alkyl substituted hydroxyaromatic compound. The reaction may occur from room temperature to 225° C., usually from 50° to about 200° C. (75° C.–150° C. most preferred), with the amounts of the reagents being such that the molar ratio of hydroxyaromatic compound to formaldehyde to amine is in the range from about 1:1:<1) to about (1:3:3).

The first reagent is an alkyl substituted hydroxyaromatic compound. This term includes phenols (which are preferred), carbon-, oxygen-, sulfur- and nitrogen-bridged phenols and the like as well as phenols directly linked through covalent bonds (e.g. 4,4'-bis(hydroxy)biphenyl), hydroxy compounds derived from fused-ring hydrocarbon (e.g., naphthols and the like); and polyhydroxy compounds such as catechol, resorcinol and hydroquinone. Mixtures of one or more hydroxyaromatic compounds can be used as the first reagent.

The hydroxyaromatic compounds are those substituted with at least one, and preferably not more than two, aliphatic or alicyclic groups having at least about 6 (usually at least about 30, more preferably at least 50) carbon atoms and up to about 400 carbon atoms, preferably 300, more preferably 200. These groups may be derived from the above described polyalkenes. In one embodiment, the hydroxy aromatic compound is a phenol substituted with an aliphatic or alicyclic hydrocarbon-based group having an $\bar{M}n$ of about 420 to about 10,000.

The second reagent is a hydrocarbon-based aldehyde, preferably a lower aliphatic aldehyde. Suitable aldehydes include formaldehyde, benzaldehyde, acetaldehyde, the butyraldehydes, hydroxybutyraldehydes and heptanals, as well as aldehyde precursors which react as aldehydes under the conditions of the reaction such as paraformaldehyde, paraldehyde, formalin and methal. Formaldehyde and its precursors (e.g., paraformaldehyde, trioxane) are preferred. Mixtures of aldehydes may be used as the second reagent.

The third reagent is any amine described above. Preferably the amine is a polyamine as described above.

Mannich dispersants are described in the following patents: U.S. Pat. No. 3,980,569; U.S. Pat. No. 3,877,899; and U.S. Pat. No. 4,454,059 (herein incorporated by reference for their disclosure to Mannich dispersants).

The supplementary dispersant may also be a dispersant-viscosity improver. The dispersant-viscosity improvers include polymer backbones which are functionalized by reacting with an amine source. A true or normal block copolymer or a random block copolymer, or combinations of both are utilized. They are hydrogenated before use in this invention to remove virtually all of their olefinic double bonds. Techniques for accomplishing this hydrogenation are well known to those of skill in the art. Briefly, hydrogenation is accomplished by contacting the copolymers with hydrogen at superatmospheric pressures in the presence of a metal catalyst such as colloidal nickel, palladium supported on charcoal, etc.

In general, it is preferred that these block copolymers, for reasons of oxidative stability, contain no more than about 5 percent and preferably no more than about 0.5 percent residual olefinic unsaturation on the basis of the total number of carbon-to-carbon covalent linkages within the average molecule. Such unsaturation can be measured by a number of means well known to those of skill in the art, such as infrared, NMR, etc. Most preferably, these copolymers contain no discernible unsaturation, as determined by the aforementioned analytical techniques.

The block copolymers typically have number average molecular weights ($\bar{M}n$) in the range of about 10,000 to about 500,000 preferably about 30,000 to about 200,000. The weight average molecular weight ($\bar{M}w$) for these copolymers is generally in the range of about 50,000 to about 500,000, preferably about 30,000 to about 300,000.

The amine source may be an unsaturated amine compound or an unsaturated carboxylic reagent which is capable of reacting with an amine. The unsaturated carboxylic reagents and amines are described above.

Examples of saturated amine compounds include N-(3,6-dioxaheptyl)maleimide, N-(3-dimethylaminopropyl)-maleimide, and N-(2-methoxyethoxyethyl)maleimide. Preferred amines are ammonia and primary amine containing compounds. Exemplary of such primary amine-containing compounds include ammonia, N,N-dimethylhydrazine, methylamine, ethylamine, butylamine, 2-methoxyethylamine, N,N-dimethyl-1,3-propanediamine, N-ethyl-N-methyl-1,3-propanediamine, N-methyl-1,3-propanediamine, N-(3-aminopropyl)morpholine, 3-methoxypropylamine, 3-isobutyoxypropylamine and 4,7-dioxyoctylamine, N-(3-aminopropyl)-N-1-methylpiperazine, N-(2-aminoethyl)piperazine, (2-aminoethyl)pyridines, aminopyridines, 2-aminoethylpyridines, 2-aminomethylfuran, 3-amino-2-oxotetrahydrofuran, N-(2-aminoethyl)pyrolidine, 2-aminomethylpyrrolidine, 1-methyl-2-aminomethylpyrrolidine, 1-amino-pyrrolidine, 1-(3-aminopropyl)-2-methylpiperidine, 4-aminomethylpiperidine, N-(2-aminoethyl)morpholine, 1-ethyl-3-aminopiperidine, 1-aminopiperidine, N-aminomorpholine, and the like. Of these compounds, N-(3-aminopropyl) morpholine and N-ethyl-N-methyl, 3-propanediamine are preferred with N,N-dimethyl-1,3-propanediamine being highly preferred.

Another group of primary amine-containing compounds are the various amine terminated polyethers. The amine terminated polyethers are available commercially from Texaco Chemical Company under the general trade designation "Jeffamine®". Specific examples of these materials include Jeffamine® M-600; M-1000; M-2005; and M-2070 amines.

Examples of dispersant-viscosity improvers are given in, for example, EP 171,167; 3,687,849; 3,756,954; and 4,320,019, which are herein incorporated by reference for their disclosure to dispersant-viscosity improvers.

The above dispersants may be post-treated with one or more post-treating reagents selected from the group consisting of boron compounds (discussed above), carbon disulfide, hydrogen sulfide, sulfur, sulfur chlorides alkenyl cyanides, carboxylic acid acylating agents, aldehydes, ketones, urea, thiourea, guanidine, dicyanodiamide, hydrocarbyl phosphates, hydrocarbyl phosphites, hydrocarbyl thiophosphates, hydrocarbyl thiophosphites, phosphorus sulfides, phosphorus oxides, phosphoric acid, hydrocarbyl thiocyanates, hydrocarbyl isocyanates, hydrocarbyl isothiocyanates, epoxides, episulfides, formaldehyde or formaldehyde-producing compounds with phenols, and sulfur with phenols.

The following U.S. Patents are expressly incorporated herein by reference for their disclosure of post-treating processes and post-treating reagents applicable to the carboxylic derivative compositions of this invention: U.S. Pat. Nos. 3,087,936; 3,254,025; 3,256,185; 3,278,550; 3,282,955; 3,284,410; 3,338,832; 3,533,945; 3,639,242; 3,708,522; 3,859,318; 3,865,813; 4,234,435; etc. U.K. Patent Nos. 1,085,903 and 1,162,436 also describe such processes.

In one embodiment, the dispersants are post-treated with at least one boron compound. The reaction of the dispersant with the boron compounds can be effected simply by mixing the reactants at the desired temperature. Ordinarily it is preferably between about 50° C. and about 250° C. In some instances it may be 25° C. or even lower. The upper limit of the temperature is the decomposition point of the particular reaction mixture and/or product.

The amount of boron compound reacted with the dispersant generally is sufficient to provide from about 0.1 to about 10 atomic proportions of boron for each mole of dispersant, i.e., the atomic proportion of nitrogen or hydroxyl group contained in the dispersant. The preferred amounts of reactants are such as to provide from about 0.5 to about 2 atomic proportions of boron for each mole of dispersant. To illustrate, the amount of a boron compound having one boron atom per molecule to be used with one mole of an amine dispersant having five nitrogen atoms per molecule is within the range from about 0.1 mole to about 50 moles, preferably from about 0.5 mole to about 10 moles.

Corrosion inhibitors, extreme pressure and antiwear agents include but are not limited to metal salts of a phosphorus acid, chlorinated aliphatic hydrocarbons; phosphorus esters including dihydrocarbyl and trihydrocarbyl phosphites; boron-containing compounds including borate esters; dimercaptothiadiazole derivatives; benzotriazole derivatives; amino-mercaptothiadiazole derivatives; and molybdenum compounds.

Viscosity improvers include but are not limited to polyisobutenes, polymethyacrylate acid esters, polyacrylate acid esters, diene polymers, polyalkyl styrenes, alkenyl aryl conjugated diene copolymers (preferably styrenemaleic anhydride copolymer esters), polyolefins and multifunctional viscosity improvers.

Pour point depressants are a particularly useful type of additive often included in the lubricating oils described herein. See for example, page 8 of "Lubricant Additives" by C. V. Smalheer and R. Kennedy Smith (Lesius-Hiles Company Publishers, Cleveland, Ohio, 1967).

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125–162.

These and other additives are described in greater detail in U.S. Pat. No. 4,582,618 (Col. 14, line 52 through Col. 17, line 16, inclusive), herein incorporated by reference for its disclosure of other additives that may be used in combination with the present invention.

The lubricating compositions of the present invention may be prepared by blending components (A) and (B) and either C-1 or C-2 as described above with or without additional optional additives such as components (D)–(F) and others described above in an oil of lubricating viscosity. More often, one or more of the chemical components of the present invention are diluted with a substantially inert, normally liquid organic diluent/solvent such as mineral oil, to form an additive concentrate. These concentrates usually comprise from about 20–90%, preferably 10–50% of component (A), 20 to 80%, preferably 0.1 to 20% of component (B) 0.1 to 20% by weight of either C-1 or C-2 and optionally one or more of the components (D) through (F). Chemical concentrations such as 15%, 20%, 30% or 50% or higher may be employed. For example, concentrates may contain on a chemical basis, from about 10 to about 50% by weight of the carboxylic derivative composition (A) and from 0.1 to about 10% of (B) and either C-1 or C-2. The concentrates may also contain about 0.001 to about 15% of (D), 0.001 to about 15% of (E) and/or about 1 to about 20% of (F).

Blending is accomplished by mixing (usually by stirring) the ingredients from room temperature up to the decomposition temperature of the mixture or individual components. Generally, the ingredients are blended at a temperature from about 25° C. up to about 250° C., preferably up to about 200° C., more preferably up to about 150° C., still more preferably up to about 100° C.

The following examples illustrate the concentrates and lubricants of the present invention. "Bal." or "remainder" in the table represents that the balance or remainder of the composition is oil. Unless otherwise indicated, the amount of each component in the examples is in percent by volume and reflects the amount of the oil-containing products used in the lubricants.

Concentrate Examples

Concentrate I

| | |
|---|---|
| Product of Example A-13 | 45 |
| Product of Example B-1 | 12 |
| Product of Example C-3 | 5 |
| Mineral Oil | 38 |

Concentrate 11

| | |
|---|---|
| Product of Example A-28 | 40 |
| Product of Example B-1 | 15 |
| Product of Example C-4 | 5 |
| Mineral Oil | 40 |

Concentrate 111

| | |
|---|---|
| Product of Example A-20 | 60 |
| Product of Example B-2 | 15 |
| Product of Example C-3 | 5 |
| Product of Example D-1 | 3 |
| Mineral Oil | 17 |

Concentrate IV

| | |
|---|---|
| Product of Example A-21 | 40 |
| Product of Example B-2 | 10 |
| Product of Example C-3 | 5 |
| Product of Example D-2 | 5 |
| Product of Example E-5 | 5 |
| Mineral Oil | 35 |

Concentrate V

| | |
|---|---|
| Product of Example A-21 | 40 |
| Product of Example ~2 | 10 |
| Product of Example C-3 | 5 |
| Product of Example D-2 | 5 |
| Product of Example E-7 | 5 |
| Mineral Oil | 35 |

Concentrate VI

| | % by weight |
|---|---|
| Calcium overbased alkyl benzene sulfonate (MR 1.2) (50% oil) | 3.25 |
| Magnesium overbased alkylbenzene sulfonate (MR 15) (32% oil) | 3.25 |
| Product of Example A-13 | 32.52 |
| Product of Example D-1 | 9.35 |
| Calcium overbased sulfurized alkyl phenol (MR 2.3) (38% oil) | 4.23 |
| Sulfurized butadiene/butyl acrylate Diels Alder adduct (17.9% S) (5% oil) | 4.07 |
| Product of Example E-6 | 2.44 |
| Product of Example B-11 | 3.90 |
| Product of Example SD-3 | 16.26 |
| Alkylated diphenyl amine | 2.03 |
| Vegetable oil | 0.810 |
| Mineral oil | Remainder |

Lubricant Examples

Lubricant A

| | |
|---|---|
| Product of Example A-13 | 6.0 |
| Product of Example ~2 | 1.2 |
| Product of Example C-3 | 0.5 |
| 100 Neutral Paraffinic Oil | Remainder |

Lubricant B

| | |
|---|---|
| Product of Example A-13 | 6.2 |
| Product of Example ~2 | 1.2 |
| Product of Example C-3 | 0.4 |
| Product of Example D-1 | 0.5 |
| 100 Neutral Paraffinic Oil | Remainder |

Lubricant C

| | |
|---|---|
| Product of Example A-21 | 5.8 |
| Product of Example ~1 | 1.0 |
| Product of Example C-4 | 0.5 |
| Product of Example D-2 | 0.5 |
| Product of Example E-5 | 0.5 |
| 100 Neutral Paraffinic Oil | Remainder |

Lubricant D

| | |
|---|---|
| Product of Example A-21 | 5.0 |
| Product of Example ~1 | 0.8 |
| Product of Example C-1 | 0.4 |
| Product of Example D-2 | 0.4 |
| Product of Example E-5 | 0.5 |
| 100 Neutral Paraffinic Oil | Remainder |

TABLE I

| Product of Lubricant Example | E[a] | F[b] | G[b] | H[b] | I[b] | J[b] | K[b] | L[b] |
|---|---|---|---|---|---|---|---|---|
| A-13 | 5.5 | 6.0 | 6.0 | 6.0 | 6.0 | 6.0 | 4.0 | 4.0 |
| B-1 | 0.3 | — | — | — | — | — | — | — |
| B-2 | — | 1.20 | 1.20 | 1.20 | 1.20 | 1.20 | — | — |
| B-11 | — | — | — | — | — | — | 0.84 | 0.48 |
| C-1 | — | — | — | 0.50 | — | — | — | — |
| C-4 | — | — | — | — | — | 0.5 | — | — |
| D-1 | 0.38 | 1.12 | 1.20 | 1.12 | 1.20 | 1.12 | 1.15 | 1.15 |
| E-3 | 0.5 | — | — | — | — | — | — | — |
| E-5 | — | — | 0.5 | — | 0.25 | — | — | — |
| E-6 | — | 1.0 | 1.0 | 1.4 | 1.0 | 1.4 | 0.52 | 0.30 |
| E-13 | 0.15 | 0.10 | — | 0.10 | — | 0.10 | — | — |
| SD-3 | — | — | — | — | — | — | 2.0 | 2.0 |
| Di(nonylphenyl)-amine | — | — | — | — | 0.25 | 0.25 | 0.25 | 0.15 |
| Calcium overbased alkyl benzene sulfonate (MR 1.2) (50% oil) | — | — | — | — | — | — | 0.70 | 0.48 |
| Calcium overbased alkyl benzene sulfonate (MR 2.4) (53% oil) | — | — | — | — | — | — | — | 0.48 |
| Calcium overbased sulfurized alkyl phenol (MR 2.3) (38% oil) | — | — | — | — | — | — | 0.90 | 0.52 |
| Sulfurized butadiene/butyl acrylate Diels-Alder adduct (17.9% S) | — | — | — | — | — | — | 0.50 | 0.30 |

TABLE I-continued

| Product of Lubricant Example | E[a] | F[b] | G[b] | H[b] | I[b] | J[b] | K[b] | L[b] |
|---|---|---|---|---|---|---|---|---|
| (5% oil) | | | | | | | | |
| Basic magnesium alkylated benzene sulfonate (32% oil, metal ratio = 15) | 0.5 | 0.25 | 0.25 | 0.25 | 0.25 | — | 0.70 | 0.40 |
| Oleyl amide | 0.10 | 0.10 | — | 0.10 | 0.10 | 0.10 | — | — |
| Vegetable oil | — | — | — | — | — | — | 0.10 | 0.10 |
| 8% Hydrogenated styrene-butadiene in 100 neutral mineral oil | 6.0 | — | — | — | — | — | — | — |
| 10% Hydrogenated Radial isoprene polymer in mineral oil | — | — | — | — | — | — | 6.5 | — |
| 8% Styrene-diene copolymer in mineral oil | — | — | — | — | — | — | — | 8.8 |
| Silicone antifoam agent | 80 ppm | 80 ppm | 80 ppm | 80 ppm | 80 ppm | 80 ppm | 80 ppm | 80 ppm |
| Oil | Bal. | Bal. | Bal. | Bal. | Bal. | Bal. | Bal. | Bal. |

[a]values are in % by volume;
[b]values are in % by weight

As stated hereinabove, lubricating oils of this invention display exceptional performance with respect to antiwear and fuel efficiency as measured by the Sequence V-E and the Sequence VI tests.

The Ford Sequence V-E test is described in the "Report of the ASTM Sludge and Wear Task Force and the Sequence VD Surveillance Panel—proposed PV2 Test", dated Oct. 13, 1987.

The test uses a 2.3 liter (140 CID) 4-cylinder overhead cam engine equipped with a multi-point electronic fuel injection system, and the compression ratio is 9.5:1. The test procedure uses a four-hour cycle consisting of three different stages. The oil temperatures (°F.) in Stages I, II and III are 155/210/115, and the water temperatures (°F.) in three stages are 125/185/115, respectively. The test oil charge volume is 106 oz., and the rocker cover is jacketed for control of upper engine temperature. The speeds and loads of the three stages are varied. The blow-by rate in Stage I is 2.00 CFM (cubic feet/minute) and the test length is 12 days. The PCV valves are replaced every 48 hours in this test.

At the end of the test, engine sludge, rocker cover sludge, piston varnish, average varnish and valve train wear are rated.

The Sequence VI test is a test utilized to qualify passenger car and light-duty truck oils in the API/SAE/ASTM Energy Conserving Category. In this test, a General Motors 3.8 L V-6 engine is operated under tightly controlled conditions, enabling precise measurements of the Brake Specific Fuel Consumption (BSFC), to indicate the lubricant-related friction present within the engine. A state-of-the-art microprocessor control and data acquisition/processing system are employed to achieve maximum precision.

Every test is preceded by an engine/system calibration using the following special ASTM oils: SAE 20W-30 moly-amine friction modified (FM), SAE 50 (LR) (low reference), and SAE 20W-30 high-reference (HR). After confirming the proper precision and calibration, a candidate oil is flushed into the engine without shut-down to undergo a 40-hour aging period at moderate temperature, light load, steady state conditions. At the conclusion of the aging, replicate BSFC measurements are taken at each of two test stages with temperatures ranging from low (150° F.) to high (275° F.), all at 1500 rpm, 8 bhp. These BSFC data are compared to corresponding measurements obtained with fresh (unaged) reference oil HR which is flushed into the engine directly after the aged candidate oil measurements are recorded.

To minimize effects of additive carry-over from the candidate oil, an abnormally high detergent flush oil (OF) is briefly run in the engine prior to the HR. Flush oil also is used during the pre-test engine calibration. Test duration is about 3.5 days, 65 operating hours.

The fuel consumption reduction provided by the candidate oil is expressed as a weighted average of the individual stage percent change (delta) (at 150° F. and 275° F.). Based on the overall correlation of the weighted test results with Five Car test results, a transform equation is used to express results in equivalent fuel economy improvement (EFEI).

The transform equation used is as follows:

$$EFEI = \frac{[0.65\ (\text{stage 150 delta}) + 0.35\ (\text{stage 275 delta})] - 0.61}{1.38}$$

For example, if a 3% improvement is observed at stage 150 and a 6% improvement at stage 275, the EFEI using the above transform equation is 2.49%.

The performance of lubricating oils of the present invention is illustrated in the following table.

| Test | Specification | Lubricant L | Lubricant K |
|---|---|---|---|
| Sequence VE | | | |
| Average Engine Sludge | 9.0 (min.) | 9.26 | 9.30 |
| Piston Skirt Varnish | 6.5 (min.) | 6.75 | 6.92 |
| Average Engine Varnish | 5.0 (min.) | 5.56 | 5.76 |
| Cam Lobe Wear: | | | |
| maximum (mils) | 15 | 4.7 | 5.20 |
| average (mils) | 5 | 1.5 | 1.86 |
| Oil Screen Sludge | 20% max. | 1% | 0% |
| Oil Ring Clogging | 15% max. | 0% | 1% |
| Sequence VI | | | |
| EFEI | 1.5 mm. | 2.57 | 3.51 |

The lubricating oil compositions of the present invention also exhibit a reduced tendency to deteriorate under conditions of use and thereby reduce wear, corrosion, rust, and the formation of such undesirable deposits as varnish, sludge, carbonaceous materials and resinous materials which tend to adhere to the various engine parts and reduce the efficiency of the engines. Lubricating oils also can be formulated in accordance with this invention which result in improved fuel economy when used in the crankcase of a passenger automobile.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating oil composition comprising a major amount of an oil of lubricating viscosity and (A) at least about 1% by weight of at least one carboxylic derivative composition produced by reacting (A-1) at least one substituted succinic acylating agent containing at least about 50 carbon atoms in the substituent with (A-2) from about 0.5 equivalent up to about 2 moles, per equivalent of acylating agent (A-1), of at least one amine compound characterized by the presence within its structure of at least one HN< group;

(B) an amount of at least one alkali metal overbased salt of a hydrocarbyl substituted carboxylic acid containing at least about 50 carbon atoms in the hydrocarbyl substituent or a mixture of a carboxylic acid and an organic sulfonic acid sufficient to provide at least about 0.002 up to about 0.01 equivalent of alkali metal per 100 grams of the lubricating oil composition provided that when the alkali metal salt comprises a mixture of overbased alkali metal salts of a hydrocarbyl-substituted carboxylic acid and a hydrocarbyl-substituted sulfonic acid, then the carboxylic acid comprises more than 50% of the acid equivalents of the mixture; and either (C-1) at least one magnesium overbased salt of an acidic organic compound having a metal ratio of at least 3 provided that the lubricating composition is free of calcium overbased salts of acidic organic compounds having a metal ratio of at least 3; or (C-2) at least one calcium overbased salt of an acidic organic compound having a metal ratio of at least 3 provided that the lubricating composition is free of magnesium overbased salts of acidic organic compounds having a metal ratio of at least 3.

2. The oil composition of claim 1 containing at least about 1.5% by weight of the carboxylic derivative composition (A).

3. The oil composition of claim 1 wherein the $\bar{M}n$ of the substituent in (A-1) is at least about 1500.

4. The oil composition of claim 1 wherein the substituent groups in (A-1) are derived from polybutene in which at least about 50% of the total units derived from butenes are derived from isobutene.

5. The oil composition of claim 1 wherein the carboxylic derivative composition (A) is obtained by reacting from about 0.7 to about 1.5 equivalents of the amine (A-2) per equivalent of the acylating agent (A-1).

6. The oil composition of claim 1 wherein the amine (A-2) is an aliphatic, cycloaliphatic or aromatic polyamine.

7. The oil composition of claim 1 wherein the succinic acylating agent (A-1) consists of substituent groups and succinic groups and the acylating agent is characterized by the presence within its structure of at least 1.3 succinic groups for each equivalent weight of the substituent groups.

8. The oil composition of claim 1 comprising (C-1) at least one magnesium overbased salt of an acidic organic compound having a metal ratio of at least 3 provided that the lubricating composition is free of calcium overbased salts of acidic organic compounds having a metal ratio of at least 3.

9. The oil composition of claim 1 wherein the alkali metal overbased salt (B) is a salt of a hydrocarbyl-substituted succinic acid wherein the number average molecular weight of the hydrocarbyl substituent is from about 900 to about 5000.

10. The oil composition of claim 9 wherein the hydrocarbyl substituent of the hydrocarbyl-substituted carboxylic acid (B) is derived from polybutene in which at least about 50% of the total units derived from butenes is derived from isobutene.

11. The oil composition of claim 1 wherein the alkali metal of (B) is sodium or potassium.

12. The oil composition of claim 1 wherein the alkali metal overbased salt (B) is characterized as having a ratio of equivalents of alkali metal to equivalents of carboxylic acid or mixture of carboxylic acid and sulfonic acid of at least about 1.5.

13. The oil composition of claim 12 wherein the ratio is from about 2 to about 40.

14. The oil composition of claim 1 further comprising (D) at least one metal dihydrocarbyl dithiophosphate.

15. The oil composition of claim 14 wherein the metal of the metal dihydrocarbyl dithiophosphate (D) is a Group II metal, aluminum, tin, iron, cobalt, lead, molybdenum, manganese, nickel or copper.

16. The oil composition of claim 14 wherein the metal of the metal dihydrocarbyl dithiophosphate (D) is zinc, copper, or mixtures thereof.

17. The oil composition of claim 14 further comprising (E) at least one antioxidant provided that the antioxidant (E) and the dithiophosphate (D) are not the same.

18. The oil composition of claim 17 wherein the antioxidant (E) is selected from the group consisting of at least one sulfur-containing composition, at least one alkylated aromatic amine, at least one phenol, at least one oil-soluble transition metal containing antioxidant, and mixtures thereof.

19. The oil composition of claim 1 wherein (C-1) comprises at least one magnesium overbased salt of a sulfonic or carboxylic acid.

20. A lubricating oil composition comprising a major amount of an oil of lubricating viscosity and (A) at least about 1% by weight of at least one carboxylic derivative composition produced by reacting (A-1) at least one substituted succinic acylating agent with (A-2) from about 0.5 equivalent up to about 2 moles, per equivalent of acylating agent (A-1), of at least one amine compound characterized by the presence within its structure of at least one HN< group wherein said substituted succinic acylating agents consist of substituent groups and succinic groups wherein the substituent groups are derived from polyalkene, said polyalkene being characterized by an $\bar{M}n$ value of 1300 to about 5000 and an $\bar{M}w/\bar{M}n$ value of about 1.5 to about 4.5, said acylating agents being characterized by the presence within their structure of an average of at least 1.3 succinic groups for each equivalent weight of substituent groups;

(B) an amount of at least one alkali metal overbased salt of a hydrocarbyl substituted carboxylic acid containing at least about 50 carbon atoms in the hydrocarbyl substituent or a mixture of a carboxylic acid and a hydrocarbyl-substituted sulfonic acid sufficient to provide at least about 0.002 up to about 0.01 equivalent of alkali metal per 100 grams of the lubricating oil composition provided that when the alkali metal salt comprises a mixture of overbased alkali metal salts of a hydrocarbyl-substituted carboxylic acid and a sulfonic acid, then the carboxylic acid comprises more than 50% of the acid equivalents of the mixture; and either (C-1) at least one magnesium overbased salt of an acidic organic compound having a metal ratio of at least 3 provided that the lubricating composition is free of calcium overbased salts of acidic organic compound having a metal ratio of at least 3; or (C-2) at least one calcium overbased salt of an acidic organic compound having a metal ratio of at least 3 provided that the lubricating composition is free of magnesium overbased salts of acidic organic compound having a metal ratio of at least 3.

21. The oil composition of claim 20 containing at least about 1.5% by weight of the carboxylic derivative composition (A).

22. The oil composition of claim 20 wherein the substituent groups in (A) are derived from polybutene in which at least about 50% of the total units derived from butenes are derived from isobutene.

23. The oil composition of claim 20 wherein the carboxylic derivative composition (A) is obtained by reacting from about 0.7 to about 1.5 equivalents of the amine (A-2) per equivalent of the acylating agent (A-1).

24. The oil composition of claim 20 wherein the carboxylic derivative composition (A) is obtained by reacting from about 0.5 up to less than 1 equivalent of the amine (A-2) per equivalent of acylating agent (A-1).

25. The oil composition of claim 20 wherein the amine (A-2) is an aliphatic, cycloaliphatic or aromatic polyamine.

26. The oil composition of claim 20 wherein the succinic acylating agent (A-1) is characterized by the presence within its structure of at least about 1.5 up to about 2.5 succinic groups for each equivalent weight of the substituent group.

27. The oil composition of claim 20 wherein the alkali metal overbased salt (B) is a salt of a hydrocarbyl-substituted succinic acid wherein the number average molecular weight of the hydrocarbyl substituent is from about 900 to about 5000.

28. The oil composition of claim 27 wherein the number average molecular weight of the hydrocarbyl substituent of the hydrocarbyl-substituted succinic acid (B) is in the range of from about 900 to about 2500.

29. The oil composition of claim 20 wherein the hydrocarbyl substituent of the hydrocarbyl-substituted carboxylic acid (B) is derived from polybutene in which at least about 50% of the total units derived from butenes is derived from isobutene.

30. The oil composition of claim 20 wherein the alkali metal of (B) is sodium or potassium.

31. The oil composition of claim 20 wherein the alkali metal overbased salt (B) is characterized as having a ratio of equivalents of alkali metal to equivalents of carboxylic acid or mixture of carboxylic acid and sulfonic acid of at least about 1.5.

32. The oil composition of claim 31 wherein the ratio is from about 2 to about 40.

33. The oil composition of claim 20 further comprising (D) at least one metal dihydrocarbyl dithiophosphate.

34. The oil composition of claim 33 wherein the metal of the metal dihydrocarbyl dithiophosphate (D) is a Group II metal, aluminum, tin, iron, cobalt, lead molybdenum, manganese, nickel or copper.

35. The oil composition of claim 33 wherein the hydrocarbyl groups of the metal dihydrocarbyl dithiophosphate (D) are each independently hydrocarbyl groups containing from 3 to about 13 carbon atoms and are attached to oxygen atoms of the dithiophosphate through secondary carbon atoms.

36. The lubricating oil composition of claim 33 wherein the dithiophosphate (D) comprises a mixture of metal salts of dihydrocarbyl phosphorodithioic acids wherein in at least one of the dihydrocarbyl phosphorodithioic acids, one of the hydrocarbyl groups (D-1) is an isopropyl or secondary butyl group, the other hydrocarbyl group (D-2) contains at least 5 carbon atoms, and at least about 10 mole percent of all of the hydrocarbyl groups present in (D) are isopropyl groups, secondary butyl groups or mixtures thereof.

37. The oil composition of claim 33 wherein the metal of the metal dihydrocarbyl dithiophosphate (D) is zinc, copper, or mixtures thereof.

38. The oil composition of claim 33 further comprising (E) at least one antioxidant provided that the antioxidant (E) and the dithiophosphate (D) are not the same.

39. The oil composition of claim 38 wherein the antioxidant (E) is selected from the group consisting of at least one sulfur-containing composition, at least one alkylated aromatic amine, at least one phenol, at least one oil-soluble transition metal containing antioxidant, and mixtures thereof.

40. The lubricating oil composition of claim 38 wherein the antioxidant (E) is an alkylated hindered phenol.

41. The oil composition of claim 38 wherein the antioxidant (E) is at least one transition metal-containing antioxidant.

42. The lubricating composition of claim 20 further comprising (SD) a supplemental dispersant.

43. The lubricating oil composition of claim 42 wherein the supplemental dispersant (SD) is (b) an ester dispersant.

44. The lubricating composition of claim 43 wherein the ester dispersant is further reacted with an amine.

45. The oil composition of claim 20 containing (C-1) at least one magnesium overbased salt of an acidic organic compound having a metal ratio of at least 3 provided the lubricating composition is free of calcium overbased salts of acidic organic compounds having a metal ratio of at least 3.

46. The oil composition of claim 45 wherein the magnesium salt is an overbased magnesium sulfonate.

47. The lubricating composition of claim 20 further comprising (F) at least one friction modifier.

48. A lubricating oil composition comprising a major amount of an oil of lubricating viscosity and (A) at least about 1.5% by weight of at least one carboxylic derivative composition produced by reacting (A-1) at least one substituted succinic acylating agent with (A-2) from about 0.7 equivalent up to about 1.5 equivalents, per equivalent of acylating agent (A-1), of at least one mine compound characterized by the presence within its structure of at least one HN< group wherein said substituted succinic acylating agents consist of substituent groups and succinic groups wherein the substituent groups are derived from polyalkene, said polyalkene being characterized by an $\bar{M}n$ value of 1300 to about 5000 and an $\bar{M}w/\bar{M}n$ value of about 1.5 to about 4.5, said acylating agents being characterized by the presence within their structure of an average of at least 1.3 succinic groups for each equivalent weight of substituent groups;

(B) an amount of at least one alkali metal overbased salt of a hydrocarbyl substituted carboxylic acid containing at least about 50 carbon atoms in the hydrocarbyl substituent or a mixture of a hydrocarbyl-substituted carboxylic acid and a hydrocarbyl-substituted sulfonic acid wherein the carboxylic acid comprises more than 50% of the acid equivalents of the mixture and wherein the mount of the alkali metal overbased salt is sufficient to provide at least about 0.002 up to about 0.01 equivalent of alkali metal per 100 grams of the lubricating composition; and either (C-1) at least one magnesium overbased salt of an acidic organic compound having a metal ratio of at least 3, provided that the lubricating oil composition is free of calcium overbased sulfonate having a metal ratio of at least 3, or (C-2) at least one calcium overbased salt of an organic acid having a metal ratio of at least 3 provided the lubricating oil composition is free of magnesium overbased sulfonate having a metal ratio of at least 3; and (D) at least one metal dihydrocarbyl dithiophosphate; and (E) at least one antioxidant, provided that the antioxidant (E) and the dithiophosphate (D) are not the same.

49. The oil composition of claim 48 wherein the substituent groups in (A-2) are derived from polybutene in which at least about 50% of the total units derived from butenes are derived from isobutene.

50. The oil composition of claim 48 wherein the amine (A-2) is an aliphatic, cycloaliphatic or aromatic polyamine.

51. The oil composition of claim 48 wherein the alkali metal overbased salt (B) is a salt of a hydrocarbyl-substituted succinic acid wherein the number average molecular weight of the hydrocarbyl substituent is from about 900 to about 5000.

52. The oil composition of claim 48 wherein the alkali metal of (B) is sodium or potassium.

53. The oil composition of claim 48 wherein the alkali metal overbased salt (B) is characterized as having a ratio of equivalents of alkali metal to equivalents of carboxylic acid or mixtures of carboxylic acid and sulfonic acid of at least about 1.5.

54. The oil composition of claim 48 wherein the metal of the metal dihydrocarbyl dithiophosphate (D) is a Group II metal, aluminum, tin, iron, cobalt, lead, molybdenum, manganese, nickel or copper.

55. The oil composition of claim 48 wherein the metal of the metal dihydrocarbyl dithiophosphate (D) is zinc, copper, or mixtures thereof.

56. The oil composition of claim 48 containing from about 0.05 to about 2% by weight of the dithiophosphate (D).

57. The oil composition of claim 48 wherein the antioxidant (E) is selected from the group consisting of at least one sulfur-containing composition, at least one alkylated aromatic amine, at least one phenol, at least one oil-soluble transition metal containing antioxidant, and mixtures thereof.

58. The oil composition of claim 48 wherein the antioxidant (E) is at least one alkylated hindered phenol.

59. The oil composition of claim 48 wherein the antioxidant (E) is at least one transition metal-containing antioxidant.

60. The lubricating composition of claim 48 wherein the supplemental dispersant (SD) is (b) an ester dispersant.

61. The lubricating composition of claim 60 wherein the ester dispersant is further reacted with an amine.

62. The lubricating composition of claim 48 further comprising (F) at least one friction modifier.

63. A lubricating oil composition comprising a major amount of an oil of lubricating viscosity and (A) at least about 1.5% by weight of at least one carboxylic derivative composition produced by reacting (A-1) at least one substituted succinic acylating agent with (A-2) from about 0.7 equivalent up to about 1.5 equivalents, per equivalent of acylating agent, of at least one amine compound characterized by the presence within its structure of at least one HN< group wherein said substituted succinic acylating agents consist of substituent groups and succinic groups wherein the substituent groups are derived from polyalkene, said polyalkene being characterized by an $\bar{M}n$ value of 1300 to about 5000 and an $\bar{M}w/\bar{M}n$ value of about 1.5 to about 4.5, said acylating agents being characterized by the presence within their structure of an average of at least 1.3 succinic groups for each equivalent weight of substituent groups;

(B) an amount of at least one alkali metal overbased salt of a hydrocarbyl-substituted carboxylic acid containing at least about 50 carbon atoms in the hydrocarbyl substituent or a mixture of a hydrocarbyl-substituted carboxylic acid and a hydrocarbyl-substituted sulfonic acid wherein the carboxylic acid comprises more than 50% of the acid equivalents of the mixture and wherein the amount of the alkali metal overbased salt is sufficient to provide at least about 0.002 up to about 0.01 equivalent of alkali metal per 100 grams of the lubricating composition;

(C-1) at least one magnesium overbased metal salt of an acid organic compound having a metal ratio of at least 3, provided that the lubricating oil composition is free of calcium overbased sulfonate having a metal ratio of at least 3;

(D) at least one metal dihydrocarbyl dithiophosphate; and (E) at least one antioxidant, provided that the antioxidant (E) and the dithiophosphate (D) are not the same.

64. The lubricating composition of claim 63 further comprising (SD) a supplemental dispersant.

65. The lubricating composition of claim 64 wherein the supplemental dispersant (SD) is (b) an ester dispersant.

66. The lubricating composition of claim 65 wherein the ester dispersant is further reacted with an amine.

67. A lubricating oil composition comprising a major mount of an oil of lubricating viscosity and (A) at least about 1.5% by weight of at least one carboxylic derivative composition produced by reacting (A-1) at least one substituted succinic acylating agent with (A-2) from about 0.7 equivalent up to about 1.5 equivalents, per equivalent of acylating agent, of at least one amine compound characterized by the presence within its structure of at least one HN< group wherein said substituted succinic acylating agents consist of substituent groups and succinic groups wherein the substituent groups are derived from polyalkene, said polyalkene being characterized by an $\bar{M}n$ value of 1300 to about 5000 and an $\bar{M}w/\bar{M}n$ value of about 1.5 to about 4.5, said acylating agents being characterized by the presence within their structure of an avenge of at least 13 succinic groups for each equivalent weight of substituent groups;

(B) an amount of at least one alkali metal overbased salt of a hydrocarbyl-substituted carboxylic acid containing at least about 50 carbon atoms in the hydrocarbyl substituent or a mixture of a hydrocarbyl-substituted carboxylic acid and a hydrocarbyl-substituted sulfonic acid wherein the carboxylic acid comprises more than 50% of the acid equivalents of the mixture and wherein the amount of the alkali metal overbased salt is sufficient to provide at least about 0.002 up to about 0.01 equivalent of alkali metal per 100 grams of the lubricating composition;

(C-2) at least one calcium overbased metal salt of an organic acid having a metal ratio of at least 3 provided the lubricating oil composition is free of magnesium overbased sulfonate having a metal ratio of at least 3;

(D) at least one dihydrocarbyl dithiophosphate;

(E) at least one antioxidant, provided that the antioxidant (E) and the dithiophosphate (D) are not the same, and (SD) a supplemental dispersant.

68. The lubricating composition of claim 67 wherein the supplemental dispersant (SD) is (b) an ester dispersant.

69. The lubricating composition of claim 68 wherein the ester dispersant is further reacted with an amine.

70. A lubricating oil composition prepared by blending a major amount of an oil of lubricating viscosity and (A) at least about 1% by weight of at least one carboxylic derivative composition produced by reacting (A-1) at least one substituted succinic acylating agent containing at least about 50 carbon atoms in the substituent with (A-2) from about 0.5 equivalent up to about 2 moles, per equivalent of acylating agent (A-1), of at least one amine compound characterized by the presence within its structure of at least one HN< group;

(B) an mount of at least one alkali metal overbased salt of a hydrocarbyl-substituted carboxylic acid containing at least 50 carbon atoms in the hydrocarbyl substituent or a mixture of a hydrocarbyl carboxylic acid and a hydrocarbyl-substituted sulfonic acid sufficient to provide at least about 0.002 up to about 0.01 equivalent of alkali metal per 100 grams of the lubricating oil composition provided that when the alkali metal salt comprises a mixture of overbased alkali metal salts of a hydrocarbyl-substituted carboxylic acid and a hydrocarbyl-substituted sulfonic acid, then the carboxylic acid comprises more than 50% of the acid equivalents of the mixture; and either (C-1) at least one magnesium overbased salt of an acidic organic compound having a metal ratio of at least 3 provided that the lubricating composition is free of calcium overbased salts of acidic organic compound having a metal ratio of at least 3; or (C-2) at least one calcium overbased salt of an acidic organic compound having a metal ratio of at least 3 provided that the lubricating composition is free of magnesium overbased salts of acidic organic compound having a metal ratio of at least 3.

71. A lubricating oil composition prepared by blending a major amount of an oil of lubricating viscosity and (A) at least about 1.5% by weight of at least one carboxylic derivative composition produced by reacting (A-1) at least one substituted succinic acylating agent with (A-2) from about 0.7 equivalent up to about 1.5 equivalents, per equivalent of acylating agent, of at least one amine compound characterized by the presence within its structure of at least one HN< group wherein said substituted succinic acylating agents consist of substituent groups and succinic groups wherein the substituent groups are derived from polyalkene, said polyalkene being characterized by an $\bar{M}n$ value of 1300 to about 5000 and an $\bar{M}w/\bar{M}n$ value of about 1.5 to about 4.5, said acylating agents being characterized by the presence within their structure of an average of at least 1.3 succinic groups for each equivalent weight of substituent groups; and (B) an amount of at least one alkali metal overbased salt of a hydrocarbyl-substituted carboxylic acid containing at least about 50 carbon atoms in the hydrocarbyl substituent or a mixture of a hydrocarbyl-substituted carboxylic acid and a hydrocarbyl-substituted sulfonic acid wherein the carboxylic acid comprises more than 50% of the acid equivalents of the mixture and wherein the amount of the alkali metal overbased salt is sufficient to provide at least about 0.002 up to about 0.01 equivalent of alkali metal per 100 grams of the lubricating composition; and either (C-1) at least one magnesium overbased metal salt of an acidic organic compound having a metal ratio of at least 3, provided that the lubricating oil composition is free of calcium overbased sulfonate having a metal ratio of at least 3, or (C-2) at least one calcium overbased metal salt of an organic acid having a metal ratio of at least 3 provided the lubricating oil composition is free of magnesium overbased sulfonate having a metal ratio of at least 3; and (D) at least one metal dihydrocarbyl dithiophosphate;

(E) at least one antioxidant, provided that the antioxidant (D) and the dithiophosphate (C) are not the same; and (SD) a supplemental dispersant.

72. A concentrate for preparing lubricating oil compositions containing at least about 0.002 up to about 0.01 equivalent of alkali metal per 100 grams of lubricating oil composition comprising from about 20% to about 90% by weight of a normally liquid, substantially inert organic diluent/solvent, and (A) from about 20 to about 80% by weight of at least one carboxylic derivative composition produced by reacting (A-1) at least one substituted succinic acylating agent with (A-2) from about 0.5 equivalent up to about 2 moles, per equivalent of acylating agent, of at least one amine compound characterized by the presence within its structure of at least one HN< group wherein said substituted succinic acylating agents consist of substituent groups and succinic groups wherein the substituent groups are derived from polyalkene, said polyalkene being characterized by an $\bar{M}n$ value of 1300 to about 5000 and an $\bar{M}w/\bar{M}n$ value of about 1.5 to about 4.5, said acylating agents being characterized by the presence within their structure of an average of at least 1.3 succinic groups for each equivalent weight of substituent groups;

(B) from about 0.1 to about 20% by weight of at least one alkali metal overbased salt of a hydrocarbyl-substituted carboxylic acid containing at least about 50 carbon atoms in the hydrocarbyl substituent or a mixture of a hydrocarbyl carboxylic acid and a hydrocarbyl-substituted sulfonic acid provided that when the alkali metal salt comprises a mixture of overbased alkali metal salts of a hydrocarbyl-substituted carboxylic acid and a hydrocarbyl-substituted sulfonic acid, then the carboxylic acid comprises more than 50% of the acid equivalents of the mixture; and either (C-1) from about 0.1 to about 20% by weight of least one magnesium overbased salt of an acidic organic compound having a metal ratio of at least 3 provided that the lubricating composition is free of calcium overbased salts of acidic organic compound having a metal ratio of at least 3; or (C-2) from about 0.1 to about 20% by weight of at least one calcium overbased salt of an acidic organic compound having a metal ratio of at least 3 provided that the lubricating composition is free of magnesium overbased salts of acidic organic compound having a metal ratio of at least 3.

73. A method comprising lubricating a spark-ignited or compression engine with the oil composition of claim 1.

74. A method comprising lubricating a spark-ignited or compression engine with the oil composition of claim 48.

* * * * *